US010702082B2

(12) United States Patent
Wong et al.

(10) Patent No.: US 10,702,082 B2
(45) Date of Patent: Jul. 7, 2020

(54) NECK PILLOW WITH CHIN SUPPORTS, MULTIPLE ANCHOR POINTS, AND MAGNETIC CLIP

(71) Applicant: Cabeau, Inc., Woodland Hills, CA (US)

(72) Inventors: Jon Wong, Long Beach, CA (US); David Sternlight, Canoga Park, CA (US); Justice Thao Le, Ontario, CA (US); Ryan Hilterbran, Los Angeles, CA (US)

(73) Assignee: Cabeau, Inc., Woodland Hills, CA (US)

( * ) Notice: Subject to any disclaimer, the term of this patent is extended or adjusted under 35 U.S.C. 154(b) by 534 days.

(21) Appl. No.: 15/278,756

(22) Filed: Sep. 28, 2016

(65) Prior Publication Data

US 2017/0086607 A1 Mar. 30, 2017

Related U.S. Application Data

(60) Provisional application No. 62/234,593, filed on Sep. 29, 2015, provisional application No. 62/377,494, (Continued)

(51) Int. Cl.

| | |
|---|---|
| ***A47G 9/10*** | (2006.01) |
| ***A47C 7/38*** | (2006.01) |
| ***A47G 9/00*** | (2006.01) |

(52) U.S. Cl.

CPC ..... *A47G 9/1072* (2013.01); *A47C 7/383* (2013.01); *A47G 2009/004* (2013.01); *A47G 2009/1018* (2013.01)

(58) Field of Classification Search

CPC ..... A47G 9/1072; A47G 2009/004; A47G 2009/1018; A47C 7/383

See application file for complete search history.

(56) References Cited

U.S. PATENT DOCUMENTS

| | | | | |
|---|---|---|---|---|
| 15,581 | A | 8/1856 | Slaughter | 297/393 |
| 1,468,072 | A | 9/1923 | Ogle | 5/654 |

(Continued)

FOREIGN PATENT DOCUMENTS

| | | |
|---|---|---|
| AU | 199176466 | 11/1991 |
| AU | A 7646691 | 11/1991 |

(Continued)

OTHER PUBLICATIONS

Examination Report from corresponding patent appl. No. GB1418089.7, dated Feb. 22, 2017.

(Continued)

*Primary Examiner* — Robert G Santos
*Assistant Examiner* — Rahib T Zaman
(74) *Attorney, Agent, or Firm* — DLA Piper LLP (US)

(57) ABSTRACT

A neck pillow for supporting the head of a user comprises left, right, and rear portions so as to be generally U-shaped. The neck pillow may include an inner frame which may be made of a material more rigid and denser than an outer material of the pillow so as to provide support. The left and right portions may include a chin support or protrusion so as to increase user comfort. Pillows according to the present disclosure may also include anchor points on each side for adjustment of the degree to which a closure mechanism attached to a connector such as a drawstring can be tightened. A closure mechanism which may be attached to the drawstring portions may include internal components that can prevent or make more difficult disconnection via horizontal force, and may also include magnets for connection of the left and right sides thereof.

26 Claims, 42 Drawing Sheets

Related U.S. Application Data filed on Aug. 19, 2016, provisional application No. 62/396,018, filed on Sep. 16, 2016.

(56) References Cited

U.S. PATENT DOCUMENTS 1,787,832 A 5/1929 Mueller
D98,859 S 3/1936 Garwood
D169,631 S 5/1953 Norman et al.
2,774,601 A 12/1956 White
3,164,151 A 1/1965 Esmond
3,327,330 A 6/1967 McCullough
4,031,578 A 6/1977 Sweeney et al.
4,097,086 A * 6/1978 Hudson ..... B60N 2/882 297/217.1
D256,728 S 9/1980 Allen
4,285,081 A 8/1981 Price ..... 5/637
D263,625 S 3/1982 McKnight
4,345,347 A 8/1982 Kantor ..... 5/644
4,617,691 A 10/1986 Monti
4,847,933 A 7/1989 Bedford
5,205,611 A 4/1993 Stephens
5,313,678 A 5/1994 Redwill ..... 5/639
5,339,472 A 8/1994 Yin
5,378,042 A 1/1995 Daneshvar
D368,527 S 4/1996 Brooke
5,588,445 A 12/1996 Brown
D396,594 S 8/1998 Lefebvre
D396,980 S 8/1998 Novros
D404,238 S 1/1999 Keilhauer
D414,974 S 10/1999 Marrone et al.
D416,745 S 11/1999 Noyes
5,974,607 A * 11/1999 Smith ..... A61G 7/072 297/393
D419,024 S 1/2000 Lenahan
6,010,192 A 1/2000 King ..... 297/397
D420,845 S 2/2000 Rumage
6,219,865 B1 4/2001 Stokesbary
6,230,348 B1 5/2001 Patrikakis ..... 5/636
6,230,349 B1 5/2001 Silver et al. ..... 5/636
D443,461 S 6/2001 Hall
D444,981 S 7/2001 Hall
D445,624 S 7/2001 Futagami ..... D6/604
D446,863 S 8/2001 Carroll
6,408,468 B1 6/2002 Comfort ..... 5/636
6,435,617 B1 8/2002 McNair ..... 297/397
6,447,468 B1 * 9/2002 Hankins ..... A61F 5/012 128/845
D481,247 S 10/2003 Roberts et al. ..... D6/604
6,658,681 B2 * 12/2003 Britto ..... A47D 13/083 5/636
D486,028 S 2/2004 Cathey
D501,349 S 2/2005 Harris
D503,062 S 3/2005 Nash
6,926,686 B2 8/2005 Cheatham
6,966,088 B1 11/2005 Hu
D522,300 S 6/2006 Roberts
7,185,378 B2 * 3/2007 Smith ..... A45C 13/26 128/DIG. 23
7,225,485 B2 * 6/2007 Binder ..... A47G 9/10 5/622
D550,495 S 9/2007 Boutin
D567,562 S 4/2008 Nash
7,437,788 B1 10/2008 Holman ..... 5/636
D582,045 S 12/2008 James
D582,713 S 12/2008 Baldwin ..... D6/601
D597,364 S 8/2009 Lindgren
D607,682 S 1/2010 Presman
D619,402 S 7/2010 Sternlight et al. ..... D6/601
7,779,492 B2 8/2010 Mangano ..... 5/482
7,788,752 B2 9/2010 Tidwell et al. ..... 5/655
7,865,987 B2 1/2011 Deetsch ..... 5/640
7,909,406 B2 3/2011 Samuelsen ..... 297/397
D637,439 S 5/2011 Mettler
D637,440 S 5/2011 Mettler
D647,624 S 10/2011 Thorgilsdottir
8,144,913 B1 3/2012 Myles ..... 381/374
8,239,987 B2 8/2012 Sharp ..... 5/639
8,316,488 B2 11/2012 Rojas
8,382,692 B1 * 2/2013 Chao ..... A47C 7/383 128/845
8,646,134 B1 2/2014 Alletto, Jr.
8,887,332 B2 11/2014 Alletto
8,898,840 B1 * 12/2014 Majette ..... A47C 7/383 297/393
9,015,883 B2 4/2015 Alletto
9,155,408 B2 10/2015 Alletto, Jr.
D746,080 S 12/2015 Mittelstadt ..... D6/601
D754,454 S 4/2016 Schwingendorf ..... D6/601
9,386,868 B2 7/2016 Alletto, Jr.
D762,400 S 8/2016 Wong ..... D6/601
D769,029 S 10/2016 Okwumabua ..... D6/601
9,526,360 B2 * 12/2016 Sternlight ..... A47G 9/02
9,968,197 B2 * 5/2018 Wong ..... A47C 7/383
10,383,465 B2 * 8/2019 Sternlight ..... A47G 9/10
2001/0054837 A1 12/2001 O'Connor
2002/0050007 A1 * 5/2002 Kim ..... A47G 9/10 5/636
2002/0129449 A1 9/2002 Harker
2003/0135927 A1 7/2003 Hsia
2003/0137178 A1 7/2003 Craft et al. ..... 297/452.41
2004/0237206 A1 12/2004 Webster
2005/0150050 A1 7/2005 Wolf et al. ..... 5/636
2005/0173300 A1 8/2005 O'Connor
2005/0179300 A1 8/2005 O'Connor et al. ..... 297/391
2005/0229557 A1 10/2005 Little et al.
2007/0033737 A1 2/2007 Melton ..... 5/640
2007/0052274 A1 * 3/2007 Morphew ..... B60N 2/2851 297/392
2007/0067915 A1 3/2007 Pryor ..... 5/636
2007/0271703 A1 11/2007 Brown et al. ..... 5/636
2007/0297633 A1 12/2007 Kaulfuss
2008/0104764 A1 5/2008 Chen ..... 5/644
2008/0216244 A1 * 9/2008 Minton ..... A47G 9/10 5/640
2008/0229498 A1 9/2008 Grosso ..... 5/244
2009/0013471 A1 * 1/2009 Yang ..... A47C 7/383 5/640
2009/0019641 A1 * 1/2009 Ali ..... B60N 2/882 5/636
2009/0133192 A1 * 5/2009 Hassell ..... A47C 7/383 5/639
2009/0133193 A1 5/2009 Weise ..... 5/640
2009/0276960 A1 11/2009 Chou
2011/0061167 A1 * 3/2011 Farley ..... A47G 9/10 5/652
2011/0094033 A1 * 4/2011 Lee ..... A61F 5/56 5/636
2011/0235832 A1 9/2011 Riopel ..... 381/300
2011/0314609 A1 12/2011 Lee ..... 5/655.3
2012/0011655 A1 * 1/2012 Rojas ..... A47C 7/383 5/636
2012/0313417 A1 * 12/2012 Hurwitz ..... B60N 2/882 297/391
2013/0098364 A1 * 4/2013 Davis ..... A47G 9/1081 128/206.21
2013/0119716 A1 * 5/2013 Stronconi ..... A47C 20/02 297/180.1
2013/0125312 A1 5/2013 Harooni ..... 5/639
2013/0232693 A1 9/2013 Myers ..... 5/636
2013/0232694 A1 * 9/2013 Ross ..... A47G 9/1009 5/639
2013/0254998 A1 10/2013 Walker
2014/0000036 A1 1/2014 Cohen
2014/0021751 A1 1/2014 Lang
2014/0041091 A1 2/2014 Sternlight
2014/0310877 A1 * 10/2014 Sternlight ..... A47G 9/10 5/639
2015/0150391 A1 * 6/2015 Hsu ..... A47G 9/10 5/636
2015/0157130 A1 * 6/2015 Kellock ..... B60N 2/80 5/636

(56) References Cited

U.S. PATENT DOCUMENTS

| | | | | |
|---|---|---|---|---|
| 2015/0257538 | A1* | 9/2015 | MacDougall | B60N 2/882 297/217.1 |
| 2015/0257555 | A1* | 9/2015 | Wong | A47C 7/383 5/636 |
| 2015/0351564 | A1* | 12/2015 | Vogel | A47G 9/1081 5/640 |
| 2016/0183685 | A1 | 6/2016 | Kang | 5/639 |
| 2017/0000273 | A1 | 1/2017 | Mitchell | |
| 2017/0042332 | A1* | 2/2017 | Atkinson | A47C 7/383 |
| 2017/0065108 | A1* | 3/2017 | Thorn | A47C 7/383 |
| 2017/0071349 | A1 | 3/2017 | Wong | |

FOREIGN PATENT DOCUMENTS

| | | | |
|---|---|---|---|
| AU | 2003201842 | A1 | 10/2003 |
| CN | 86300949 | | 5/1987 |
| CN | 3006418 | | 9/1990 |
| CN | 3010592 | | 9/1991 |
| CN | 3015753 | | 10/1992 |
| CN | 3052608 | | 12/1996 |
| CN | 013590715 | | 12/2001 |
| CN | 3238498 | | 5/2002 |
| CN | 3289601 | | 4/2003 |
| CN | 3435056 | | 3/2005 |
| CN | 3440171 | | 4/2005 |
| CN | 3476279 | | 9/2005 |
| CN | 2836650 | | 11/2005 |
| CN | 3487002 | | 11/2005 |
| CN | 3497652 | | 1/2006 |
| CN | 2006301323942 | | 6/2006 |
| CN | 3563694 | | 9/2006 |
| CN | 3578942 | | 11/2006 |
| CN | 3614520 | | 2/2007 |
| CN | 300685967 | | 9/2007 |
| CN | 300690834 | | 9/2007 |
| CN | 300707538 | | 11/2007 |
| CN | 300711427 | | 11/2007 |
| CN | 300774484 | | 5/2008 |
| CN | 300811882 | | 8/2008 |
| CN | 300882439 | | 2/2009 |
| CN | 300892694 | | 3/2009 |
| CN | 300941334 | | 6/2009 |
| CN | 300959418 | | 7/2009 |
| CN | 301025929 | | 9/2009 |
| CN | 301109905 | | 1/2010 |
| CN | 301137730 | | 2/2010 |
| CN | 301151430 | | 3/2010 |
| CN | 102166088 | | 8/2011 |
| CN | 201958085 | | 8/2011 |
| CN | 202014937 | U | 10/2011 |
| CN | 103126791 | A | 6/2013 |
| CN | 103458742 | | 12/2013 |
| CN | 206525873 | U | 9/2017 |
| EP | 0026844310002 | | 4/2015 |
| FR | 1076118 | | 10/1954 |
| GB | 2055656 | | 8/1996 |
| GB | 2198341 | A1 | 6/2000 |
| JP | 200015308 | | 10/2001 |
| JP | 3132278 | | 5/2007 |
| JP | 1543718 | | 2/2015 |
| KR | 3019990015333 | | 2/2000 |
| KR | 3020000029799 | | 5/2001 |
| KR | 3020010000482 | | 8/2001 |
| KR | 3020010007585 | | 8/2001 |
| KR | 20050019575 | A | 3/2005 |
| KR | 200424871 | | 8/2006 |
| KR | 3020070002191 | | 1/2007 |
| KR | 3020080018019 | | 5/2008 |
| KR | 3020080039948 | | 10/2008 |
| KR | 3020080049371 | | 11/2008 |
| KR | 3008249610000 | | 11/2015 |
| RU | 34338 | U1 | 12/2003 |
| WO | WO 2011122769 | | 10/2011 |
| WO | WO 2013155003 | | 10/2013 |
| WO | WO 2015/138654 | A1 | 9/2015 |
| WO | WO 2015138654 | A1 | 9/2015 |

OTHER PUBLICATIONS

Search Report from Russian Federation patent application No. 2013131760, dated Mar. 6, 2017.
Notification of Refusal from JPO Appl. No 2016-500702, dated Mar. 31, 2017.
Notification of Refusal from JPO Appl. No. 2016-500700, dated Mar. 31, 2017.
Office Action from Chinse Patent Appl. No. 201580023142.2, dated Jun. 2, 2017.
Third Party Submittal, Kirby IP Canada, dated Sep. 18, 2015.
Third Party Observation from International Appl. No. PCT/US2013/035646, dated Jun. 16, 2014.
Third Party Observation from Australian Appl. No. AU2014100424, dated Jun. 18, 2014.
Patent Examination Report No. 2. from Australian Patent Appl. No. 2013206536, dated Jan. 16, 2015.
Supplementary European Search Report from Appl. No. EP13745557, dated Sep. 15, 2014.
Third Party Observation for Appl. No. EP20130745557, dated Jun. 14, 2014.
Office Action from U.S. Appl. No. 13/488,443, dated Apr. 18, 2014.
Office Action from U.S. Appl. No. 13/488,443, dated Jul. 23, 2015.
Office Action from U.S. Appl. No. 13/488,443, dated Oct. 29, 2014.
Response to Office Action from U.S. Appl. No. 13/488,433, dated Apr. 28, 2015.
Response to Office Action from U.S. Appl. No. 13/488,433, dated Sep. 18, 2014.
Response to Office Action from U.S. Appl. No. 13/488,433, dated Dec. 12, 2014.
Office Action from U.S. Appl. No. 14/394,259, dated May 7, 2015.
Response to Office Action from U.S. Appl. No. 14/394,259, dated Nov. 9, 2015.
Examination from European Patent Appl. No. 13 745 557.2, dated Jun. 12, 2015.
Notice of Preliminary Rejection from Korean Patent Appl. No. 10-2013-7034274, dated Jul. 2, 2015.
International Search Report and Written Opinion from corresponding PCT application No. PCT/US2015/020038, dated May 29, 2015.
Third party observations on Great Britain Appl. No. GB1418089.7 dated Jun. 23, 2016.
Third Party Observations from corresponding UK Patent appl. No. 1418089.7 dated Oct. 27, 2015.
Examination from European Patent Appl. No. 13 745 557.2-1653, dated Mar. 7, 2016.
Third Party Observations filed with the Australian IP against Australian Patent Appl. No. 2015202263 and received Feb. 23, 2016.
Office Action from U.S. Appl. No. 13/488,443, dated Feb. 11, 2016.
Office Action from U.S. Appl. No. 14/394,259, dated Feb. 5, 2016.
U.S. Appl. No. 29/325,226, filed Aug. 4, 2009, Lindgren.
U.S. Appl. No. 29/196,689, filed Mar. 22, 2005, Jill Nash.
U.S. Appl. No. 29/327,069, filed Jan. 12, 2010, C. Presman.
U.S. Appl. No. 29/316,623, filed Jul. 31, 2001, T. Futagami.
U.S. Appl. No. 29/197,503, filed Feb. 1, 2005, L. M. Harris.
U.S. Appl. No. 29/174,190, filed Oct. 28, 2003, B. Roberts.
U.S. Appl. No. 29/218,867, filed Jun. 6, 2006, B. Roberts.
U.S. Appl. No. 29/098,894, filed Jan. 18, 2000, Lenahan.
U.S. Appl. No. 29/262,985, filed Sep. 11, 2007, C. Boutin.
U.S. Appl. No. 29/129,963, filed Jun. 12, 2001, D. T. Hall.
U.S. Appl. No. 29/224,808, filed Apr. 29, 2008, J. Nash.
U.S. Appl. No. 29/129,962, filed Jul. 17, 2001, D. T. Hall.
Office Action from Columbian Patent Appl. No. 14-249922-4, dated Jun. 16, 2016.
Notice of Final Rejection from Korean Patent Appl. No. 10-2013-7034274, dated Apr. 15, 2016.
First Office Action (summary) from Mexican Design Appl. No. MX/f/2015/001297, dated Mar. 14, 2016.

(56) References Cited

OTHER PUBLICATIONS

Notice of Allowance and Search Report from Taiwanese Patent Appl. No. 104302012, dated Apr. 20, 2016.
3rd party observations filed against European Patent Application No. 13745557.2, filed on Oct. 26, 2016.
Intention to Grant from European Patent Appl. No. 13 745 557.2-1653. dated Dec. 22, 2016.
Office Action from U.S. Appl. No. 15/348,742, dated Jan. 9, 2017.
Edge. (n. d.) American Heritage® Dictionary of the English Language, Fifth Edition. (2011). Retrieved Jan. 3, 2017 from http://www.thefreedictionary.com/edge.
Office Action from U.S. Appl. No. 29/568,003, dated Jan. 26, 2017.
Office Action for U.S. Appl. No. 14/518,719; dated Aug. 15, 2017.
Office Action for European Patent Application No. 15761243.3; dated Oct. 18, 2017.
Certificate of Registration for Registration No. 002684431-0001; Dated Apr. 20, 2015.
Certificate of Registration for Registration No. 002684431-0002; Dated Apr. 20, 2015.
Statement of Grant of Protection for International Registration No. DM/090972-002; Japanese Registration No. 1577739; Dated May 2, 2017.
Statement of Grant of Protection for International Registration No. DM/090972-004; Japanese Registration No. 1577740; Dated May 2, 2017.
Notification of Refusal for Korean Registration No. DM/090972-002; dated Sep. 12, 2017.
International Search Report for International Application No. PCT/US16/54178; dated Sep. 28, 2016.

* cited by examiner

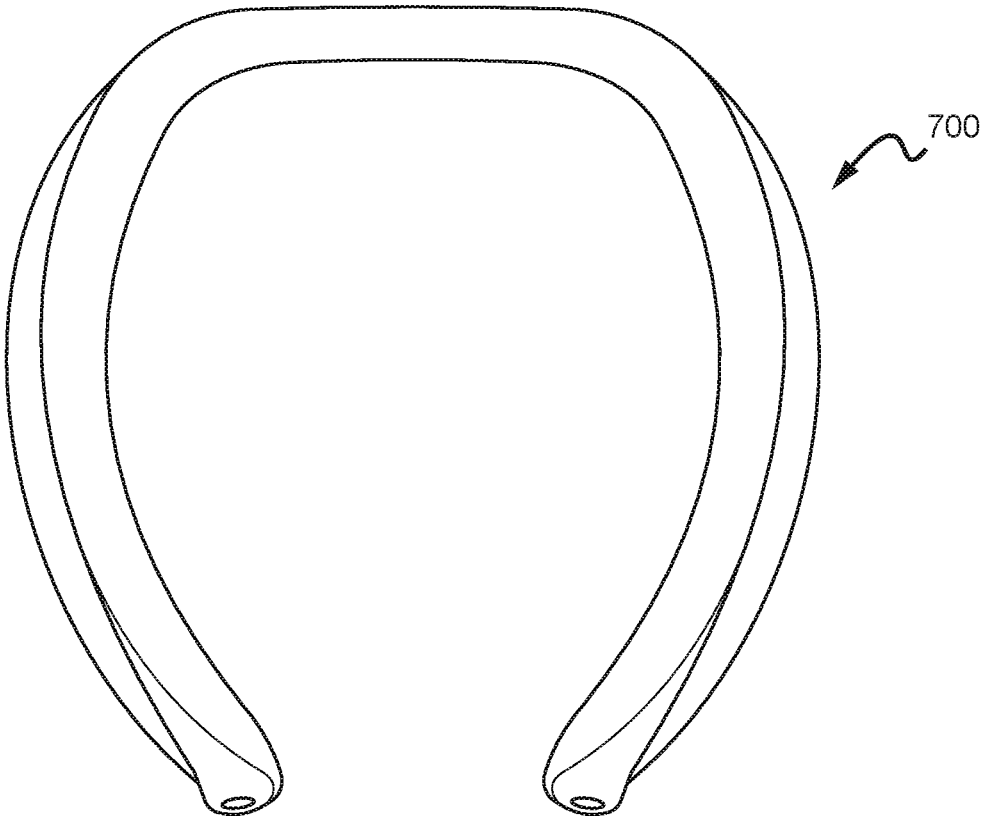
FIG. 7B
FIG. 7C
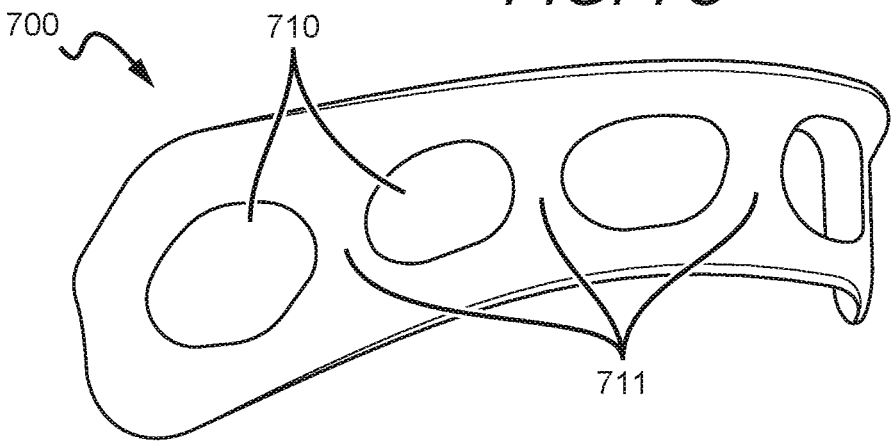

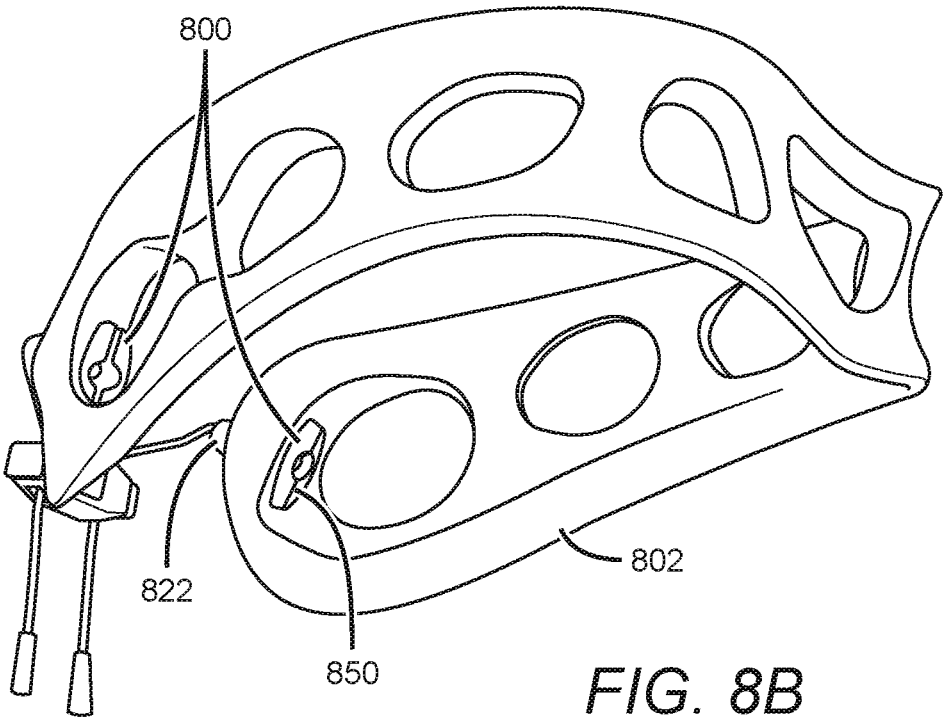
FIG. 8B
FIG. 8C
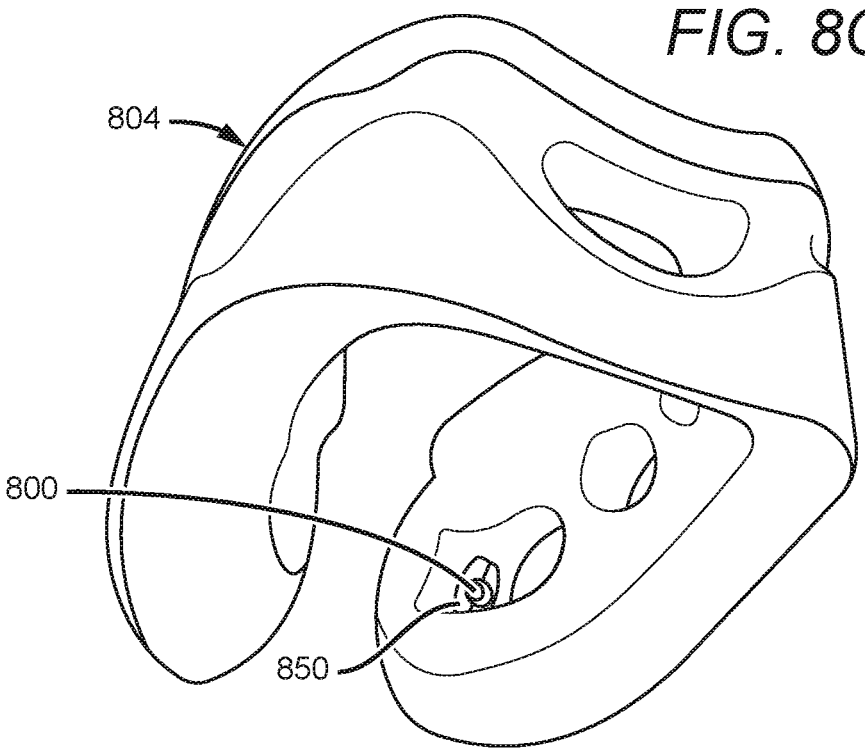

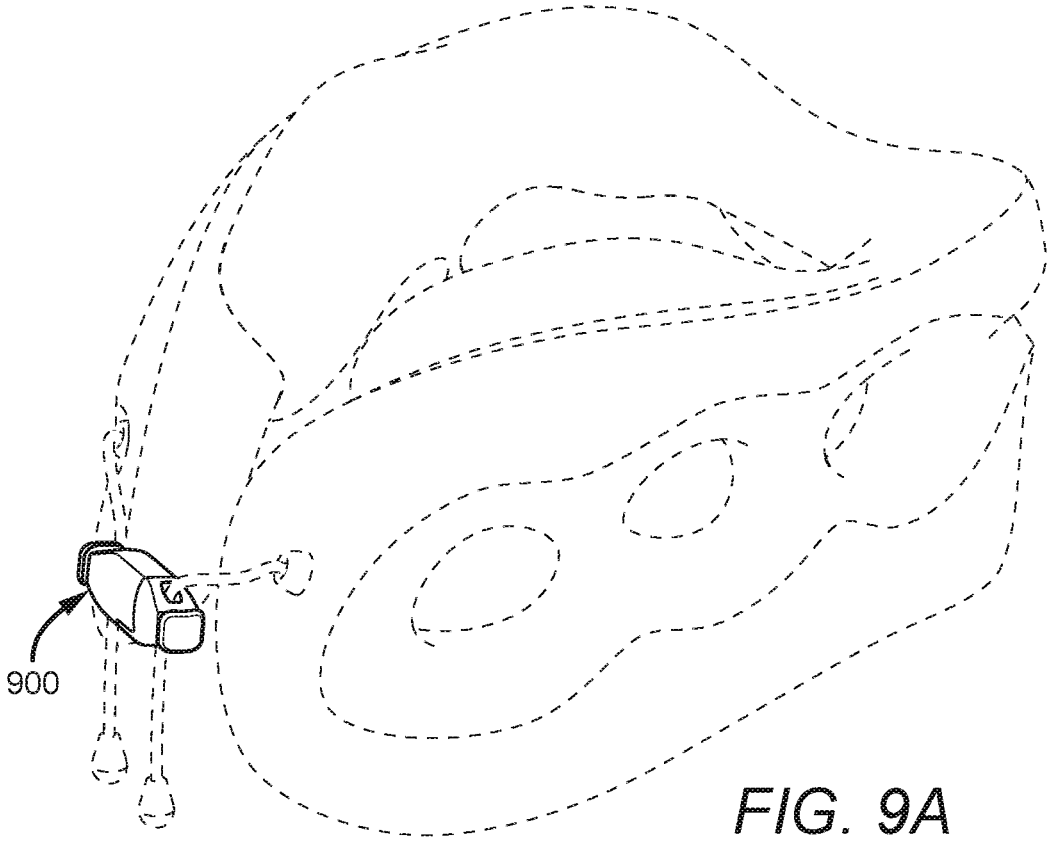
FIG. 9A
FIG. 9B
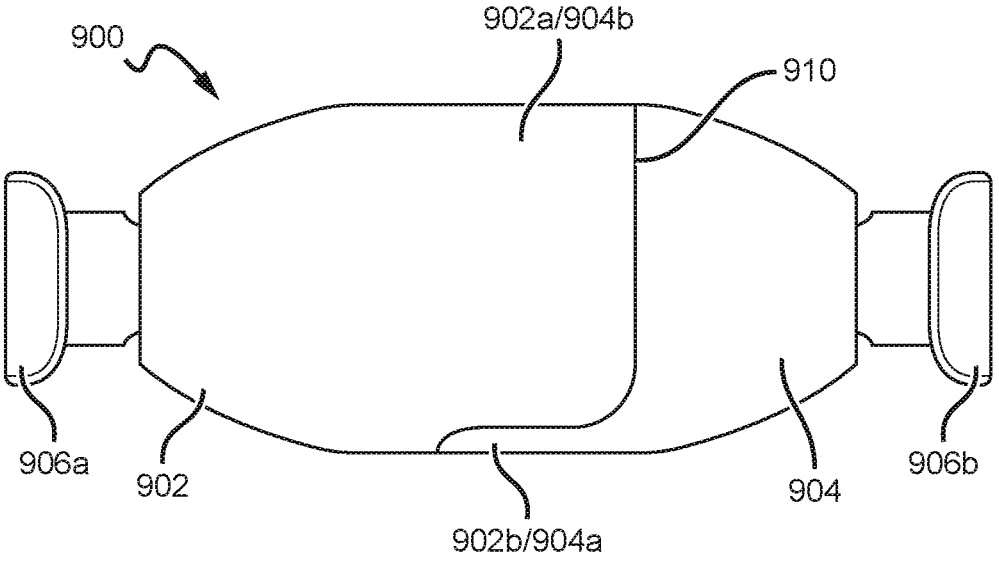

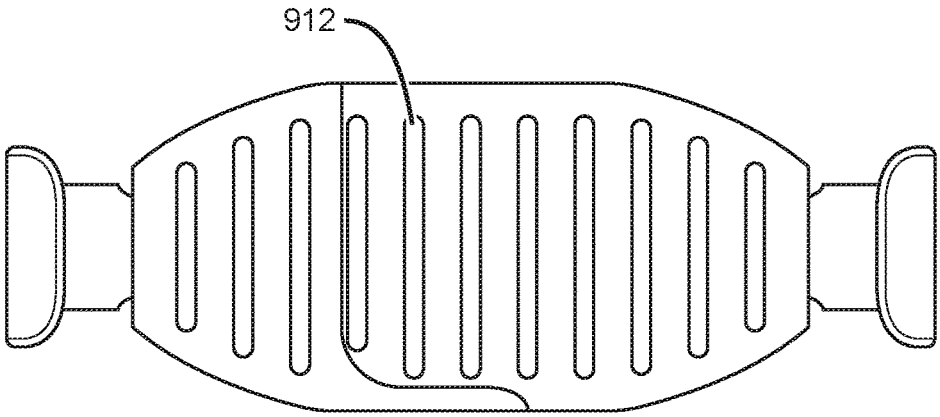
FIG. 9C
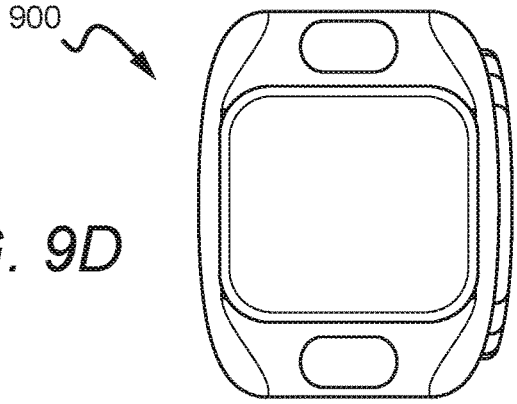
FIG. 9D
FIG. 9E
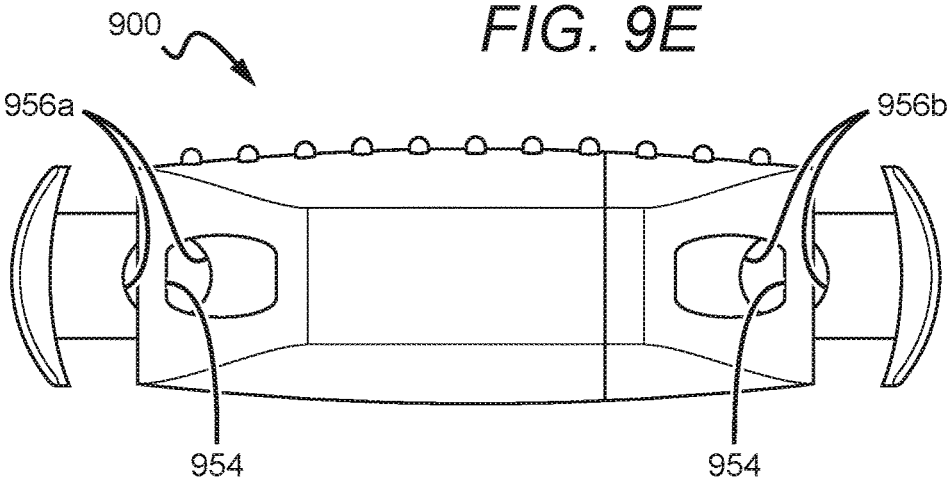

FIG. 11A
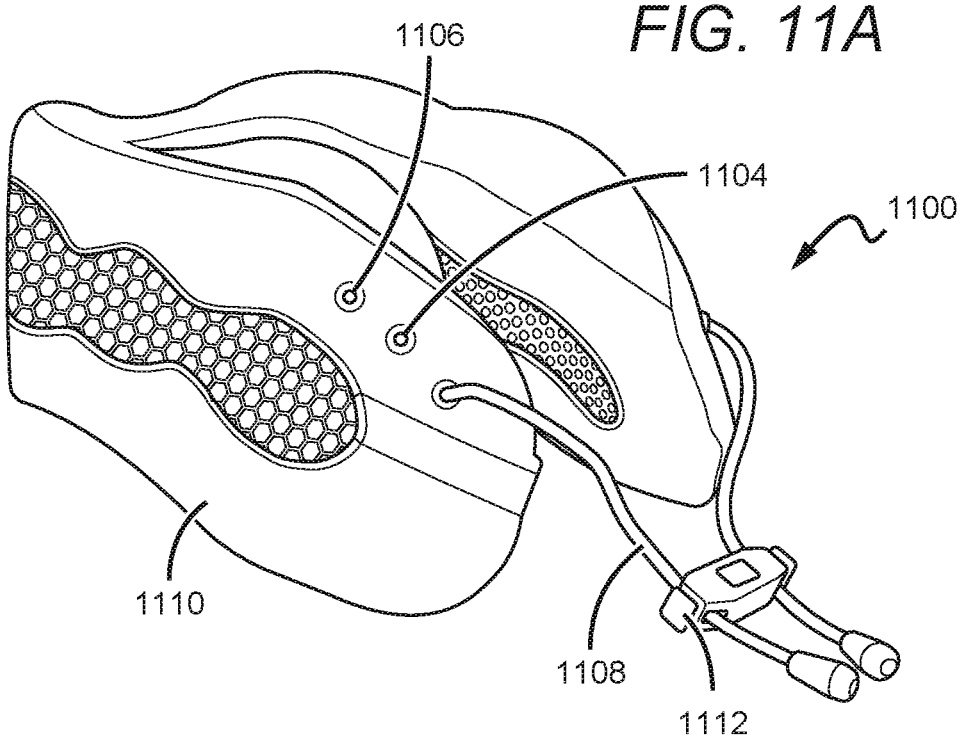
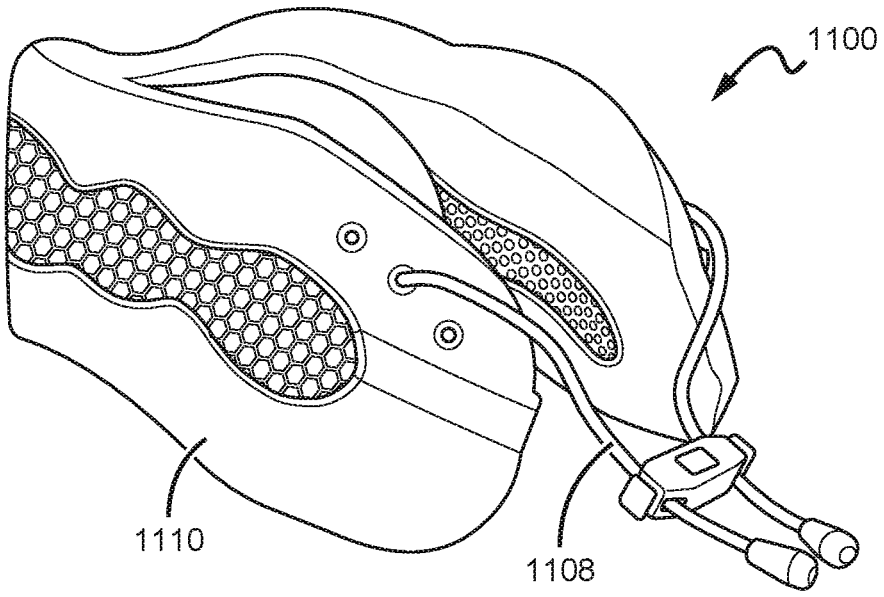
FIG. 11B

FIG. 11C
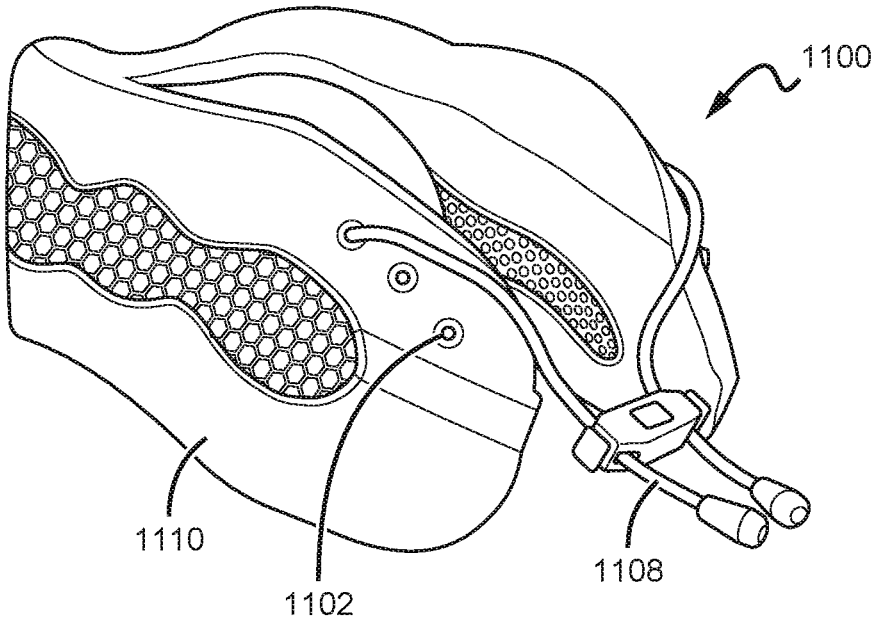
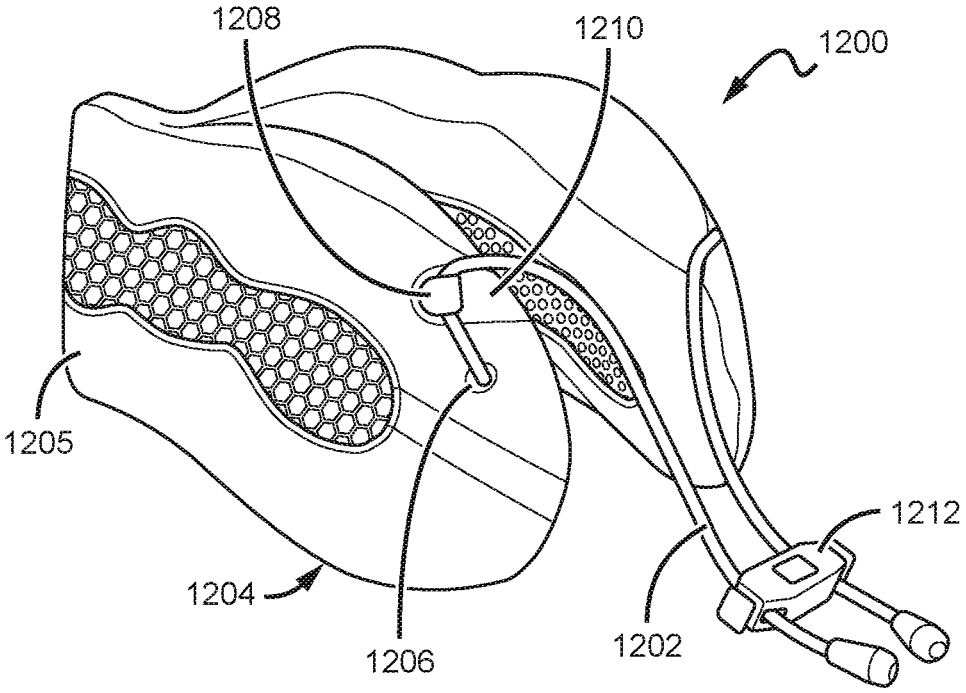
FIG. 12

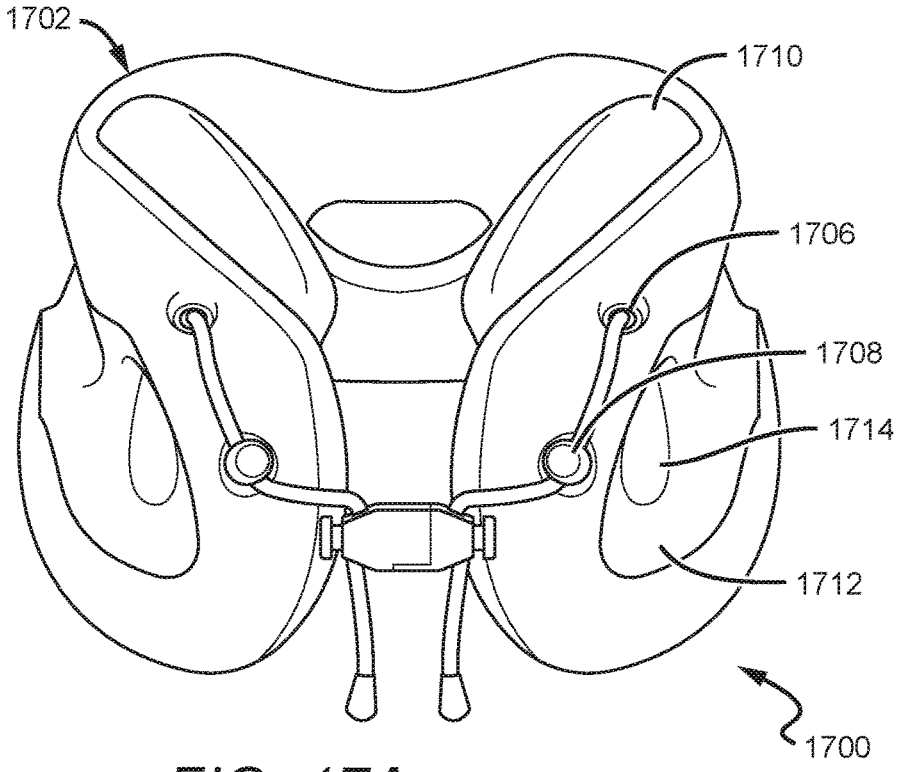
FIG. 17A
FIG. 17B
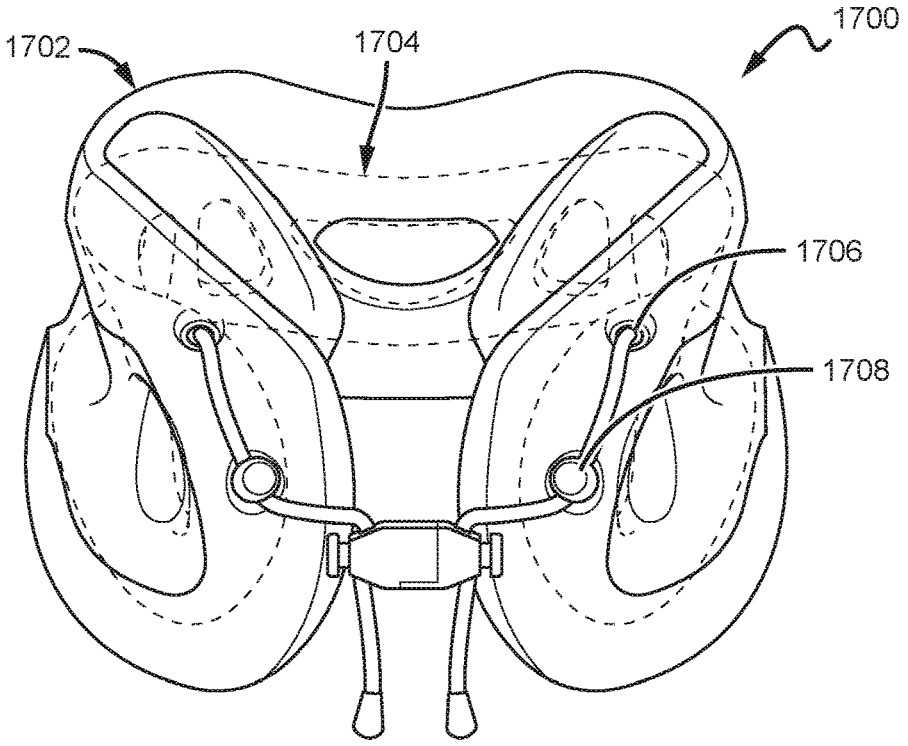

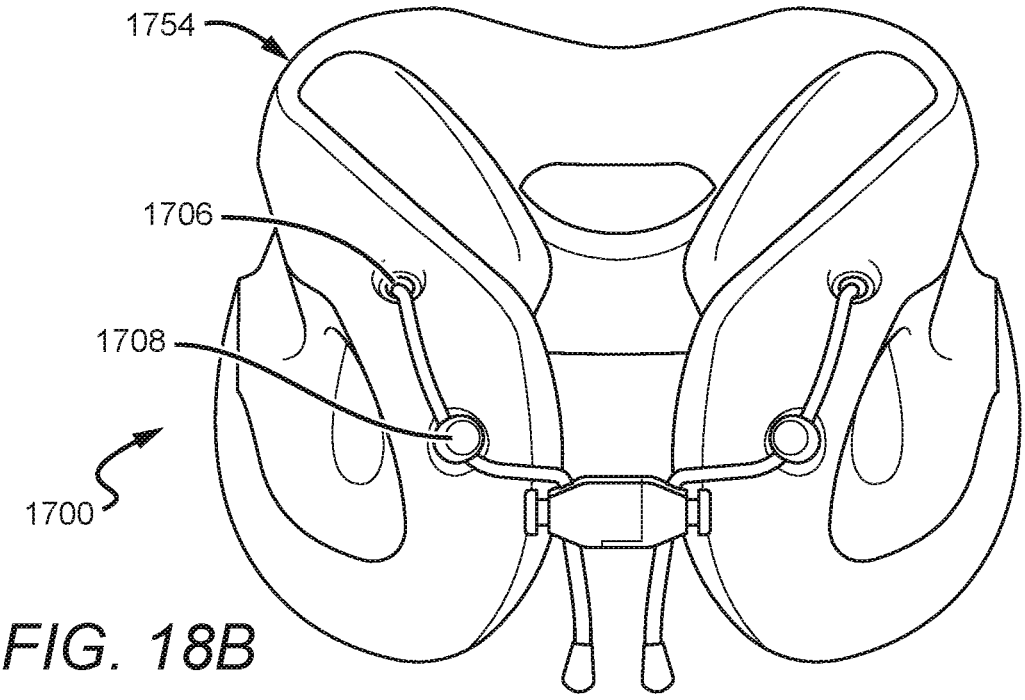
FIG. 18B
FIG. 18C
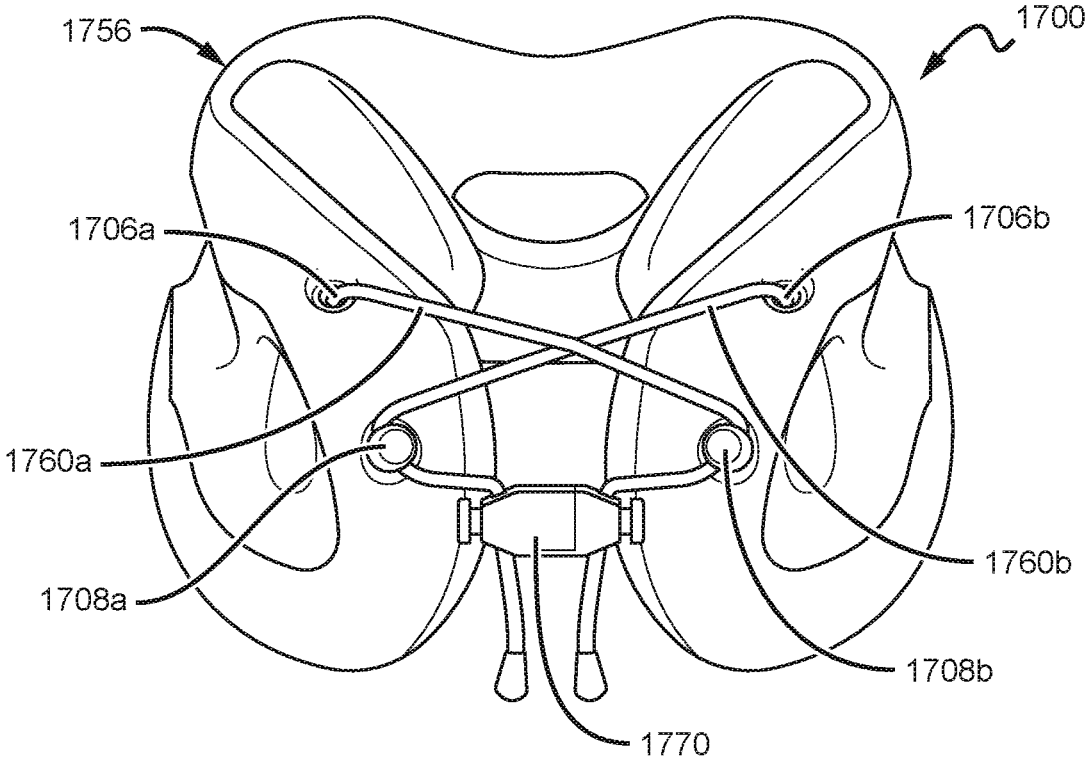

FIG. 19A
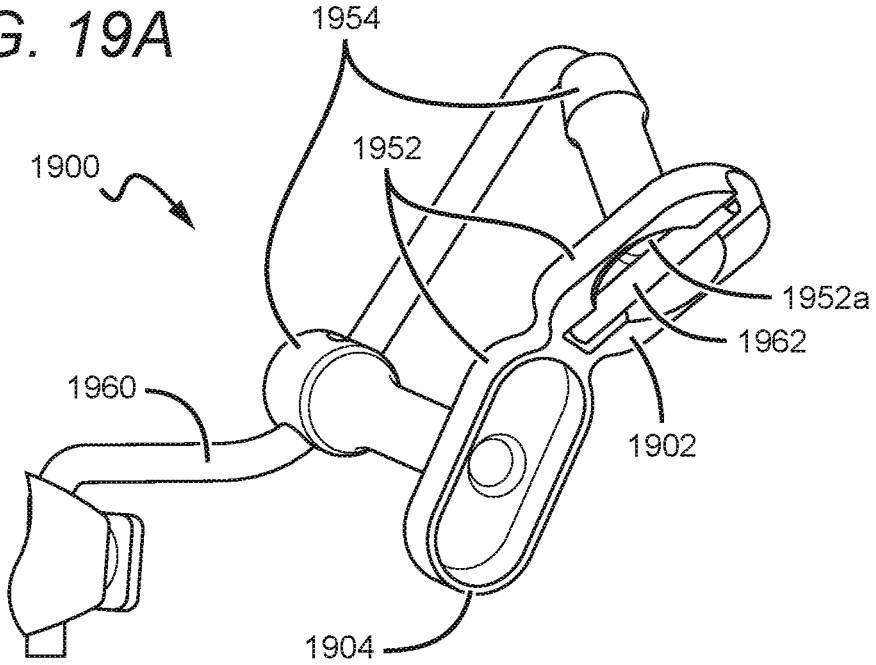
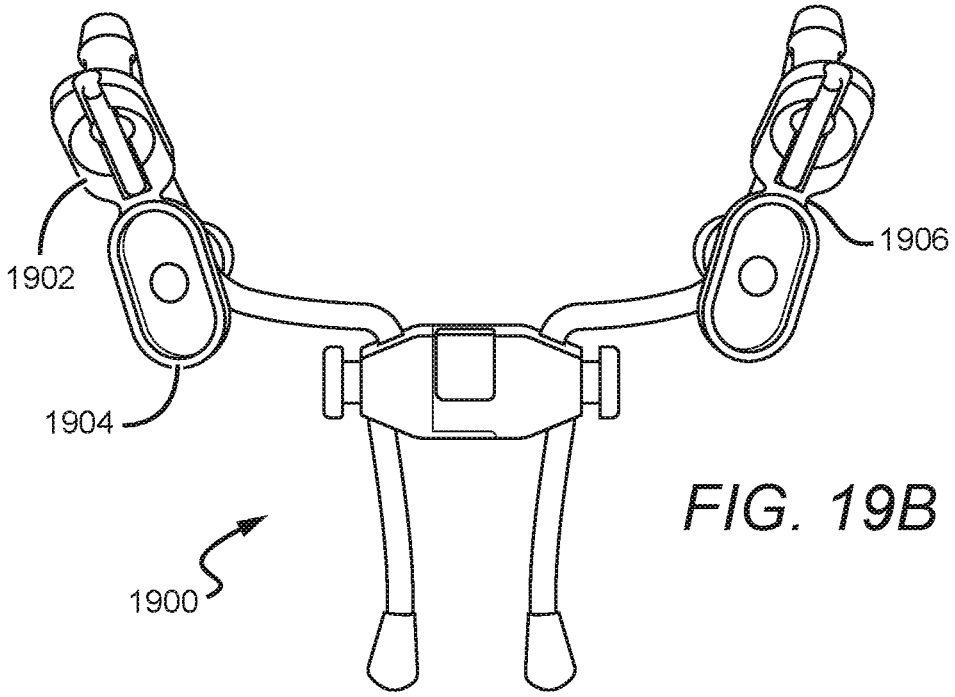
FIG. 19B

NECK PILLOW WITH CHIN SUPPORTS, MULTIPLE ANCHOR POINTS, AND MAGNETIC CLIP

CROSS-REFERENCE TO RELATED APPLICATIONS

This application claims the benefit of U.S. Provisional Patent Application No. 62/234,593 to Wong et al., filed on Sep. 29, 2015 and entitled "Neck Pillow with Chin Supports and Magnetic Clip"; of U.S. Provisional Patent Application No. 62/377,494 to Wong et al., filed on Aug. 19, 2016 and entitled "Neck Pillow with Chin Supports, Multiple Anchor Points, and Magnetic Clip"; and of U.S. Provisional Patent Application No. 62/396,018 to Wong et al., filed on Sep. 16, 2016 and entitled "Neck Pillow with Chin Supports, Multiple Anchor Points, and Magnetic Clip." Each of these applications is fully incorporated by reference herein in its entirety.

BACKGROUND

Field

This disclosure relates to pillows, and more particularly to improved neck and travel pillows.

Description of the Related Art

Travel pillows are well known for helping people rest or sleep when in a seated or upright position. However, such prior art travel pillows suffer from common drawbacks such as being bulky, trapping heat and moisture between the pillow and the user's neck and head, and generally being unable to adequately or comfortably support the user's head.

For instance, U.S. Pat. No. 6,230,349 to Silver et al. discloses a travel pillow with some of these drawbacks. Little air is allowed to circulate between the pillow and the user's neck with this type of product, often resulting in an uncomfortably hot and sweaty neck. Further, this type of travel pillow may cause the user's head to tilt forward due to a relatively large and thick rear portion that, when contacting the seat, puts pressure on the rear of the user's neck. Finally, this traditional travel pillow shape may fail to provide adequate support for a user's head and neck when the head is in a left, right, or forward position.

SUMMARY OF THE DISCLOSURE

The present disclosure is generally directed to travel pillows with features for increased user comfort, with some exemplary features including air or ventilation apertures, an inner pillow frame that is more rigid than an outer cushion at least partially surrounding the frame, and one or more protrusions or chin supports. The present disclosure is also generally directed to clip mechanisms which may include indentations and accompanying protrusions, and/or magnets, for preventing accidental or unintentional disengaging of the clip halves. Some embodiments of the present disclosure may include features for increased adjustment capability and comfort, such as multiple anchor points on each side of the pillow which may be used for engagement of a drawstring mechanism or similar.

One embodiment of a pillow according to the present disclosure comprises a cushion with left and right side portions and a rear portion therebetween. The left side portion may comprise a left forward portion and the right side portion may comprise a right forward portion, and a top of each of the left forward portion and the right forward portion may extend upward to support a user's chin. The left and right side portions may be shaped to define at least one aperture each.

Another embodiment of a pillow according to the present disclosure may include a cushion, with the left side of the cushion having two or more anchor points and the right side of the cushion having two or more anchor points. One half of a connector, such as a drawstring, may be connected to one anchor point on each side, and a closure mechanism may be attached to both or one of the connector halves. A user can choose to engage the second anchor point on each side of the cushion with one of the connector halves in order to adjust the maximum tightening point of the pillow.

One embodiment of a magnetic closure mechanism according to the present disclosure comprises a left portion with an inner protrusion and a magnet therein, and a right portion shaped to define an inner indentation for connection with the inner protrusion. The right portion may include a second magnet for connecting to the first magnet.

These and other further features and advantages of the disclosure would be apparent to those skilled in the art from the following detailed description, taken together with the accompanying drawings, in which:

BRIEF DESCRIPTION OF THE DRAWINGS

FIGS. 7A-7C show views of one embodiment of a pillow inner frame according to the present disclosure;

FIGS. 8B and 8C show the anchor mechanism of FIG. 8A in conjunction with a pillow inner frame and a pillow outer cushion, respectively;

FIGS. 9A-9F show top perspective, front, rear, side, top, and bottom views of one embodiment of a closure mechanism according to the present disclosure;

FIGS. 11A-11C show top perspective views of one embodiment of a pillow according to the present disclosure in three different configurations;

FIG. 12 shows a top perspective view of another embodiment of a pillow according to the present disclosure;

FIGS. 17A-17C show front, second front, and top views of another embodiment of a pillow according to the present disclosure;

FIGS. 18A-18C show front views of one embodiment of a pillow according to the present disclosure in three different configurations;

FIGS. 19A-19C show rear perspective, rear, and front perspective views of one embodiment of an anchor mechanism and closure mechanism according to the present disclosure.

DETAILED DESCRIPTION

Figure 1:
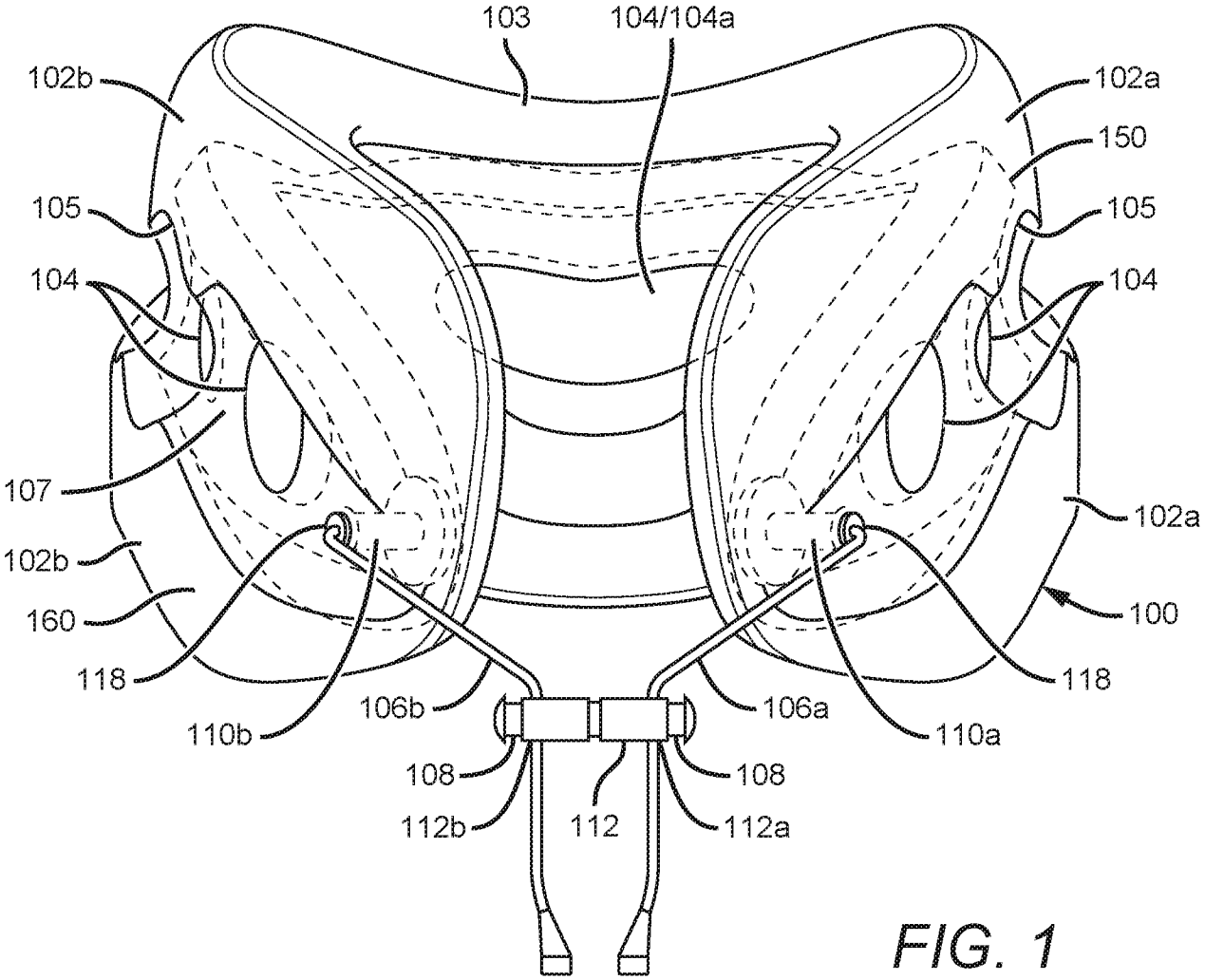
FIG. 1 shows a front elevational view of one embodiment of a pillow and closure mechanism according to the present disclosure.

The present disclosure describes travel pillows for supporting the head of a user, such as when sitting in an airline seat. Different embodiments of neck and travel pillows according to embodiments of the present disclosure may include novel and inventive features for increasing user comfort. Some embodiments of the present disclosure may include one or more air or ventilation apertures which may aid in user cooling, such as by increasing air circulation and preventing or reducing the trapping of warm air by a user's head and/or neck. Other embodiments may include a soft outer cushion with a more rigid inner frame therein. The inner frame can provide for more support than a travel pillow without such a frame, while the softer outer cushion can provide the typical comfort and softness associated with travel pillows. In embodiments also including ventilation apertures, the inner frame may be shaped to define apertures which correspond to apertures in the outer cushion. Some embodiments may include protrusions or chin supports which may be included on the side or leg portions of the pillow. These protrusions can increase support of a user's head and may also be designed so as to avoid contact with areas of a user that are sensitive, such as the front of the neck and the jaw underside. The travel pillow may also include a cover which may be removable. The cover may include air-permeable areas, such as mesh or woven areas, which may be aligned with ventilation apertures such as those described above. Another embodiment of a travel pillow according to the present disclosure may include side portions which terminate at a lower side thereof with an outwardly-extending flared portion such that the lower and/or front sides of each side portion may rest on the user's chest to help support the user's head. Various embodiments of the present disclosure may also include combinations of these features.

Other embodiments may further include a closure mechanism, attachment mechanism, or clip fixed with the side portions of the pillow. The side portions may each include a drawstring aperture at a forward end thereof. One half of the drawstring may be attached, such as on its internal drawstring half end, to each side portion of the pillow through its respective drawstring aperture. At its external end, the drawstring half may be connected to a closure or attachment mechanism half, such as a buckle or clip half. The closure mechanism halves may be connected to one another and their position along their respective drawstring halves adjusted so as to tighten together the side portions of the pillow, which can allow for adjustment to various neck sizes. The closure mechanism halves may be, for example, spring-biased so as to hold their respective positions upon their respective drawstring halves unless a user actuates the closure mechanism to reverse the spring biasing. The closure mechanism may include features for preventing or making more difficult unintentional disengagement of its halves. For instance, the closure mechanism may include male and female mating portions such as indentations and protrusions, and/or may include magnets which engage with one another when the closure mechanism is engaged.

Additionally, travel pillows according to the present disclosure may include additional features to increase user adjustability. For instance, such features may include features which enable the adjustment of the drawstring configuration beyond the adjustment provided solely by the closure mechanism. In one such embodiment, in addition to the primary anchor point where each drawstring half exits the main body of the pillow, each side portion of the pillow may include a secondary anchor point. A user can optionally engage the left anchor point with the left drawstring half and engage the right anchor point with the right drawstring half, which will either allow the pillow fit to be looser or tighter (depending on the positions of the primary and secondary anchor points). In another possible configuration utilizing left and right primary and secondary anchor points, the left drawstring half can be engaged with the right secondary anchor point and the right drawstring half can be engaged with the left secondary anchor point, such as in a "criss-cross" pattern, to provide even further increased support. It is understood that many different embodiments other than those described above, and embodiments including any combination of these and other features, are possible.

The present disclosure is described herein with reference to certain embodiments, but it is understood that the disclosure may be embodied in many different forms and should not be construed as limited to the embodiments set forth herein. The devices and elements herein may have different shapes and sizes beyond those shown. It is also understood that when a feature or element, such as a layer, region, cover, cushion, frame, or otherwise may be referred to as being "on" another element, it can be directly on the other element or intervening elements may also be present. Furthermore, relative terms such as "inner," "outer," "upper," "above," "lower," "beneath," and "below," and similar terms, may be used herein to describe a relationship of one element to another. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present disclosure.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. When the word "each" is used to refer to an element, it does not necessarily imply a plurality of the elements, but can also mean a singular element.

FIG. 1 is a front view of one embodiment of a pillow 100 according to the present disclosure. The pillow 100 may include two side portions 102*a*,102*b* and a rear portion 103.

Any one or any combination of the side portions 102*a*,102*b* and the rear portion 103 may be shaped to define one or more apertures 104. In the specific embodiment shown, each of the side portions 102*a*,102*b* includes a plurality of ventilation apertures 104 and the rear portion 103 includes a single aperture 104, although it is understood that any of the pillow portions 102*a*,102*b*,103 may include any number of apertures 104, or may not include any apertures 104. Further, while the apertures 104 of the pillow 100 are shown as being through an indented portion 105 of the pillow body, it is understood that embodiments of the present disclosure may include apertures through non-indented areas or portions as well, and may not include an indented portion at all.

Inclusion of ventilation apertures such as the apertures 104 can provide for a travel pillow that is cooler than prior art pillows. Inclusion of the ventilation apertures can allow for air to flow more easily through the pillow 100. Additionally, the relative size of each of the apertures may vary to allow different compression characteristics along the top of the travel pillow, or aperture size may be approximately uniform. For example, the rear portion aperture 104*a* may be relatively large so that the top side of the cushion at the rear portion 103 may flex more than, for example, areas of the side portions 102*a*,102*b*. Alternately, larger apertures towards the front of the side portions can allow for greater air flow and flexing at the front area of the travel pillow, while smaller apertures and more rigid pillars in the back portion can provide for greater support at the back of the user's head. Pillars 107 defined between adjacent apertures 104 may be provided to control flexion of the top portion of the outer cushion and/or inner frame, improve support of the user's head, and/or provide for a wide range of sizes. Some embodiments of travel pillow apertures which may be used in embodiments of the present disclosure are described in commonly assigned U.S. patent application Ser. No. 15/125,095 to Wong (a joint inventor of the present application), which is fully incorporated by reference herein in its entirety.

The pillow 100 may comprise an outer cushion 160 and an inner frame 150 (shown here in broken line as it is internal to the outer cushion 160). The outer cushion 160 may comprise any material including but not limited to traditional travel pillow materials, and in one specific embodiment comprises foam such as memory foam or polyurethane foam. The inner frame may be harder, more rigid, and/or denser than the outer cushion (although it is understood that in other embodiments the outer cushion may be harder, more rigid, and or denser, and that still other embodiments may not include a distinct inner frame). The inner frame may be made of any rigid or semi-rigid material, such as, for example, plastic, metal, composite materials, or foam such as memory foam.

For example, in one embodiment the inner frame and outer cushion are made of foam or other material. In one such embodiment, the inner frame material has a density between 50 kg/m$^3$ and 600 kg/m$^3$. In a more specific embodiment, the inner frame material has a density between approximately 150 kg/m$^3$ and 500 kg/m$^3$. In a further specific embodiment, the inner frame material has a density between approximately 300 kg/m$^3$ and 400 kg/m$^3$. And in one specific embodiment, the inner frame material has a density of approximately 350 kg/m$^3$. The outer cushion 160 may also have a range of densities. In one embodiment, the outer cushion has a density between approximately 10 kg/m$^3$ and 200 kg/m$^3$. In a more specific embodiment, the outer cushion has a density between approximately 60 kg/m$^3$ and 120 kg/m$^3$. In a further specific embodiment the outer cushion has a density between approximately 75 kg/m$^3$ and 105 kg/m$^3$, and in one specific embodiment the outer cushion has a density of approximately 90 kg/m$^3$. It is understood that the exemplary densities listed above for inner frames and outer cushions according to the present disclosure are applicable both to embodiments where both of these elements are made of foam or a similar material, and to embodiments where only one of the two is made from foam or a similar material. It is further understood that embodiments with densities outside these ranges are possible.

In one particular embodiment, both the inner frame 150 and the outer cushion 160 are made from foam such as memory foam, but with different densities. The foam density of the inner frame 150 may be higher than the density of the outer cushion 160. In one embodiment of the present disclosure, a travel pillow includes an inner frame that is at least 1.5 times as dense or rigid as the outer cushion. In another embodiment, the inner frame is at least twice as dense or rigid as the outer cushion. In another embodiment, the inner frame is at least three times as dense or rigid as the outer cushion, or at least four times as dense or rigid. In another embodiment, the inner frame is between 1.5 and 10 times as dense or rigid as the outer cushion, or is between two and six times as dense or rigid as the outer cushion, or is between three and five times as dense or rigid as the outer cushion, or is approximately four times as dense or rigid as the outer cushion. Utilization of a more dense or rigid inner frame such as the inner frame 150 may allow the design of the outer cushion 160 to be focused more upon contact comfort (i.e., the comfort of the material as it contacts the user or a user's clothes), since the inner frame 150 can provide structural support which normally would have to be provided solely by the outer cushion 160.

In embodiments of pillows according to the present disclosure that include both an inner frame/outer cushion arrangement and ventilation apertures, such as the pillow 100, the apertures of the inner frame and outer cushion may be at least partially (and in some instances completely) aligned with one another to allow air flow through the entire width of the side or rear portion of the pillow through which the aperture is disposed. Some embodiments of inner frame/outer cushion arrangements which may be used in embodiments of the present disclosure are described in commonly assigned U.S. patent application Ser. No. 15/125,095 to Wong, which is fully incorporated by reference herein in its entirety.

The pillow 100 may also optionally include a closure mechanism, attachment mechanism, clip, or buckle 112 (referred to herein simply as a "closure mechanism," although it is understood that many different embodiments are possible), which may include closure mechanism halves 112*a*,112*b* that can engage with one another. The closure mechanism halves 112*a*,112*b* may be connected to the remainder of the pillow 100 by a connection mechanism such as a drawstring 106 including drawstring halves 106*a*, 106*b*. It is understood that while the specific embodiment shown in FIG. 1 and described below utilizes a drawstring, other functionally and/or aesthetically similar devices such as straps, ropes, and the like could be substituted for the drawstring 106.

In one embodiment, the side portions of the inner frame 150 and the outer cushion 160 each include a drawstring aperture 118 at the forward end thereof, respectively. The drawstring 106 may traverse the drawstring apertures of each side portion. Each of the drawstring halves 106*a*,106*b* may attach to the body of the pillow 100 at an anchor mechanism, such as the anchor mechanisms 110*a*,110*b*, although it is understood that many different closure mechanisms are possible. For example, in one embodiment the drawstring halves 106*a*,106*b* could each loop through a pillow aperture such as one of the apertures 104, and in another embodiment the drawstring halves 106*a*,106*b* could attach to the remainder of the pillow 100 without an anchor mechanism.

The position of each of the closure mechanism halves 112*a*,112*b* along its respective drawstring half 106*a*,106*b* can be adjusted upward so as to tighten the side portions 102*a*,102*b* toward one another. In one embodiment, the closure mechanism halves 112*a*,112*b* may be spring-loaded or similar, and/or may be biased to a "locked" position at a location along a drawstring half 106*a*,106*b* until actuation of a device, such as the push-buttons 108, which may be spring-loaded. Upon actuation, the closure mechanism halves 112*a*,112*b* can be "unlocked" and can be slid along their respective drawstring half 106*a*,106*b* to a new position. It is understood that the location of the closure mechanism halves 112*a*,112*b* can be adjusted when separate, and can be adjusted when engaged with one another. In some embodiments, the pillow side portions 102*a*,102*b* can be tightened such that they are nearer each other, and in one embodiment may be tightened such that they touch one another.

FIGS. 2A-F display a travel pillow 200 according to one embodiment of the present disclosure. The travel pillow 200 may include some components similar to or the same as those described elsewhere herein. For example, the travel pillow 200 may include multiple layered portions, such as an inner frame (not shown) and an outer cushion, or can be homogeneous in nature. In the embodiment shown in FIGS. 2A-F, the travel pillow 200 can include first and second side portions 202,204 and a rear portion 206. Each of the side portions 202,204 can include a forward side portion 202*a*, 204*a*. While many embodiments are possible, in one embodiment one or both of the forward side portions 202*a*, 204*a* can curve downward, such as in the manner best shown in FIG. 2D, in order to better fit the shape of a user's shoulders.

Figure 2A:
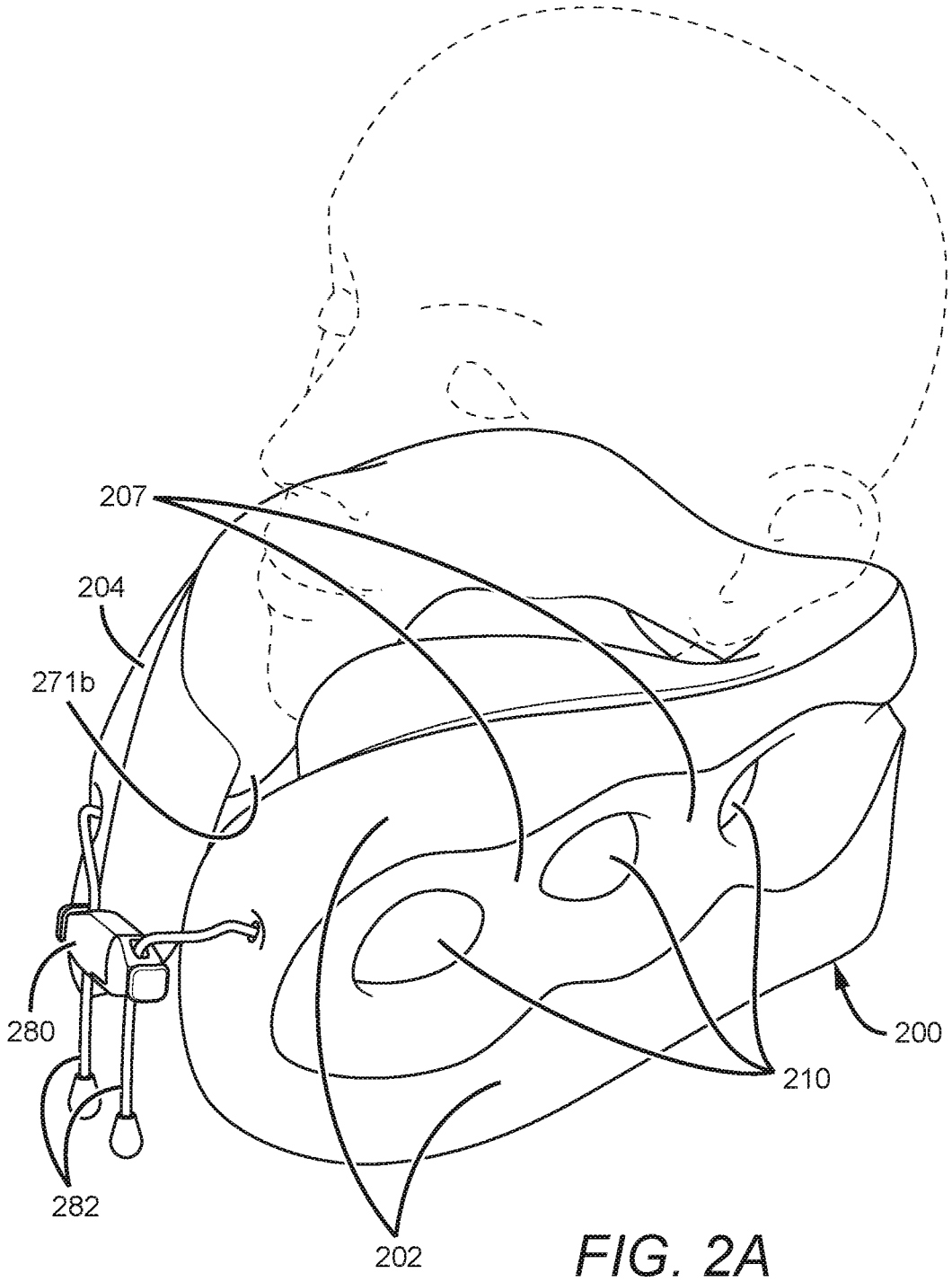
FIGS. 2A-2F show top perspective, front, rear, side, top, and bottom views of one embodiment of a pillow according to the present disclosure.
Figure 2B:
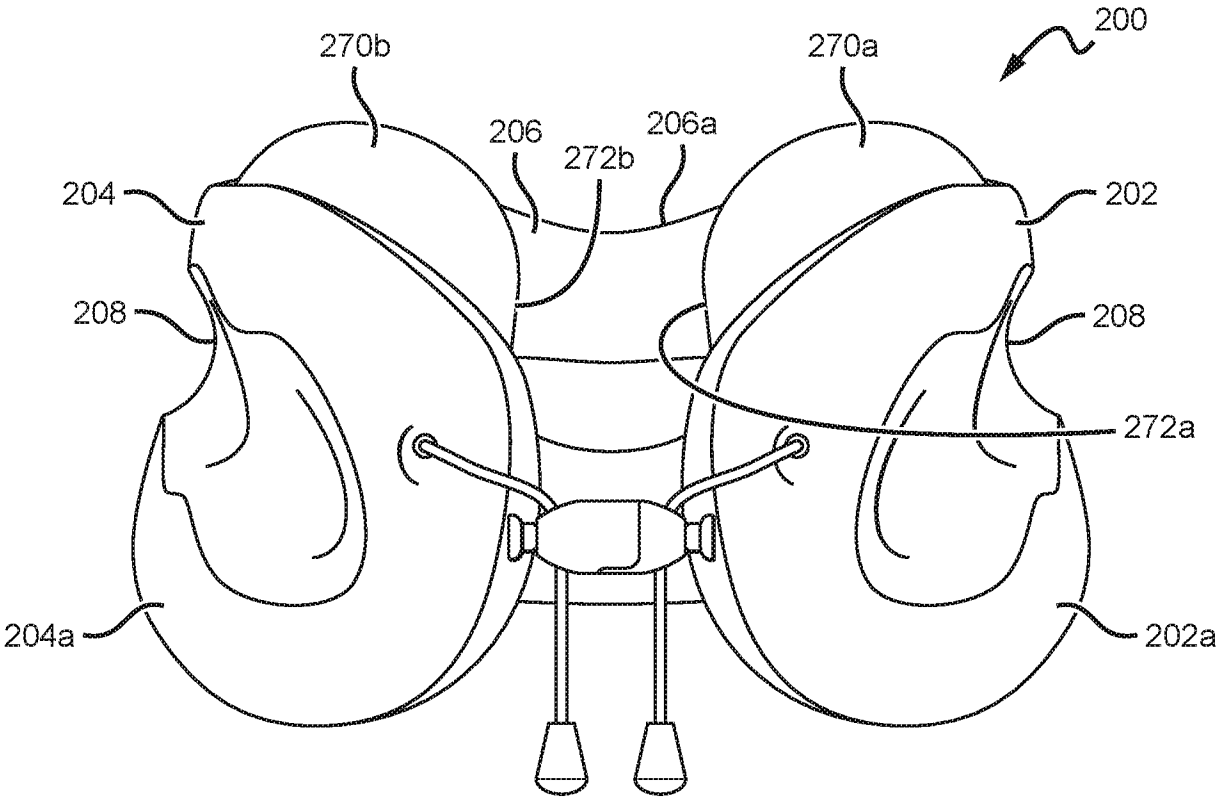

Travel pillows described herein and according to the present disclosure, including but not limited to the travel pillow 200, may have side portion cross-sections such as the cross-sections of the side portions 202,204 that are generally vertically-oriented. The height and width of side portions according to the present disclosure may vary at different points of the side portion due to the pillow's ergonomic shape, such that the side portion has a maximum height that is greater than its minimum height (as opposed to having a uniform height where the maximum height and minimum height are equal). In some embodiments, side portions may have a smaller height toward their rear and a larger height toward the front (as shown in FIG. 2D), which may better fit the shape of a user's shoulders. The side portions may also curve downward so as to better fit the user's shoulders. In some embodiments, side portions may have a maximum height (not including protrusion height, which will be discussed separately) between about 2.5 inches and 8 inches. In a more specific embodiment the maximum height is between about 2.5 inches and about 6.5 inches, and in an even further specific embodiment the maximum height is between about 3.5 and 5.5 inches, such as about 4.5 inches. In some embodiments, side portions may have a minimum height between about 1 inch and 6 inches. In one specific embodiment, side portions may have a minimum height between about 2.5 inches and 4.5 inches, such as about 3.5 inches. In one specific embodiment the side portion minimum height is about 3.5 inches and the maximum height is about 4.5 inches. The minimum height in some embodiments may be between 0.5 inch and 1.5 inches less than the maximum height. The minimum height in some embodiments may be between about 60% and 90% of the maximum height, and in one further specific embodiment may be between about 70% and 80% of the maximum height. It is understood that these ranges are exemplary in nature, and that many different embodiments with dimensions outside these ranges are also possible. Further, embodiments that are not generally vertically-oriented are also possible; for example, different embodiments of side portions according to the present disclosure may have circular, rectangular, square, triangular, or any other shaped cross-section.

The width of side portions according to embodiments of the present disclosure, such as the side portions 202,204, may also either be uniform or vary. In some embodiments, the average width of the side portion may be between about 0.5 inch and 4 inches, and in one specific embodiment between about 1 inch and 3 inches, and in an even further specific embodiment between about 1.5 inches and 2.5 inches. Many different embodiments in and outside of these ranges are possible.

Side portions according to embodiments of the present disclosure may be approximately straight vertical, or may be angled. For example, as best seen in FIG. 2B and as can be seen in FIG. 2F, the side portions 202,204 may angle outward from top to bottom when the pillow is in its natural position (i.e., without outside forces acting on it). This may result in a pillow that is wider at its bottom that at its top, such that the width of the pillow on a user's shoulders is larger than the width of the pillow at a user's jaw. This arrangement can provide excellent support, as a base that is wider can be mechanically more stable. Further, this design may result in a travel pillow with a smaller user contact area (i.e., the total area of the pillow that is in physical contact with the user) compared to some prior art travel pillows, while still providing adequate support to a user. This reduction in user contact area can aid in reducing the probability of overheating, as less contact area typically results in a cooler environment for the user. Different embodiments including but not limited to approximately vertical side portions and side portions that angle inward from top to bottom are also possible, and can in certain embodiments result in similar benefits to those described above with regard to those embodiments with a wider base.

Figure 2C:
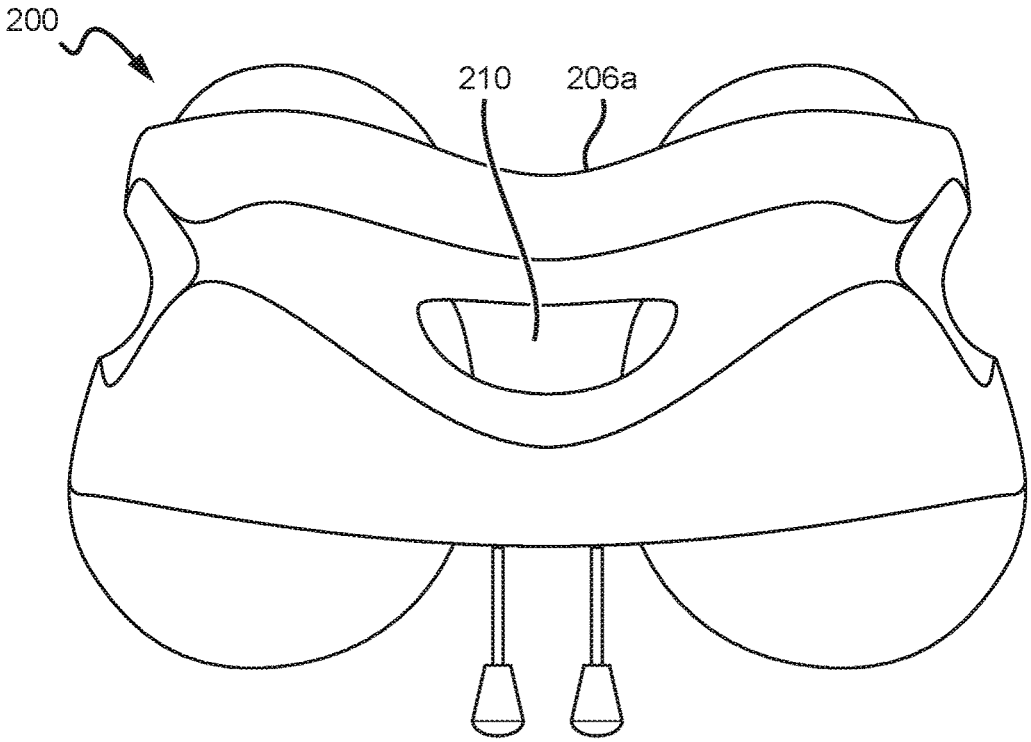
Figure 2D:
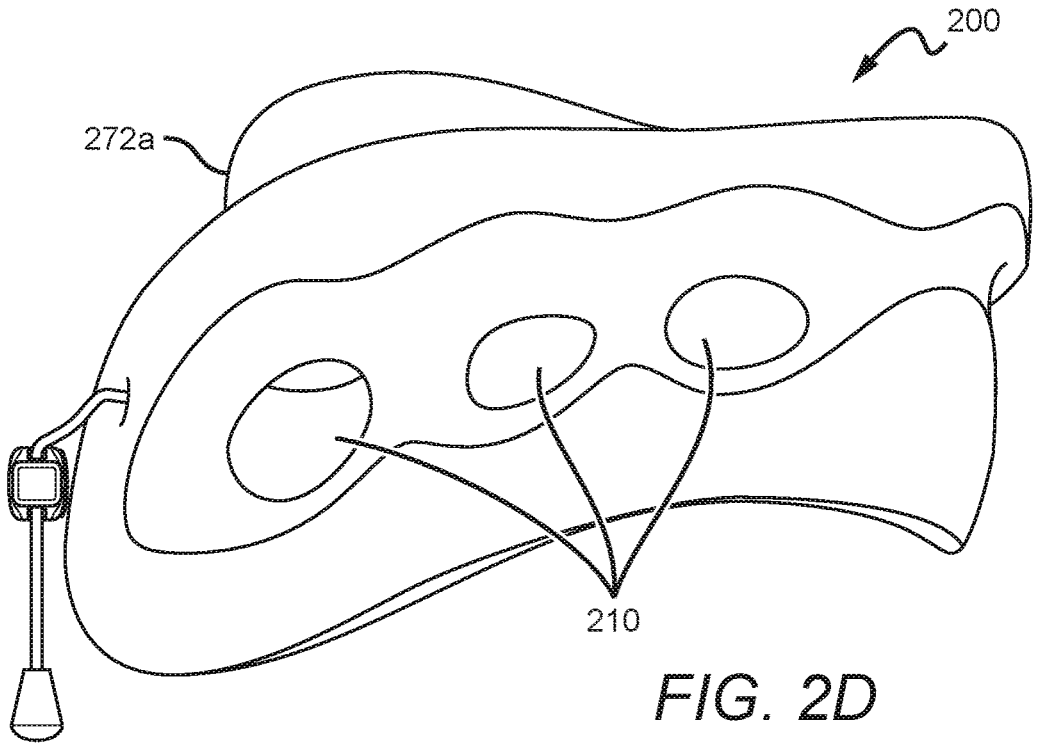
Figure 2E:
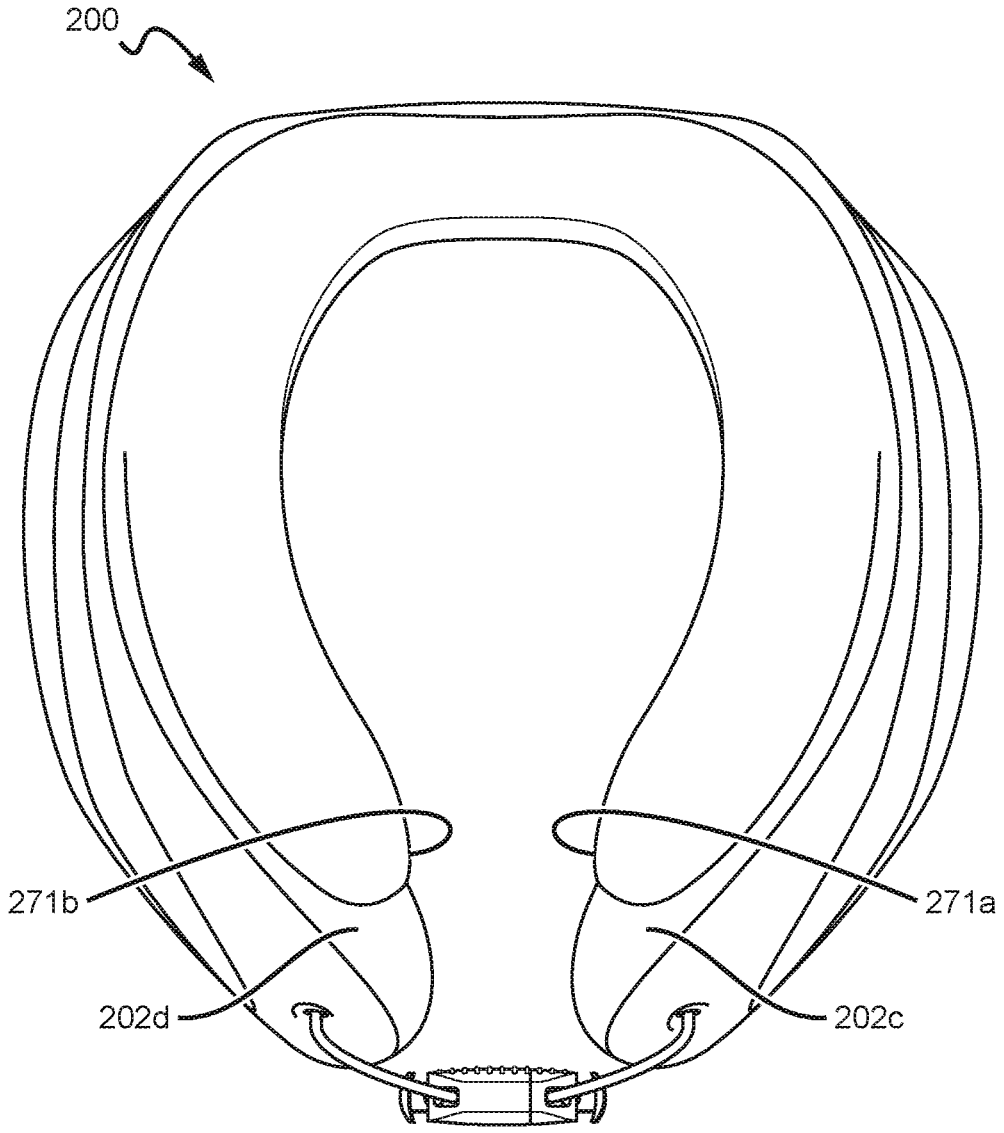
Figure 2F:
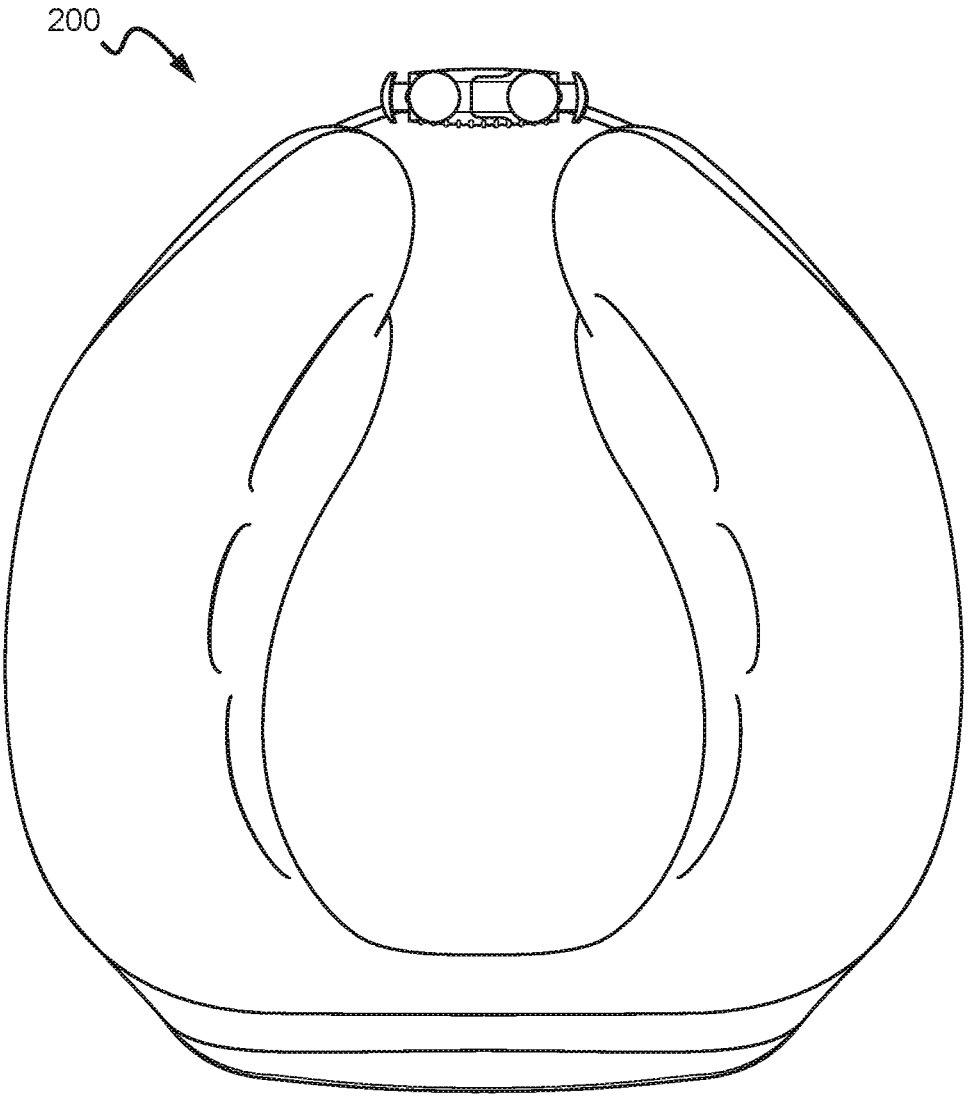
Figure 3A:
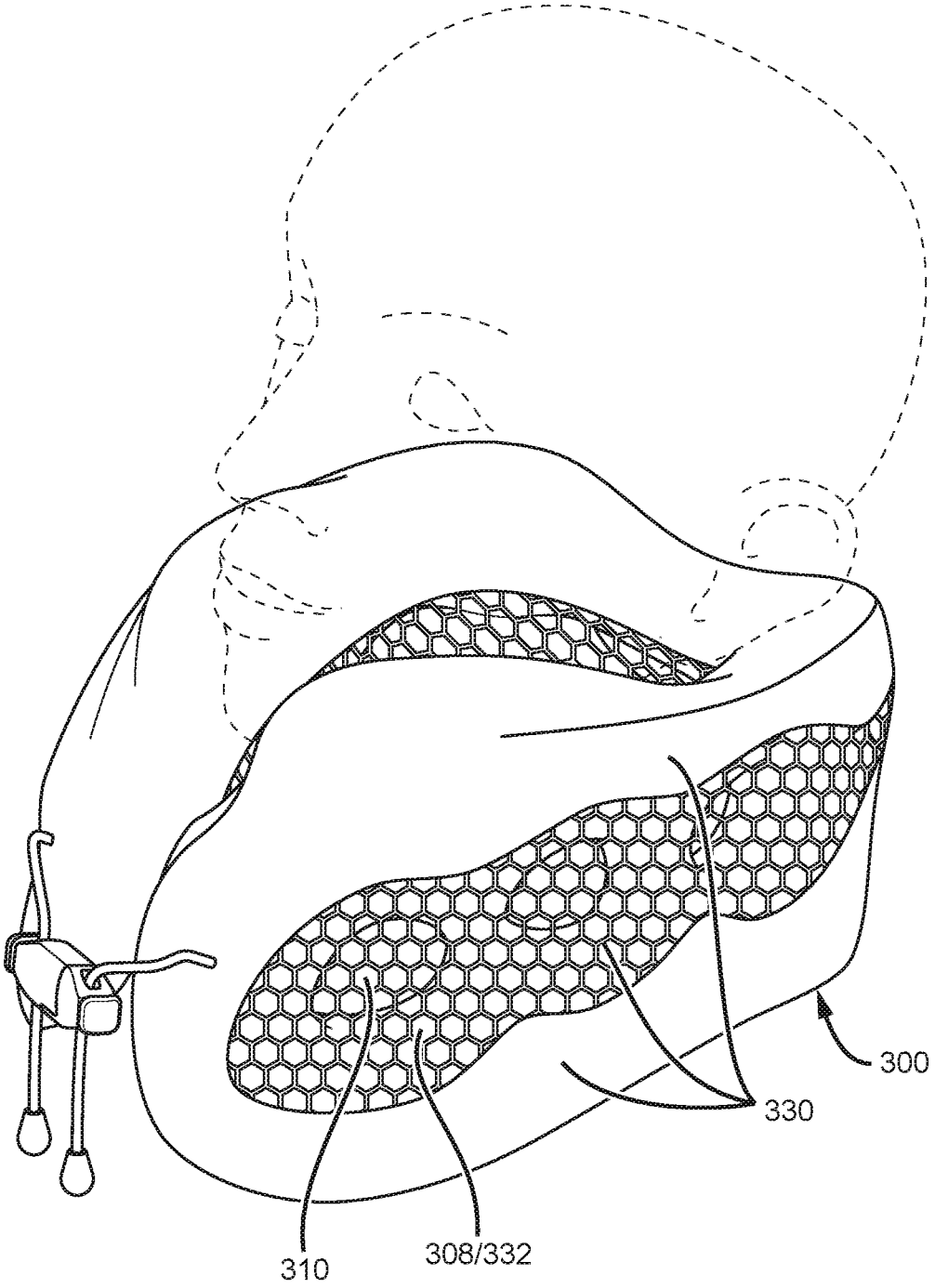
FIGS. 3A-3F show top perspective, front, rear, side, top, and bottom views of one embodiment of a pillow including a cover according to the present disclosure.
Figure 3B:
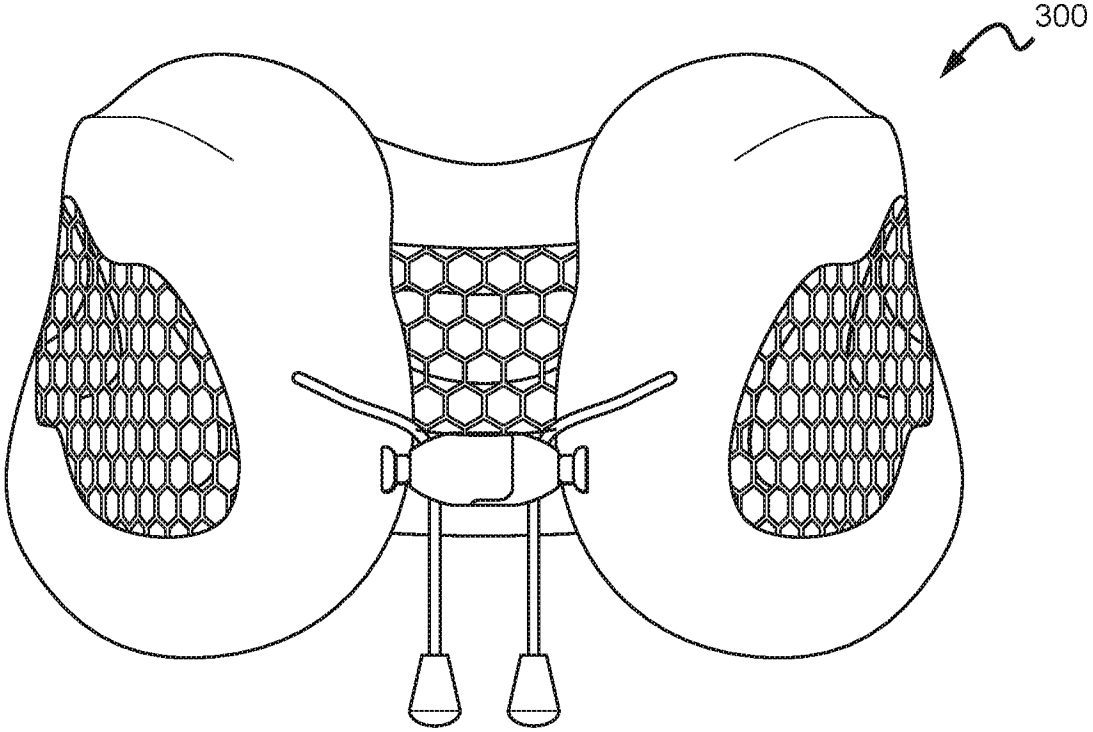
Figure 3C:
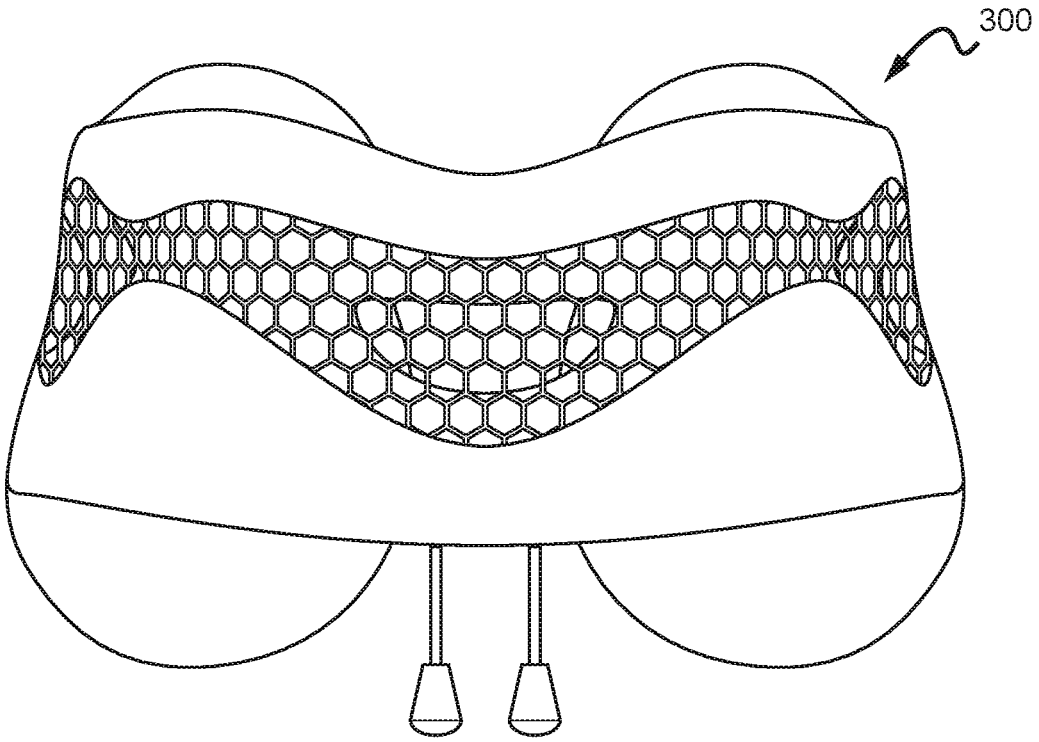
Figure 3D:
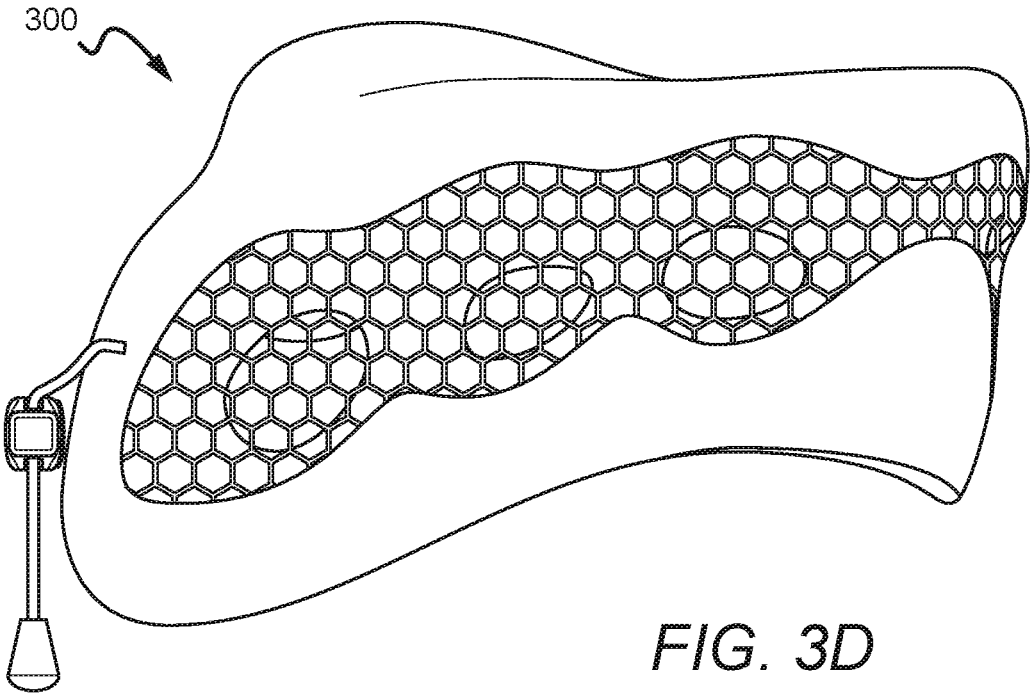
Figure 3E:
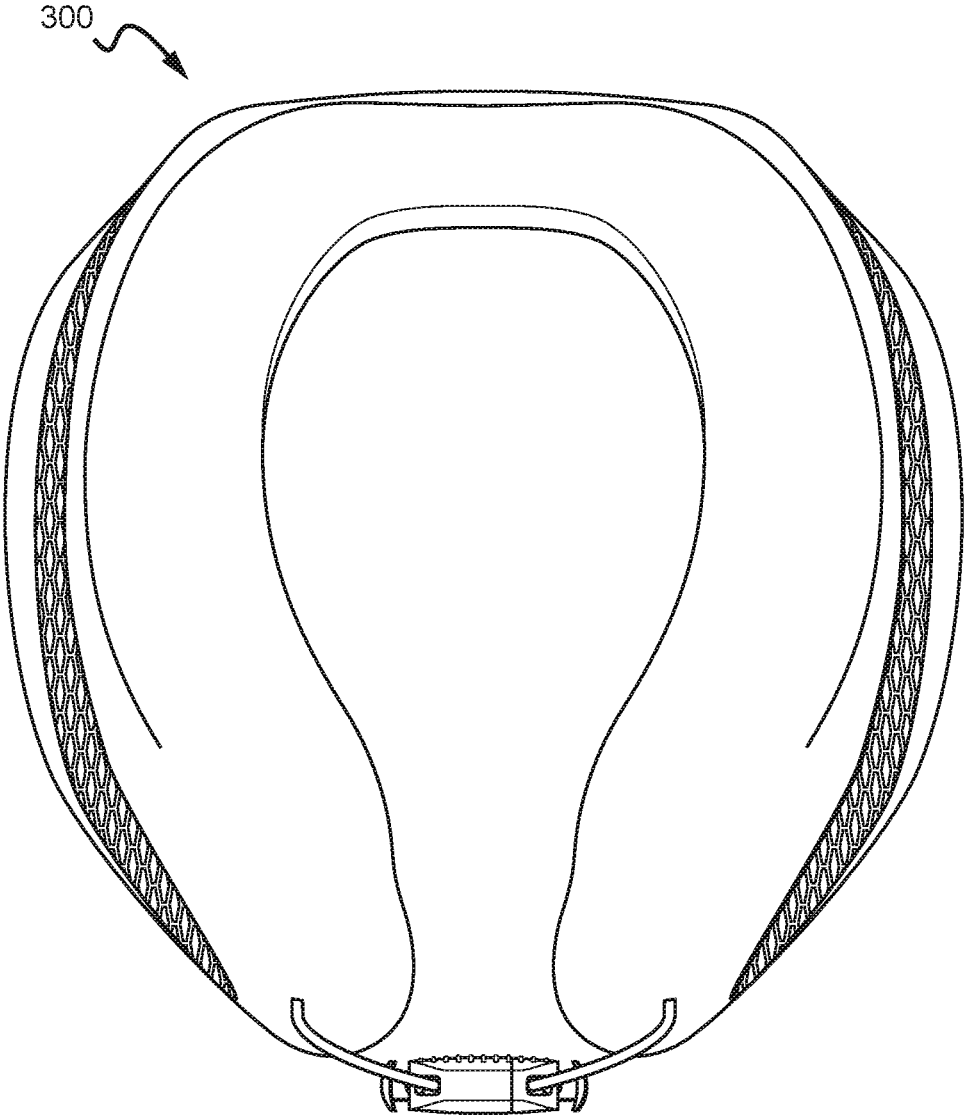
Figure 3F:
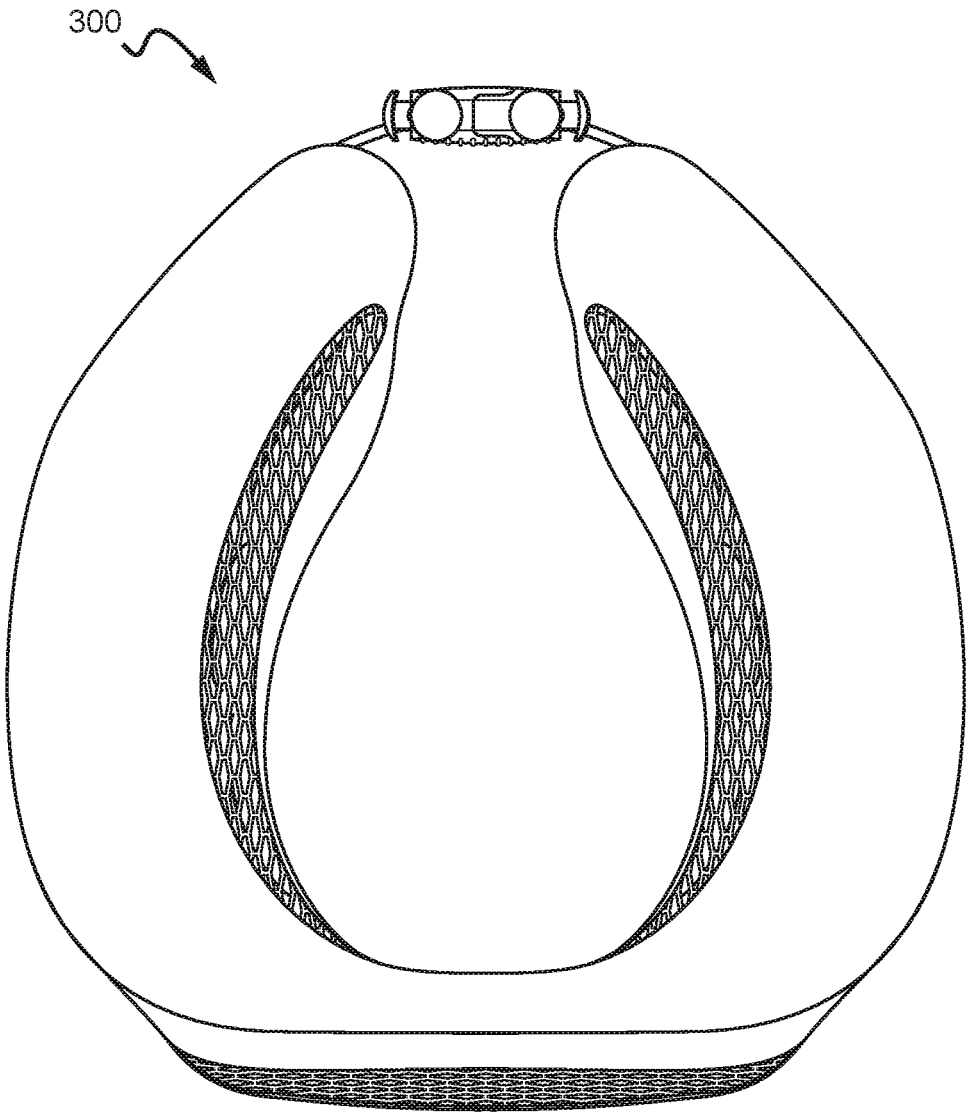

As best seen in FIGS. 2B and 2C, the rear portion 206 of the pillow 200 may include a rear indented portion or dip 206*a* (referred to herein as the "dip 206*a*" for simplicity). The dip 206*a* can provide room for a user's neck or head to angle or lean backwards, and can prevent a user's neck or head from being pushed forward. Additionally, if the pillow 200 is turned around then the dip 206*a* can serve as a chin support. The presence of the dip 206*a* can also help to prevent bunching of material behind a user's head that may cause discomfort. The thickness of the rear portion 206 of the pillow 200 (as best seen in FIG. 2E) may also be kept relatively low in order to avoid pushing a user's head forward. In some embodiments, the thickness of the rear 206 of a pillow according to the present disclosure is between 0.1 inch and 2.0 inches; in another embodiment, between 0.5 inch and 1.5 inches; and in another embodiment, about an inch. Additionally, the height of the rear portion may be the same or different than the height of side portions. For example, in one embodiment the height of a rear portion such as the rear portion 206 is between about 2 inches and 7 inches, and in a further specific embodiment between about 2.5 inches and 6 inches, and in yet a further specific embodiment between about 3 inches and 5 inches. Many different embodiments in and outside of these ranges are possible.

The pillow 200 may include an indented portion 208 having some characteristics similar to the indented portion 105 shown in FIG. 1. An indented portion 208 of the pillow 200 may run from the outer surface 202*b* of the first side portion 202, through the outer surface 206*b* of the rear portion 206, and through the outer surface 204*b* of the second side portion 204. In the embodiment shown in FIGS. 2A-2F, the indented portion 208 runs from the forward portion 202*a* of the first side portion 202, through the first side portion 202, the rear portion 206, and the second side portion 204, and to the forward portion 204*a*. This indented portion may increase or maximize the percentage of the circumference of a user's neck that receives ventilation, as will be further described below. It is understood that while the embodiment shown in FIGS. 2A-2F includes a single continuous indented portion 208, any combination of the side and rear portions 202,204,206 may include their own indented portions which are not continuous with one another. Additionally, embodiments with indented portions only in certain areas and embodiments without any indented portion are also possible.

Air or ventilation apertures 210 may be included through the side portions 202,204 and/or rear portion 206 of the pillow 200. The apertures 210 may have some characteristics similar to the apertures 104 shown in FIG. 1. In one embodiment, the apertures 210 are through the indented portion 208, although air or ventilation apertures through non-indented portions are possible. The inclusion of the indented portion 208 and the placement of the air or ventilation apertures 210 therethrough can increase ventilation as compared to a pillow that includes air or ventilation apertures through a non-indented portion thicker than the indented portion 208, due at least to the fact that there is less distance to travel from the outside of the pillow to the neck. For example, the thickness of a side portion at an aperture may be less than 90% of the thickness of the side portion outside of the indented portion, and in a further specific embodiment may be 75% or less than the thickness of the side portion outside of the indented portion. The thickness of a side portion at an aperture may be less than 2 inches, and in a further specific embodiment may be less than 1.5 inches. In one specific embodiment the thickness of a side portion at an aperture may be less than 1 inch. It is understood that these percentages and measurements are exemplary only and in no way limiting.

Further, the inclusion of an indented portion such as the indented portion 205 may result in less material being used, which can lower the weight and cost of the pillow. While as shown the apertures 210 are included in the first and second side portions 202,204 and the rear portion 206, it is understood that many different air aperture placements are possible, such as through side portions only, through the rear corners of the pillow 200 between the side portions and the rear portion, through the rear portion only, and any combination thereof.

Pillars 207 may be provided between adjacent apertures 210, and can provide mechanical support. The pillars 207 may be similar to or the same as the pillars 107 described above. In embodiments utilizing an inner frame, the pillars 207 may include material from both the inner frame and outer cushion, just the inner frame, or just the outer cushion. In other embodiments, pillars according to the present disclosure may include a third material, which may be more rigid than both the outer cushion and the inner frame material. The combination of pillar and aperture design may be designed to provide a desired flexion profile to a user. Additionally, the area between pillars can serve as "flexion zones" while the areas corresponding to pillars can serve as stiffer areas, thus providing the user with different flexion profiles in different areas of the pillow which he or she can utilize as desired. Many different embodiments are possible.

Apertures in embodiments of the present disclosure may have various different shapes. For example, apertures such as the apertures 210 and those described elsewhere herein may be circular, square, polygon-shaped, oval, triangular, plus-shaped (e.g., intersecting vertical and horizontal apertures), L- and inverted-L-shaped, T- and inverted-T-shaped, or any other regular or irregular shape. Many other different shapes are possible. Further, while in FIGS. 2A-2F the apertures are shown as running substantially horizontally through the pillow side portions and rear portion 202,204, 206, it is understood that other embodiments are also possible. For example, in some embodiments of the present disclosure ventilation apertures may be angled downward from the outside of the pillow to the inside of the pillow. In another embodiment, one or more ventilation apertures may open on an upper portion of a side or rear portion, or may open on an upper surface of a side or rear portion. These embodiments can results in increased cooling since in a typical airplane the air conditioning unit is mounted over a user and aimed downwards at a user; in these embodiments, the ventilation aperture openings may be more closely aligned with this downward airflow to provide increased ventilation. Many embodiments are possible, including but not limited to embodiments with combinations of the above-described ventilation aperture designs.

Additionally, such apertures may also have many different sizes. Pillows according to the present disclosure may include apertures having a width or a height, and in some cases both, from about 0.1 inch to about 6 inches, and in a further specific embodiment about 0.25 inch to about 4 inches, in an even further specific embodiment about 0.5 inch to about 2.5 inches, and in yet an even further specific embodiment about 0.75 inch to about 1.75 inches. Pillows according to the present disclosure may include apertures having a width or a height, and in some cases both, of 0.1 inch or greater, and in a specific embodiment 0.25 inch or greater, and in a further specific embodiment 0.5 inch or greater, and in a further specific embodiment 0.75 inch or greater, and in an even further specific embodiment 1 inch or greater, and in one specific embodiment 1.5 inches or greater. Pillows according to the present disclosure may include apertures having a width or height, and in some cases both, of about 6 inches or less, and in a specific embodiment 4 inches or less, and in a further specific embodiment 2.5 inches or less. Pillows according to the present disclosure may include one or more apertures having an area of 0.25 square inch or more, 0.5 square inch or more, 0.75 square inch or more, 1 square inch or more, 1.25 square inches or more, or 1.5 square inches or more. As shown with regard to FIGS. 2A-2F, the aperture 210*a* in the rear portion 206 of the pillow may have a longer width, height, or both than apertures 210 along the side portions 202,204. Many different embodiments are possible, and apertures without dimensions within the above ranges are within the scope of the present disclosure.

The indented portion 208 is shown as running approximately centrally height-wise through the outer surfaces of the first and second side portions 202/204 and rear portion 206. Similarly, the apertures 210 are shown as centered approximately halfway up the outside surfaces of the pillow 200. This vertical placement can increase ventilation in that a space (or spaces) may remain between the apertures 210 and the neck of a user, as opposed to an embodiment where an air aperture is, for example, directly against a user's jaw or neck. Designing the pillow 200 such that a space remains between the inner opening of the ventilation apertures and a typical user's neck can aid in ventilation by increasing air circulation, whereas if no space remains air may become stagnant within an aperture against a user's skin. It is understood that the vertical placement of the indented portion 208 and/or apertures 210 may be higher or lower than the specific embodiment shown as would be understood by one of skill in the art. For example, vertical placement of the indented portion 208 may vary between embodiments designed for users with longer necks (higher indented portion and aperture placement) versus users with shorter necks (lower indented portion and aperture placement). In some embodiments of the present disclosure, the bottom of one or more of the apertures 210 may be between about 0.25 inch to 2.00 inches from the bottom of the outside surface of the pillow 200 beneath the aperture. In some embodiments, one or more of the apertures 210 may be between about 0.50 inch to 1.50 inches from this point, and in a specific embodiment may be between about 0.75 inch to 1.25 inches, and in yet a further specific embodiment may be about an inch from this point.

As shown in FIGS. 2A-2F, embodiments of the present disclosure may include protrusions or chin supports 270*a*, 270*b* which may result in increased support and user comfort. The chin supports 270*a*,270*b* can provide support to a user's chin or jaw. By supporting the user's chin or jaw, such chin supports may also help to reduce user fatigue.

The chin supports 270*a*,270*b* may take the form of protrusions at least partially from an upper surface 202*c*, 202*d* of the left and right side portions 202,204. Additionally, the chin supports 270*a*,270*b* may be on surfaces other than an upper surface of a cushion, as shown by the portions 271*a*,271*b* of the chin supports 270*a*,270*b* that are inside of and/or on an inside surface of the side portions 202,204. Such an arrangement may have greater chin support stability compared to embodiments where chin supports are attached only to a top surface. Many different embodiments are possible.

The chin supports 270*a*,270*b* may be arcuate and may be designed to abut and support a user's jaw. The top of the chin supports 270*a*,270*b* may be defined by an arc or a spline curve from rear to front or from side to side (i.e., from top to bottom and from side to side, respectively, as shown in FIG. 2E), or both from rear to front and from side to side. Alternatively, the top of the chin supports according to embodiments of the present disclosure may be flat (such as, in one specific embodiment thereof, being substantially horizontal) either from rear to front, from side to side, or both. In one specific embodiment, the top of the chin supports include a substantially planar surface. In some embodiments, the top of the chin supports may angle downward as they approach a user to provide a surface upon which the user's jaw or head can rest. Many different embodiments are possible.

By fitting to a user's jaw, the chin supports can help to increase user comfort, such as by providing more support to the chin or jaw, or by providing a comfortable feel to the user. In one embodiment, the chin supports 270*a*,270*b* may include indentations therein (not shown), such as in an upper surface thereof. These indentations may help to fit the chin supports to the user's jawline. Additionally, the chin supports 270*a*,270*b* as they approach their front may be angled inward toward the center of the pillow 200 (as best seen in FIG. 2E) so as to fit the shape of a user's jawline, which angles inward as it approaches the center of a user's face. Chin supports may also include near-vertical or vertical ends 272*a*,272*b* as shown in FIGS. 2B and 2D. Vertical, substantially vertical, and near-vertical ends can increase user comfort, such as by providing more support to the user's jaw. It is understood that these shapes are exemplary in nature, and chin supports and protrusions according to the present invention may have any number of regular or irregular shapes including but not limited to arc shapes, spline shapes, semicircular shapes, hemispheric shapes or frustospheric shapes, conical or frustoconical shapes, prismatic shapes, pyramid shapes, and any other shape.

The height provided by the chin supports 270*a*,270*b* as compared to embodiments without chin supports may provide distinct advantages. For example, the chin supports 270*a*,270*b* may be shaped so as to contact the corner or outside of a user's jaw. By contacting the corner or outside of a user's jaw, the chin supports may avoid the jaw underside or neck of a user, which are typically more sensitive areas. In this manner, the chin supports can help to avoid discomfort. It is understood that chin supports according to the present disclosure may be sized and angled in any number of manners.

In some embodiments, the protrusions or chin supports 270*a*,270*b* may run along the majority of the left and right side portions 202,204, as shown in FIGS. 2A-2F. However, it is understood that in other embodiments chin supports may be positioned differently, or may not run along the majority of the left and right side portions 202,204. Further, while the protrusions or chin supports 270*a*,270*b* are shown as separate elements, in other embodiments of the present disclosure the protrusions or chin supports 270*a*,270*b* may be connected to one another, such as an embodiment where a chin support element runs around the entire rear portion of a pillow in addition to the sides. Moreover, while some embodiments may display two protrusions or chin supports, it is understood that any number of protrusions or chin supports may be included in pillows according to the present disclosure, such as a single protrusion or chin support or a plurality of protrusions or chin supports.

By elevating the chin supports higher than the upper portions of the pillow, the portion of a user that potentially may contact the upper portion of the pillow, e.g. the chin, may contact the chin supports first. Therefore, the inclusion of elevated protrusions or chin supports 270*a*,270*b* can enable the use of a softer material, as the increased height provided by the chin supports will provide additional support for a user's chin or jaw. As such, in some embodiments the protrusions or chin supports may comprise a material that is less dense than the remainder of the pillow or outer cushion. This less dense material may be more comfortable after a user's chin has been contacting it for some time, such as the length of extended travel. However, it is understood that the material used for the chin supports may use any number of materials and may comprise a material that is less dense, more dense, or the same density than the material used in the remainder of the pillow or the outer cushion of the pillow.

In some embodiments of the present disclosure, the chin supports 270*a*,270*b* may be approximately 0.25 inch to 3.00 inches high, or more specifically about 0.5 inch to 1.5 inches high. In other embodiments, the chin supports 270*a*,270*b* may be about 0.75 inch to 1.25 inches high, or may be approximately 1 inch high. The chin supports 270*a*,270*b* can be approximately 2 inches to 10 inches from back to front (as shown in FIG. 2E), or more specifically may be approximately 3 inches to 7 inches, or in one specific embodiment may be approximately 4 inches to 6 inches from front to back. The chin supports 270*a*,270*b* may be approximately 0.25 inch to 3 inches wide (as shown in FIG. 2E), or more specifically may be approximately 0.5 inch to 2 inches wide, or in one specific embodiment may be approximately 0.75 inch to 1.5 inches wide. However, it is understood that protrusions or chin supports according to the present disclosure may be any range of heights, lengths, and widths, such that dimensions outside the above ranges are also possible.

In addition to the added support described above, the inclusion of chin supports can also result in other benefits. For example, the inclusion of chin supports such as the chin supports 270*a*,270*b* can further reduce the pillow's user contact area, thus reducing the chances of overheating and resulting in a cooler pillow as described above with regard to side portion design. The combination of the inclusion of chin supports and the previously-described side portion design, including but not limited to side portions which angle outward from top to bottom and/or which are wider at their base than at their top, can have particularly beneficial cooling effects, and can result in an even further-reduced user contact area.

Embodiments of pillows according to the present disclosure may also include closure mechanisms such as the closure mechanism 280, and connectors such as the connectors 282, such as drawstring halves. These elements will be discussed in detail below.

Embodiments of pillows and cushions according to the present disclosure may include covers, such as flexible covers. FIGS. 3A-3F show one embodiment of a pillow 300 that may be similar to or the same as the pillow 200, but for the inclusion of a cover 330. The cover 330 may be made of many different materials, with some materials being lightweight and/or porous so as to keep a user cooler compared to conventional travel pillows. The cover 330 may comprise four-way stretch materials such as a cotton/polyester blend. Many different cover materials including but not limited to unitary materials, two-way stretch materials, eight-way stretch materials, cotton, polyester, mesh, foam, and combinations or blends of these and other materials are possible. The material may be chosen so as to provide the flexion, displacement, containment, shape, and other pillow characteristics as desired.

The cover 330 may include an airflow portion 332. The airflow portion 332 may comprise an air permeable material, such as a mesh material or other type of material that enables the flow of air into and out of the pillow 330. In other embodiments of the present disclosure, an airflow portion may include no material so as to provide the maximum airflow. The airflow portion 332 may be placed in an area approximately corresponding to or at least partially overlapping with an indented portion such as the indented portion 308, and/or in an area approximately corresponding to or at least partially overlapping with apertures such as air or ventilation apertures 310, such that the airflow portion 332 is over one or more of the apertures 310. In other embodiments, the entire cover 330 may be a highly air permeable material such as mesh. Many different embodiments are possible.

Use of covers such as the cover 330 may also alter the shape and appearance of the pillow itself. For example, the cover 330 causes the curves of the pillow 300 shown in FIGS. 3A-3F to be softened compared to those of the pillow 200 from FIGS. 2A-2F. Tighter- and looser-fitting covers are also possible.

Figure 4A:
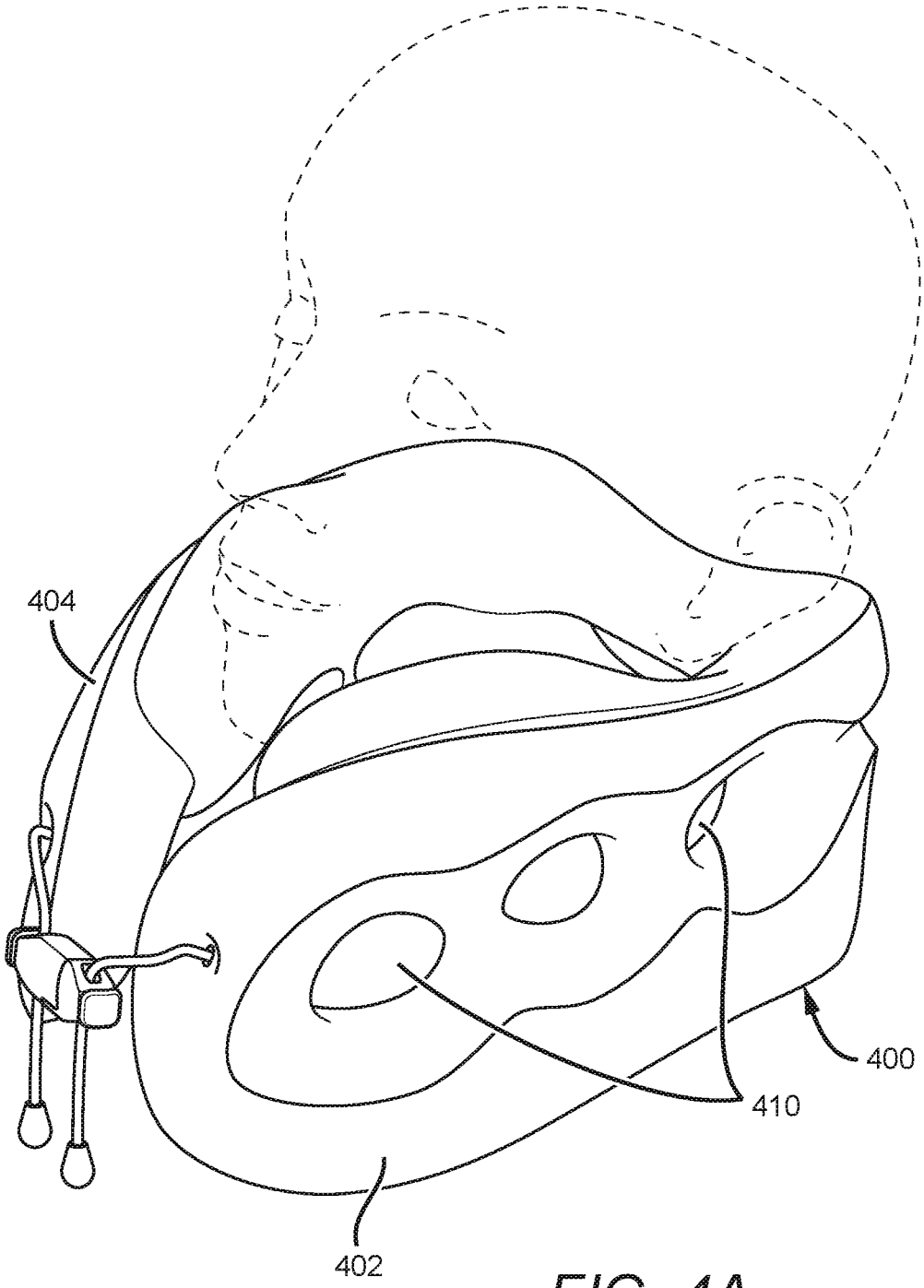
FIGS. 4A-4F show top perspective, front, rear, side, top, and bottom views of another embodiment of a pillow according to the present disclosure.
Figure 4B:
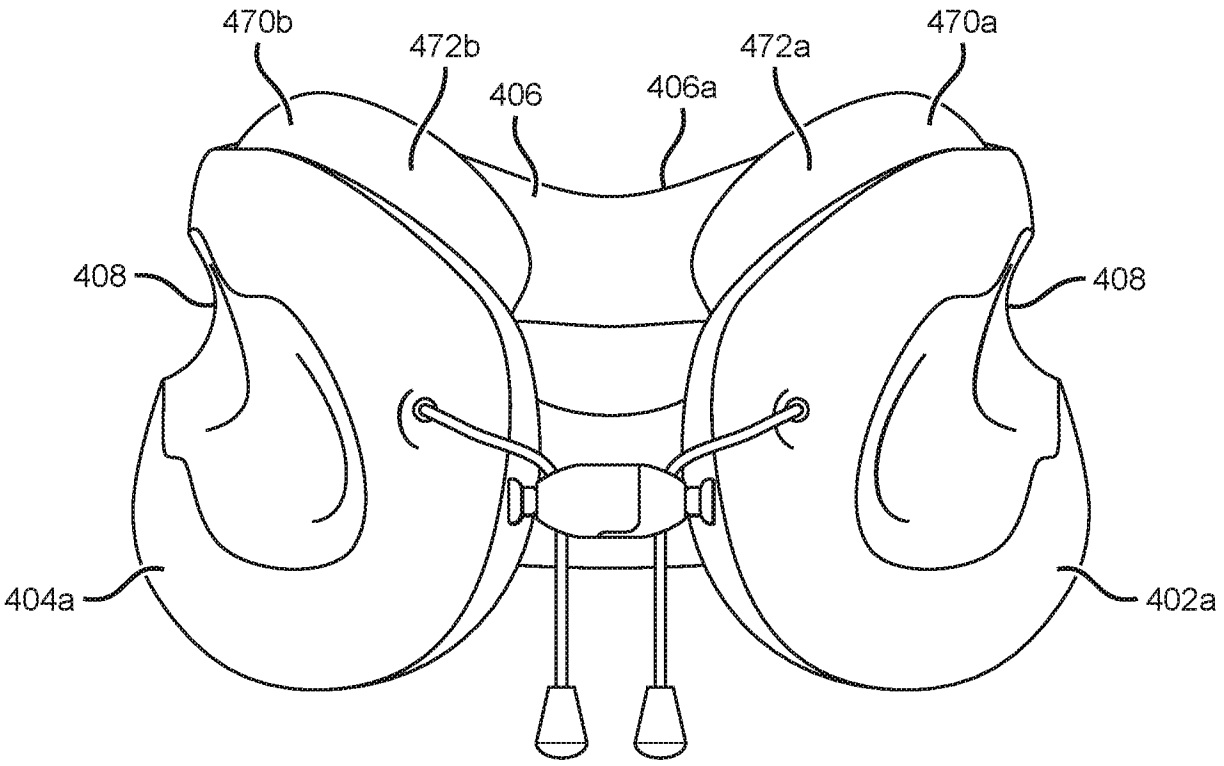
Figure 4C:
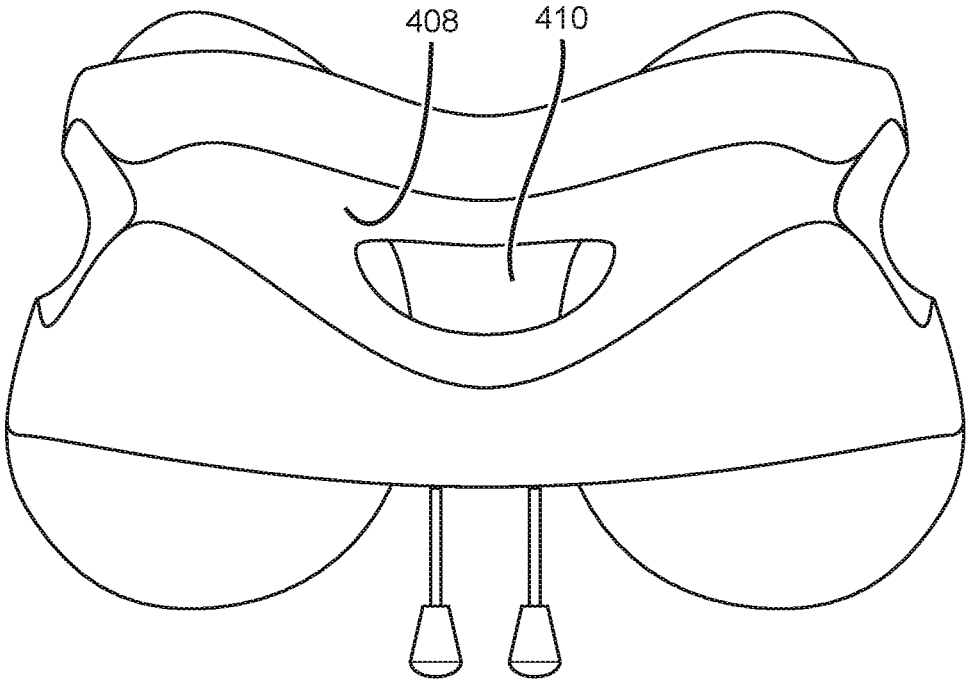
Figure 4D:
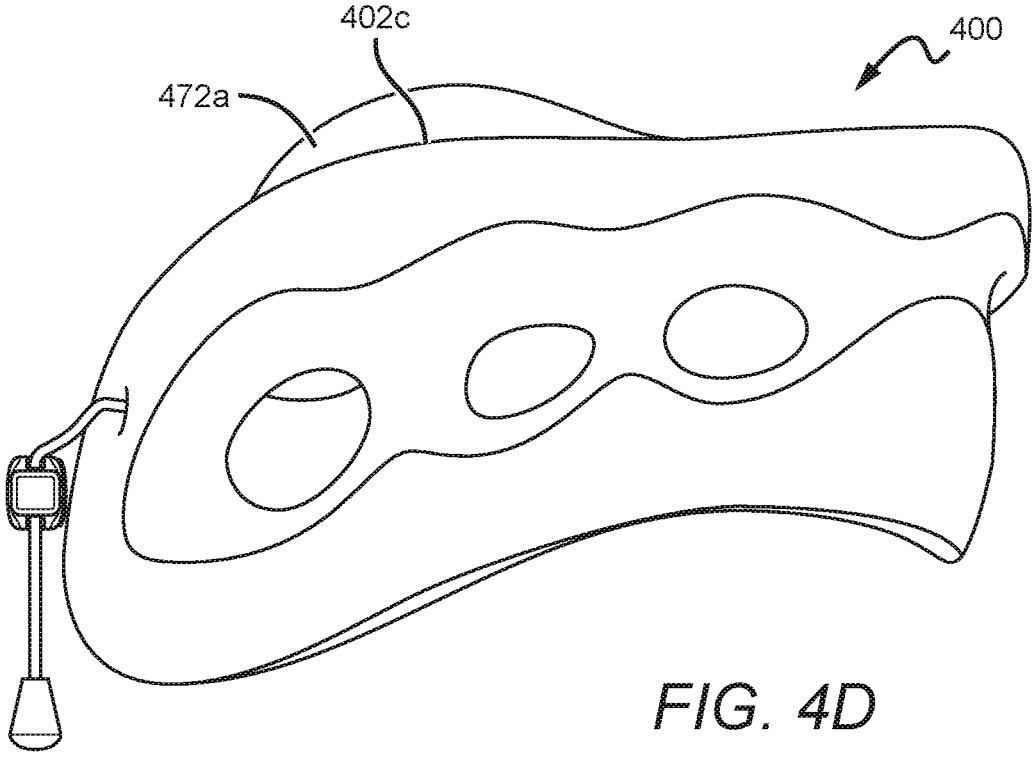
Figure 4E:
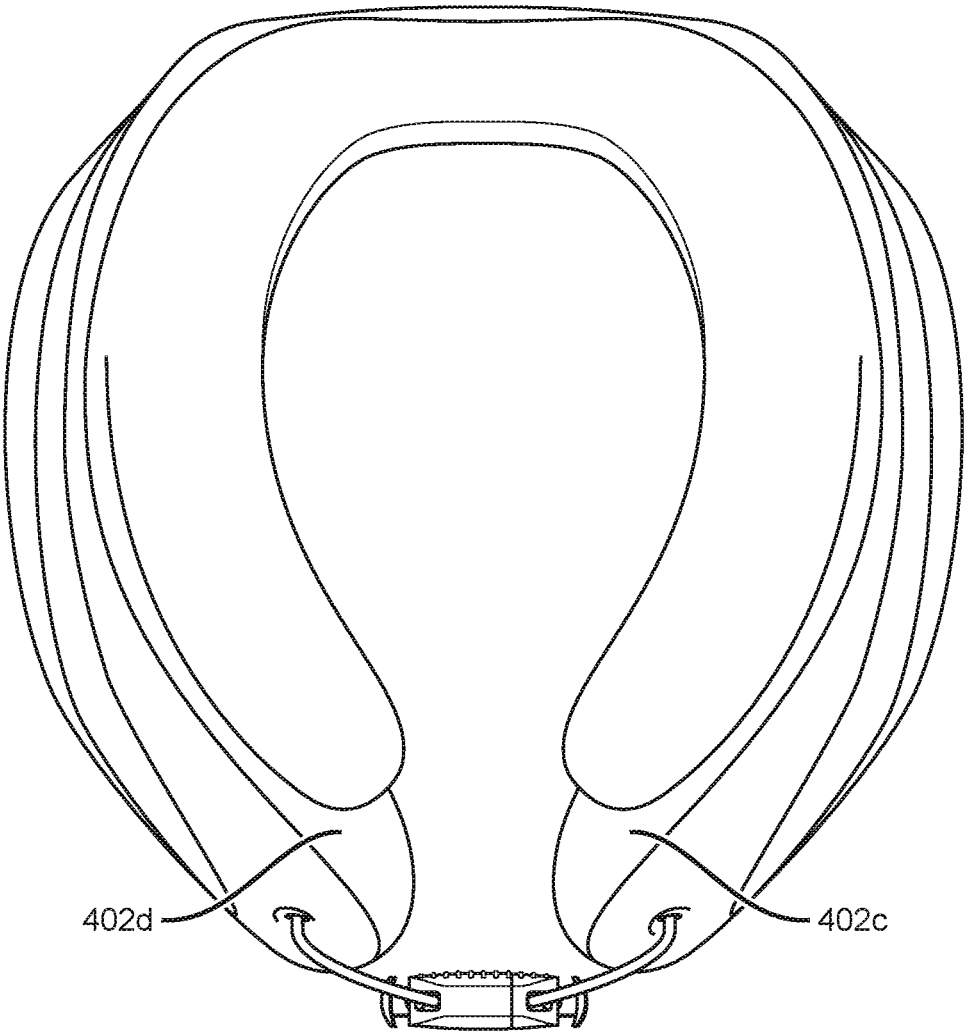

Many different chin support shapes other than those shown in FIGS. 2A-3F are possible. For example, FIGS. 4A-4F show one example of a pillow 400 including protrusions or chin supports 470*a*,470*b*. The protrusions or chin supports 470*a*,470*b* are arcuate in nature similar to the protrusions or chin supports 270*a*,270*b*, but are less pronounced and do not include near-vertical or vertical front ends. The chin supports 470*a*,470*b* may have dimensions similar to or the same as the protrusions 270*a*,270*b* from FIGS. 2A-2F, or may have different dimensions. The maximum height of the chin supports 470*a*,470*b* may have a maximum height in the middle 50% of the length of the chin supports from back to front (as best shown in FIG. 4D), such as having a maximum height approximately in their center, as opposed to the protrusions 270*a*,270*b* which have a maximum height at or near their front, such as in the front 25% of the length of the chin supports. Many different protrusion or chin support shapes are possible. FIGS. 4A-4F also display first and second side portions 402,404, rear portion 406, indented portion 408, air or ventilation apertures 410, as well as upper surfaces 402*c*,402*d* of the left and right side portions 402/404. These elements may be similar to or the same as corresponding elements in FIGS. 2A-2F, or may be different.

FIGS. 5A-5F show another embodiment of a pillow 500 according to the present disclosure. The pillow 500 may be similar to, or the same as the pillow 400 from FIGS. 4A-4F, but also include a cover 530, which may be designed similarly to the cover 330 but also designed to fit the shape of the elements therein. FIGS. 5A-5F also include airflow portion 532 which may be placed in an area approximately corresponding to indented portion 508, and/or in an area approximately corresponding to apertures such as air or ventilation apertures 510. In some embodiments, airflow portions such as the airflow portion 532 may be provided so as to overlap completely with each of the ventilation apertures 510, such that no portion of the ventilation apertures 510 are covered by a non-airflow portion of the cover (it is understood that the airflow portion may or may not also overlap with non-aperture areas). In some embodiments, airflow portions such as the airflow portion 532 may be provided so as to overlap completely with an indented portion such as the indented portion 508, such that no portion of the indented portion 508 is covered by a non-airflow portion of the cover (it is understood that the airflow portion may or may not also overlap with non-indented areas). In certain specific embodiments, an airflow portion can be provided such that a viewer can see through the airflow portion and the underlying aperture(s), which can indicate that a sufficient amount of airflow is being provided. The use of covers such as the cover 530 may also alter the shape and appearance of the pillow itself.

Figure 4F:
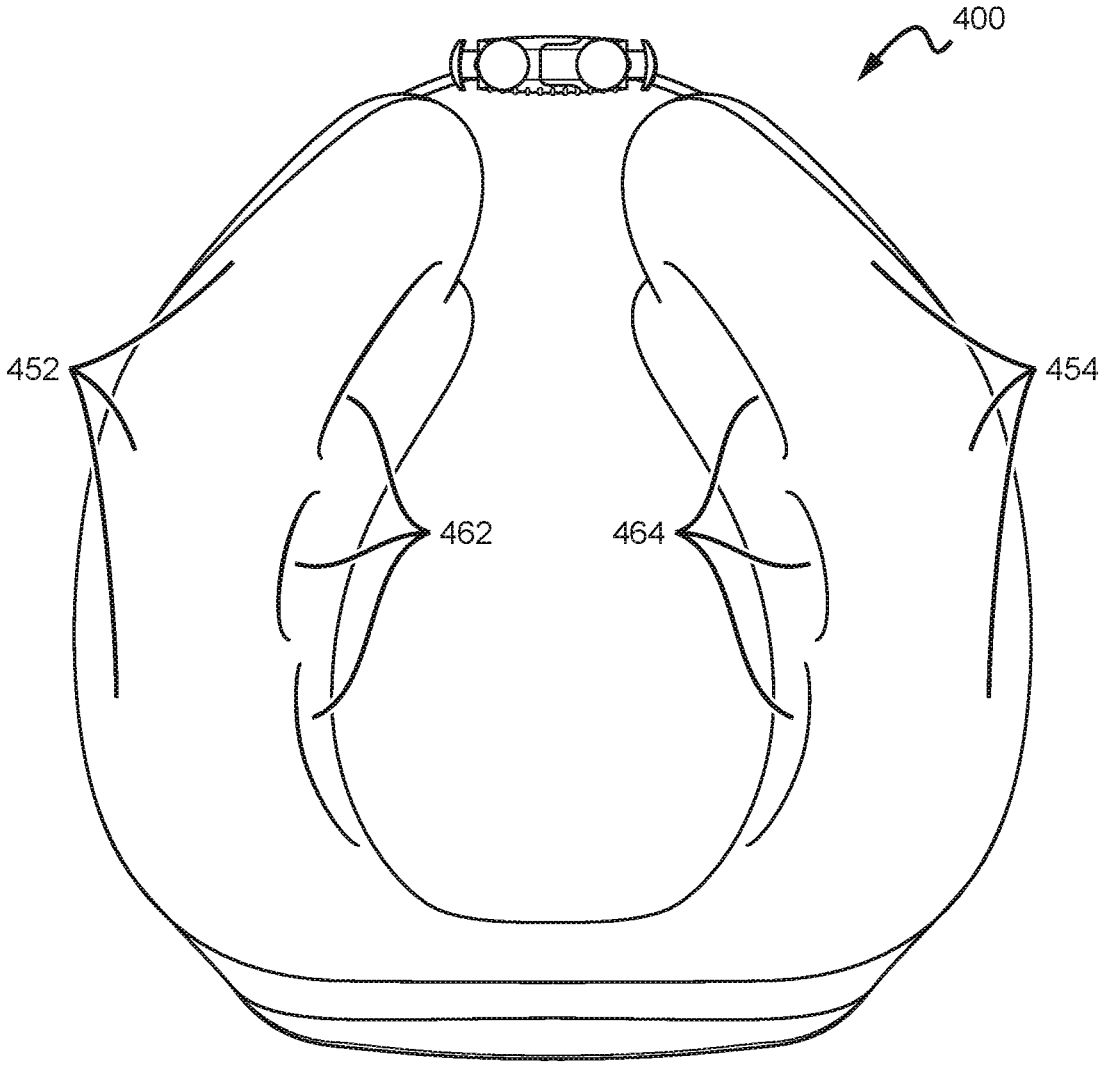
Figure 5A:
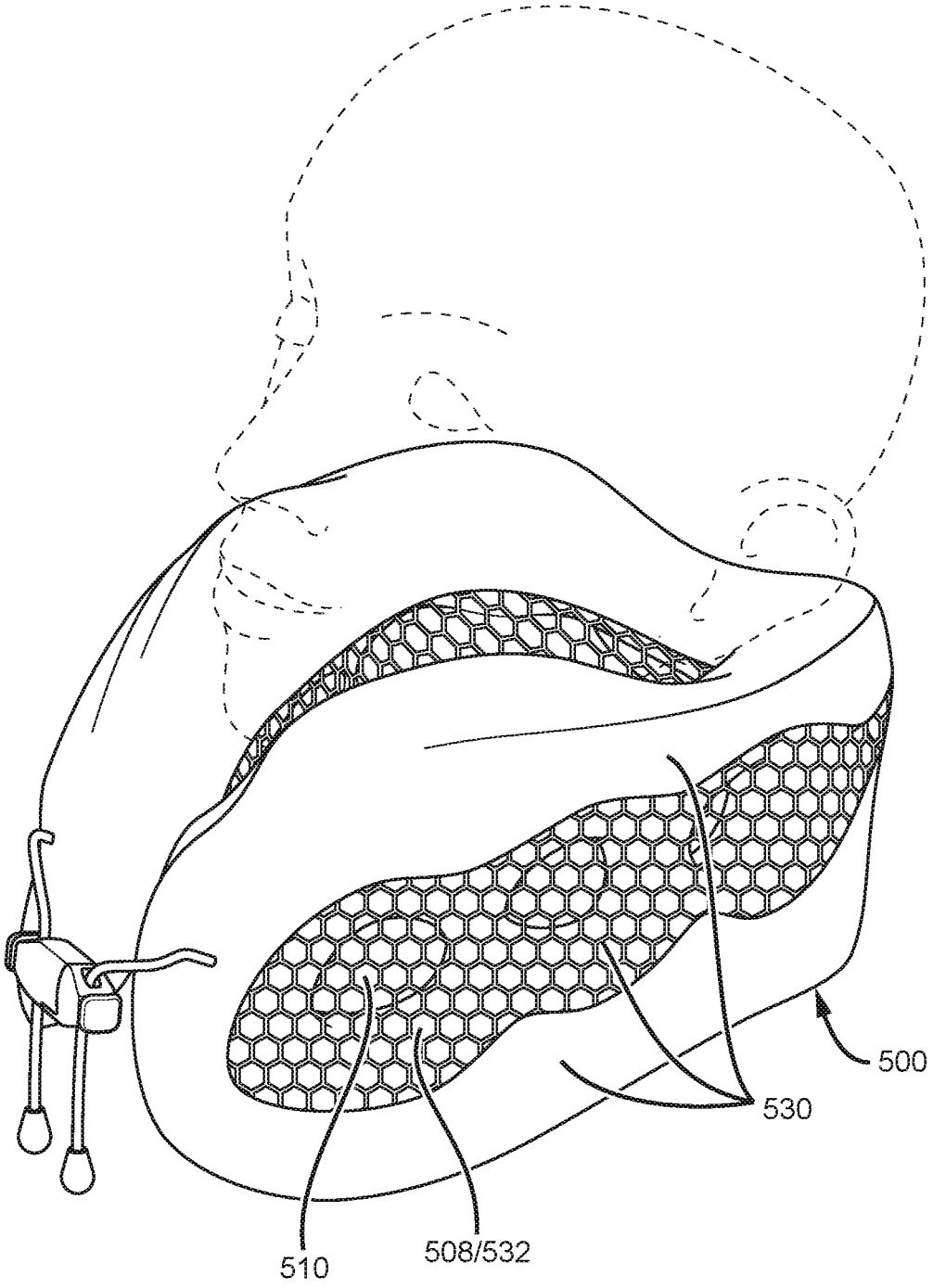
FIGS. 5A-5F show top perspective, front, rear, side, top, and bottom views of another embodiment of a pillow including a cover according to the present disclosure.
Figure 5B:
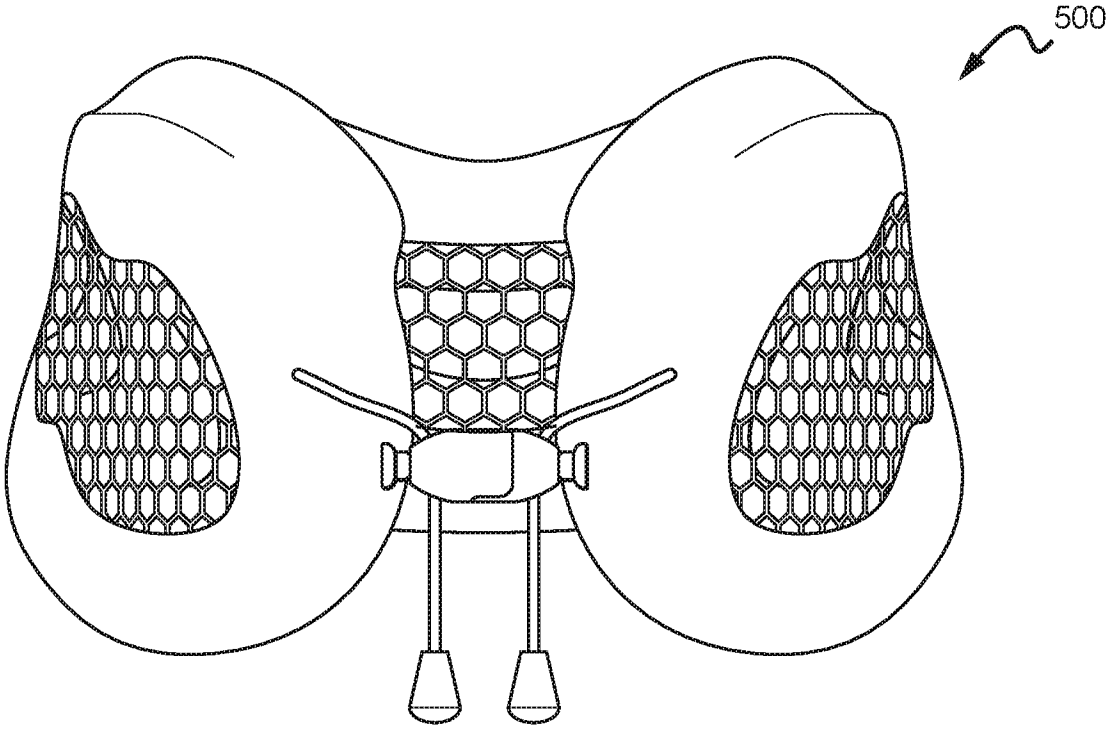
Figure 5C:
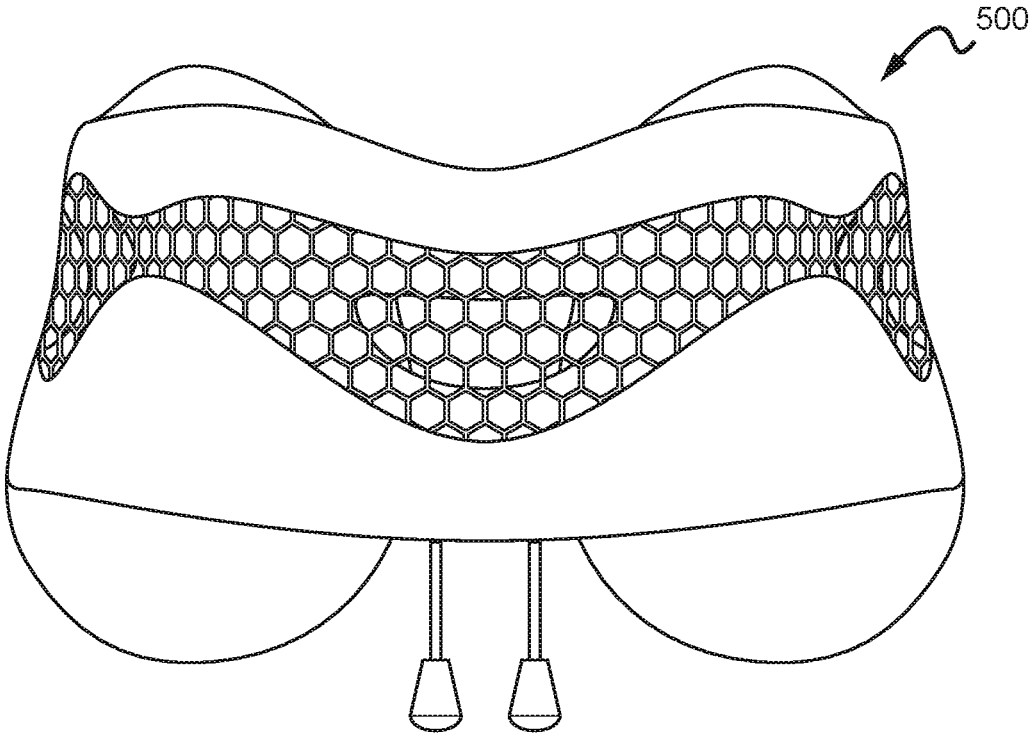
Figure 5D:
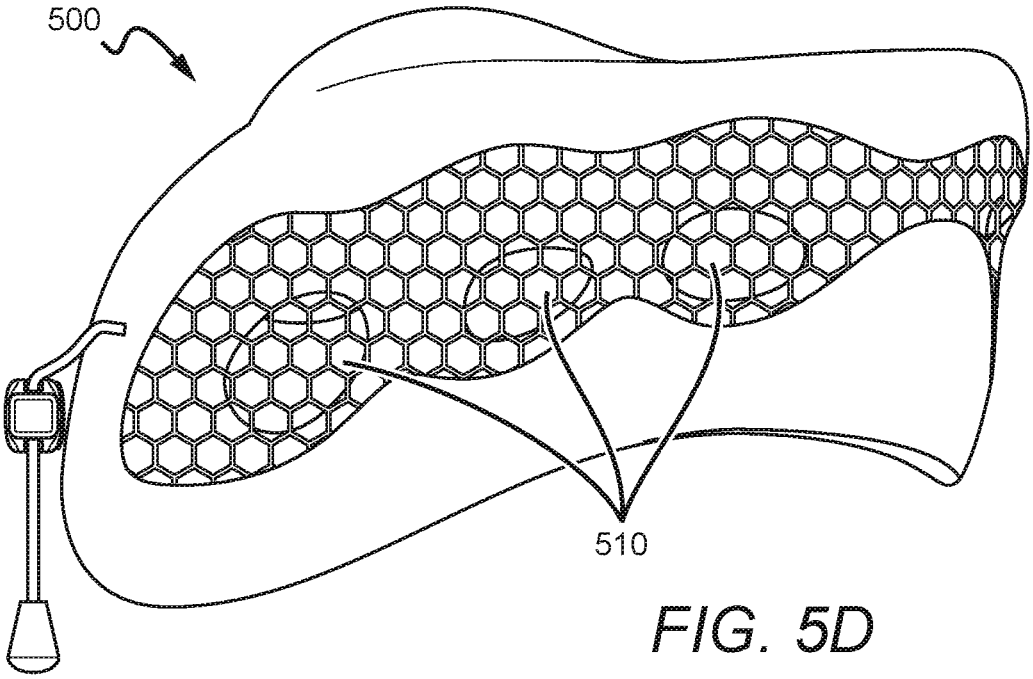
Figure 5E:
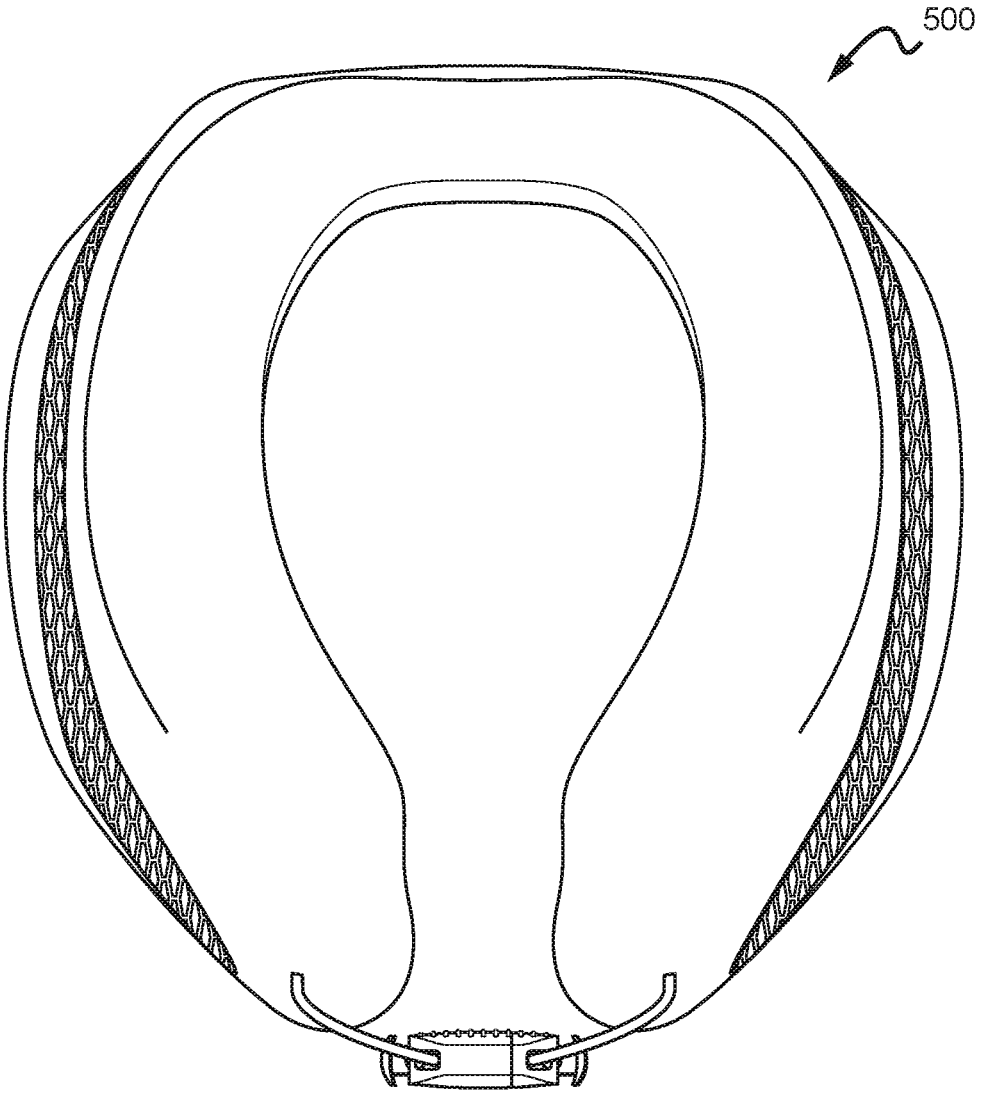
Figure 5F:
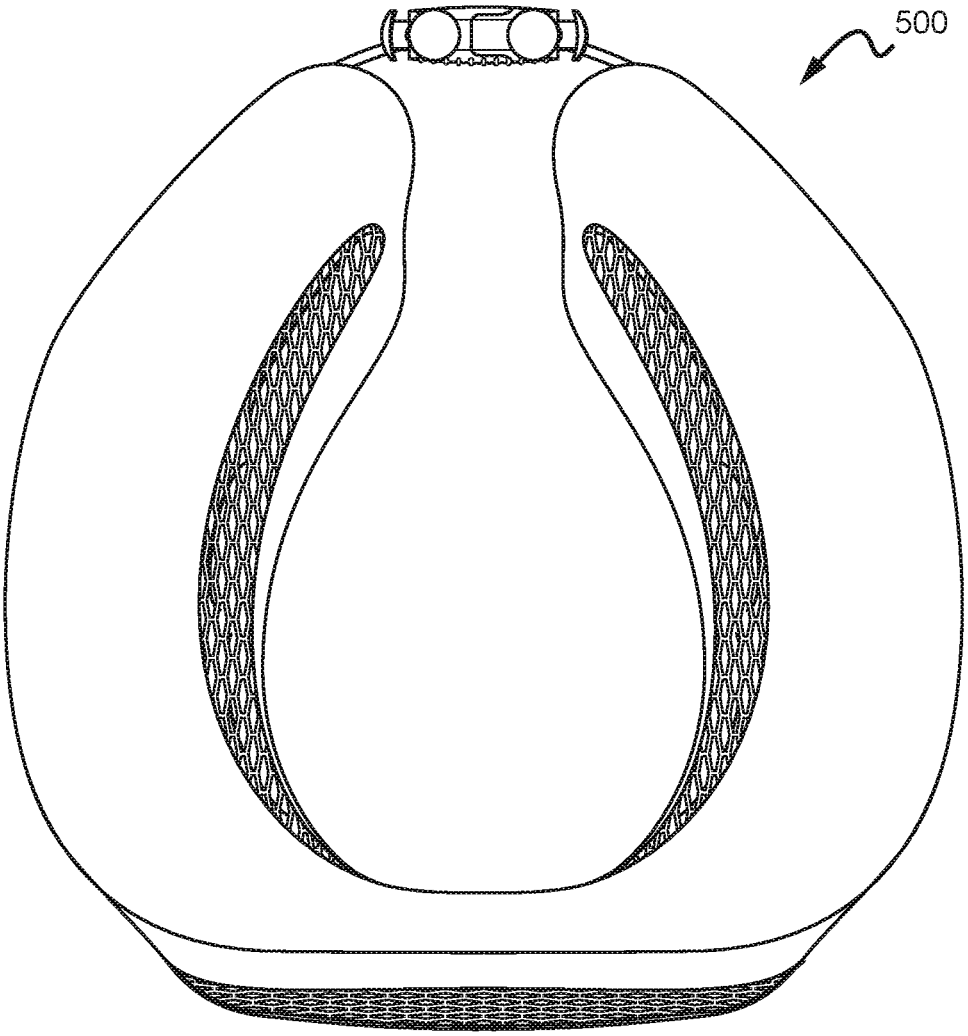

Chin supports such as protrusions or chin supports 270*a*, 270*b* and 470*a*,470*b* may be used for purposes other than support of the outside of a user's chin. For example, in the embodiment shown in FIGS. 4A-4F and as best seen in FIG. 4F, in a first position the bottom surfaces 452,454 of the left and right side portions 402,404 may rest on a user's shoulders. In a second position particularly adapted to a user whose head is tilting forward, the user may place the inner surfaces 462,464 of the left and right side portions 402,404 against his/her chest. In such a configuration, the outer surfaces of chin supports, such as the outer surfaces 472*a*, 472*b*, can serve as a chin rest for a user resting with his/her head leaning forward, such that, for example, the bottom of the user's chin is on a portion of one or more of the outer surfaces 472*a*,472*b*.

Pillows according to the present disclosure may be manufactured using many different methods. In one embodiment of a manufacturing method according to the present disclosure, an inner frame of the pillow (typically comprising denser and/or more rigid material than the outer portion) is molded and cured. After curing, the outer portion may be molded thereover. The molding of the inner and outer portions of the pillow may be done so as to include air apertures therein. In another embodiment, neither of the inner frame and outer cushion are molded to define apertures, and any material in the proposed aperture area may be removed automatically or manually. In another embodiment, only one of the inner frame and outer cushion is molded to define one or more apertures, and any material in the proposed aperture area of the other may be removed. Many different methods are possible.

The cross-sectional shape of the side portions may be shaped so as to enhance user comfort over conventional travel pillows. In conventional travel pillows, the portion abutting a user's neck often contacts or pressures a user's trachea, which can cause discomfort. Embodiments of pillows according to the present disclosure, however, may be shaped so as to prevent this contact or pressure.

Figure 6:
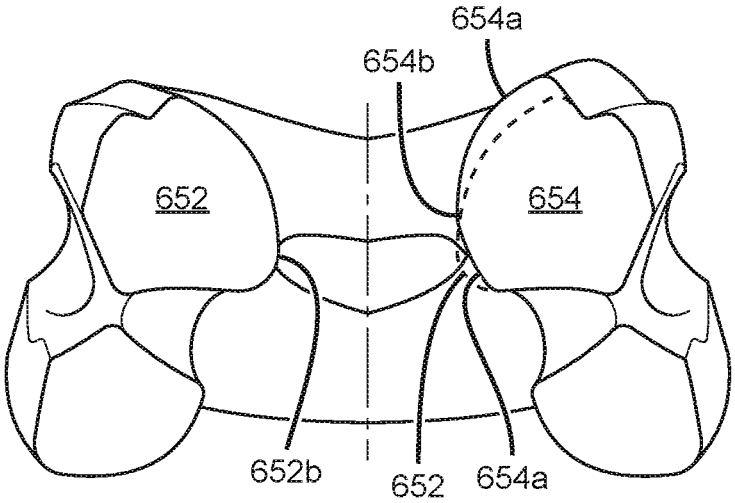
FIG. 6 shows a comparative view of two pillow cross-sections according to the present disclosure.

FIG. 6 shows a comparison of the cross-section of an upper side portion 652 compared to the cross-section of an upper side portion 654 according to the present disclosure. Whereas the upper side portion 652 (shown on the left side of the figure and shown by the outline shape on the right side of the figure) is substantially angled toward a user's neck toward its bottom, the upper side portion 654 includes an inner surface 654*a* that angles away from a user's neck toward its bottom so as to avoid contact or pressure upon a user's neck or trachea. This is shown by the fact that the innermost protruding point 652*b* of the upper side portion 652 is nearly at the bottom of the upper side portion 652, while the innermost protruding point 654*b* is approximately at the midpoint height-wise of the upper side portion 654. Cross-sections including an inner surface which are angled away from a user's neck toward their bottom such as the inner surface 654*a* may thus result in increased comfort. In some embodiments of the present disclosure, the cross-section of the upper side portion may be angled away from the user's neck for one quarter or more of the total cross-sectional height. In other embodiments, such a cross-section may be angled away from a user's neck for half or more of the total cross-sectional height, and in yet another embodiment may be angled away from a user's neck for three quarters or more of the total cross-sectional height. Many different embodiments are possible.

Angling of upper side portion cross-sections away from a user, such as the angling of the upper side portion 654, may serve additional purposes. For example, users may adjust the pillow such that the inner surfaces of the pillow, such as the inner surface 654*a*, are against a user's chest, as described above. The angle of the inner surface 654*a* removes material which typically would bunch against the user's chest and cause discomfort. Additionally, as previously described with respect to side portion shape and the inclusion of chin supports, the angling of the upper side portion away from a user's neck can result in a lower user contact area, thus providing an increased cooling effect. This type of cross-section can also result in benefits with regard to the support provided by the pillow, in that because less material is present or bunched against the user, the pillow is capable of a further range of user adjustment to find a comfortable configuration.

Figure 7A:
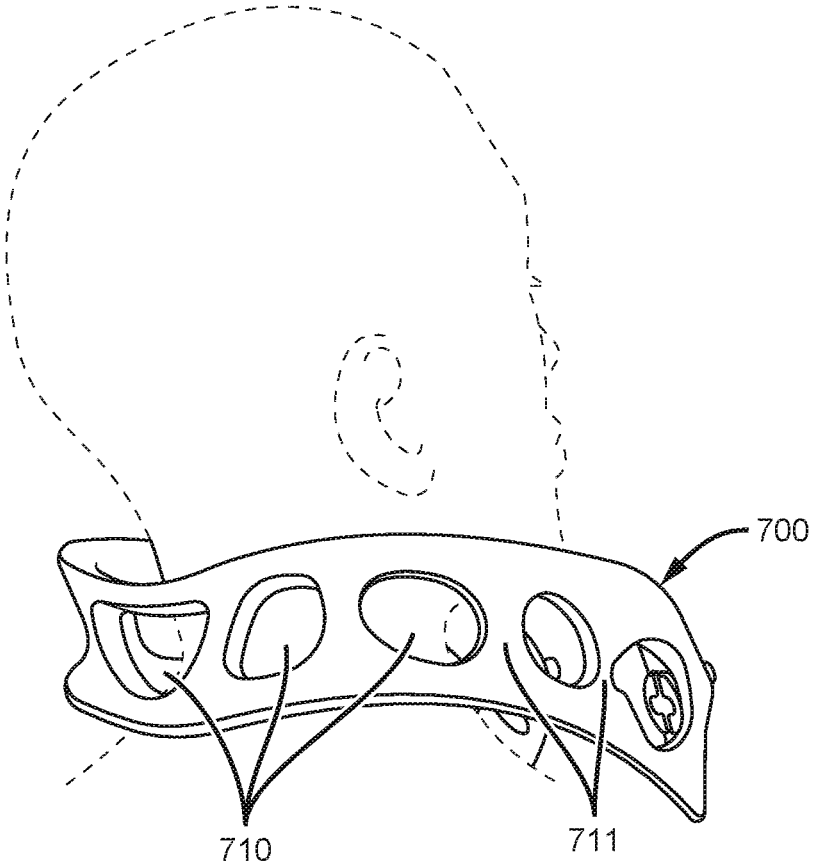

As discussed above, pillows according to the present disclosure may include inner frames which can provide support, serve as shock absorbers, and provide a desired flexion profile to a user. One example of a frame 700 according to the present disclosure and which can be used in embodiments of pillows according to the present disclosure is shown in FIGS. 7A-7C. The frame 700 includes air apertures 710 and pillars 711 therebetween for support. Some or all of the apertures 710 may correspond to apertures in an outer cushion that is over the frame 700. In other embodiments, some or all of the pillars 711 may be omitted so as to provide more flexibility. For example, in one such embodiment no pillars are present and one large aperture runs around nearly the entire frame from the front of one side to another. In another embodiment, the left and right portions of the frame each define one large aperture. In yet another embodiment, the left, right, and rear portions of the frame each define one aperture. In other embodiments, more pillars may be included so as to provide more structural support. While in some embodiments of the present disclosure each inner frame aperture 710 corresponds to an outer cushion aperture, in some other embodiments the inner frame may have more or less apertures than the outer cushion. This can serve structural and cost purposes.

Inner frames such as the frame 700 shown in FIGS. 7A-7C may have many different dimensions, and the dimensions of inner frames according to the present disclosure may be customized based upon the dimensions of the outer cushion in which the inner frame will be placed. In one embodiment, the maximum width of the frame (from left to right as shown in FIG. 7B) may be approximately equal to the length of the frame (from top to bottom as shown in FIG. 7B). Each of these dimensions, whether or not they are approximately equal to one another, may be between 6 and 12 inches, and in one further specific embodiment may be between about 7.5 inches and 10 inches. In one specific embodiment thereof, the length, width, or both may be between about 8.5 inches and 9 inches. The height of the inner frame may be uniform along its length, or may vary as shown in FIG. 4C. In some embodiments, the height of the frame (whether substantially uniform or varying) may be between about 1 inch and 5 inches, and in one specific embodiment thereof between about 2 inches and 3.5 inches. The frame may be have a smaller height in the back than in the front, as shown, or may have a larger height in back and a smaller height in front. As also discussed above, the inner frame may curve toward its front as best seen in FIG. 7C in order to better fit a user's shoulders. As best seen in FIG. 7B, the width of the side portions of the frame may vary along their length, and/or the side portions may have a width different than the rear portion. The side portions of the frame may have widths between about 0.25 inch and 2 inches, and in one specific embodiment thereof between about 0.5 inch and 1.5 inches. The rear portion may have a thickness of about 0.1 inch to about 1.0 inches, and in a specific embodiment thereof about 0.25 inch to 0.75 inch, and in an even further specific embodiment thereof about 0.5 inch. Many different embodiments are possible, and it is understood that the above dimensions are only exemplary in nature.

Embodiments of the present disclosure may also include a layer between inner and outer cushions, with such a layer preventing or reducing the possibility of tearing of the inner frame. Such a layer may comprise cloth, nylon, rubber, fibrous materials, cross-hatched materials, or other materials, and may be arranged in a pattern to reduce the possibility of tearing, such as a cross-hatch arrangement. Such materials or layers could also be within inner frames, or within outer cushions, according to embodiments of the present disclosure.

Figure 8A:
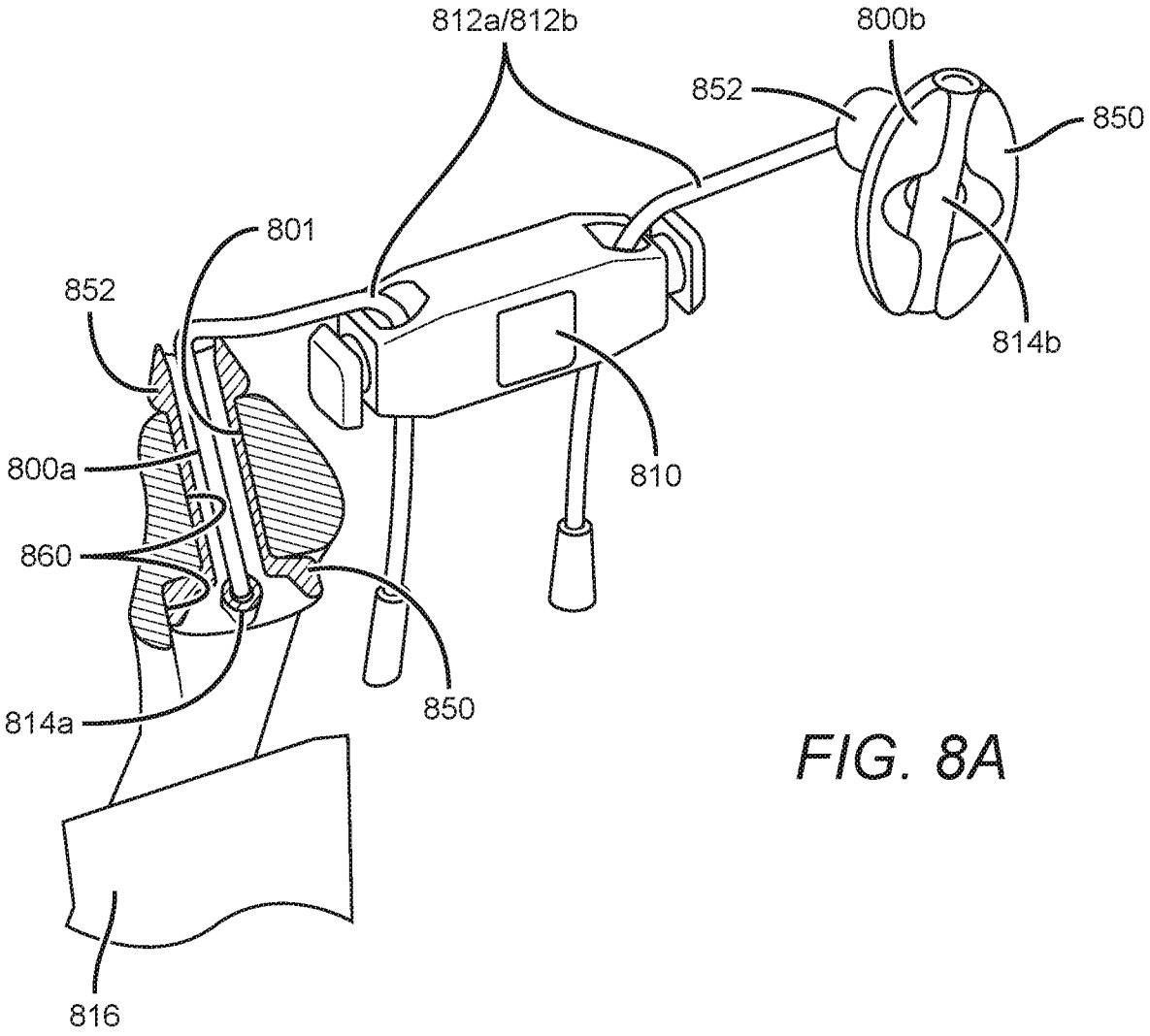
FIG. 8A shows one embodiment of an anchor mechanism according to the present disclosure.

As discussed above with regard to FIG. 1, some embodiments of the present disclosure may include drawstrings or similar devices to be attached to the remainder of the pillow. In some embodiments of the present disclosure, these devices may be elastomeric. FIG. 8A shows one embodiment of an anchor mechanism 800 according to the present disclosure, with FIGS. 8B and 8C showing connections of the anchor mechanism 800 to a pillow inner frame 802 and a pillow cushion 804, respectively. In FIG. 8A, two anchor mechanisms 800 are shown connected to a closure mechanism 810 and two drawstring halves 812*a*,812*b*. A rear perspective view of the right anchor mechanism 800*b* is shown on the right of FIG. 8A. The left anchor mechanism 800*a* is connected to a pillow inner frame 816, and a cross-sectional view of this connection is shown. The left anchor mechanism may include a base 850 on an inside surface of the inner frame (and in some embodiments including an outer cushion, on an inside surface of the outer cushion), and may include a protrusion 852 which in this embodiment sticks out a front surface of the inner frame 816 (although in some other embodiments it may not completely protrude from the inner frame). The anchor mechanism base 850 and part of the protrusion 852 are also shown in FIG. 8C. It is understood that some anchor mechanisms according to the present disclosure may include only one of a base and protrusion, or neither of these elements.

In the specific embodiment shown in FIGS. 8A-8C, the anchor mechanism 800 is a T-anchor mechanism that allows for disconnection from a connector such as the drawstring halves 812*a*,812*b*. It is understood that many different anchor mechanisms, including both those that do and those that do not allow for disconnection from connectors such as a drawstring half, are possible. Each of the base 850 and protrusion 852 may define a channel through which a connector can be placed, and in the embodiment shown these portion channels combine to form an anchor mechanism channel 801. In FIG. 8A, the drawstring halves 812*a*, 812*b* are placed through the channel defined by the anchor mechanism 800 to the rear side 854 of the anchor mechanism 800. The connectors (in this embodiment, the drawstring halves 812*a*,812*b*) may include stops 814*a*,814*b*. In the embodiment shown the stops 814*a*,814*b* include a portion of the drawstring halves 812*a*,812*b* which is rigid, such as plastic, metal, or the like. The stops 814*a*,814*b* could be rigid or semi-rigid pieces attached to the end of the remainder of the drawstring halves 812*a*,812*b*, could be tubes around the end of the less rigid drawstring material, or could be some other type of stop as is known in the art.

In the embodiment shown, the drawstring halves 812*a*, 812*b* may be aligned with and placed through the channel 801 defined by the anchor mechanism 800 until they are on the rear side thereof, and the stops 814*a*,814*b* can then be turned so as to no longer be aligned with the channel 801, such as being turned perpendicularly to the channel 801 as shown in FIG. 8A. In this configuration, the stops 814*a*,814*b* may prevent the drawstring halves 812*a*,812*b* from being disconnected from the anchor mechanisms 800, unless the stops 814*a*,814*b* are turned so as to be aligned with the channel 801. The rear of the anchor mechanism 800 may be shaped to define a nesting position for the stops 814*a*,814*b*, which may aid in preventing accidental alignment of the stops 814*a*,814*b* with the channel 801, and thus can aid in preventing accidental disconnection of the drawstring halves 812*a*,812*b* and the anchor mechanisms 800.

Use of anchor mechanism and drawstring combinations such as that shown in FIGS. 8A-8C may also be advantageous for disassembly of a pillow according to the present disclosure. These mechanisms provide increased stability for the drawstring halves because they are anchored to the outer cushion and/or inner frame instead of simply being anchored or otherwise attached to a cover. Further, such a system provides one or more advantages of drawstring halves that are connected to covers, in that the removability of the drawstring halves means that the drawstring halves and cover can be removed from the remainder of the pillow, enabling easier cleaning or other maintenance. In some prior art pillows with drawstring halves that are anchored to the pillow body itself but are not removable, the cover may not be able to fully detach from the remainder of the pillow, making maintenance difficult. It is understood, however, that pillows with connectors or drawstring halves that are anchored to a cover, or that are not removable, are within the scope of the present disclosure. Further, while FIGS. 8A-8C show one embodiment of a T-anchor mechanism according to the present disclosure, it is understood that many aesthetically and/or functionally similar anchor mechanisms are possible.

Use of anchor bases such as the anchor base 850 can aid in preventing ripping of the pillow to which the anchor mechanism is attached. An anchor base may have an area larger than the material that would otherwise be resting against the remainder of the pillow, such as a stop such as the stop 814*a*. This larger area can spread the force caused by a user pulling upon the connector (e.g., a drawstring half) over a larger pillow area, thus reducing the chance of ripping or tearing.

Anchor mechanisms according to the present disclosure may be connected to pillows, such as to inner frames and cushions, at drawstring apertures which may be placed through a forward portion of the side portions thereof (although other placements are possible). The anchor mechanism may include ends having a diameter larger than the aperture so as to secure the anchor mechanism to the frame and/or cushion. For example, in the embodiment shown on the left of FIG. 8A, the base 850 and the end 852*a* of the protrusion 852 have a diameter larger than the diameter of the drawstring aperture 860. The material of inner frames and outer cushions according to the present disclosure may be pliable (even though the inner frame is often "rigid" compared to the outer cushion), thus allowing for a user to remove the anchor mechanism from the drawstring aperture. Further, while FIG. 8A shows an anchor mechanism 800*a* that protrudes from both sides of the drawstring aperture 860, in other embodiments no sides or only one side of the anchor mechanism protrudes from the drawstring aperture. For example, in one such embodiment, an anchor mechanism base is partially or wholly on the outside of a drawstring aperture while an anchor protrusion is entirely within the drawstring aperture; the anchor protrusion may still have a diameter larger than the natural diameter of drawstring aperture formed by a pliable material, which can help in securing the attachment of the anchor mechanism to the adjacent material, whether it be an inner frame or a cushion.

The anchor mechanism 800 may be attached at an inner surface of the pillow inner frame 802 (FIG. 8B) and/or a pillow cushion 804 (FIG. 8C). In embodiments of the pillow cushion 804 that include an inner frame therein, the drawstring apertures may be through both the inner frame and the outer cushion, such that the anchor mechanism is anchored at a rear wall of the outer cushion as shown in FIG. 8C. In other embodiments, the anchor mechanism could be anchored at a rear wall of an inner frame as is shown in FIG. 8B. Many different embodiments are possible.

Figure 9F:
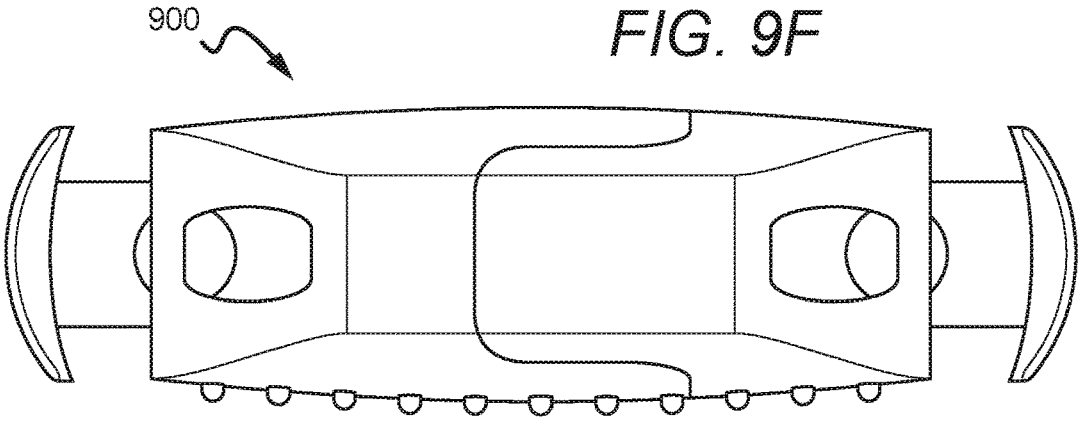

As discussed above with regard to FIG. 1 and the closure mechanism 112, and as shown in other figures above, pillows according to the present disclosure may include closure mechanisms such as clips, buckles, and mechanical fasteners, for example. FIGS. 9A-9F show top perspective, front, rear, side, top, and bottom views of one embodiment of a closure mechanism 900 according to the present disclosure. As shown in FIGS. 9A-9F, the closure mechanism 900 may include a left closure mechanism portion 902 and a right closure mechanism portion 904, and may also include operators such as spring-operated push buttons 906*a*,906*b*. In the specific embodiment shown and as best seen in FIG. 9E, actuating push button 906*a* can cause the button aperture 956*a* to align with the closure mechanism portion aperture 952, and actuating the push button 906*b* can cause the button aperture 956*b* to align with the closure mechanism portion aperture 954. Once aligned, the sliding of the left and right closure mechanism portions 902,904 along each respective half of a connected drawstring becomes possible. When the push buttons 906*a*,906*b* are not actuated, they may be biased to a "closed" position as shown in FIG. 9E such that any drawstring halves will be held in a vice-like grip between the closure mechanism portions and the push buttons, and movement along the drawstring halves will be made more difficult. When the left and right closure mechanism portions 902,904 are connected, both push buttons 906*a*,906*b* can be actuated to enable the sliding of the entire closure mechanism 900. When the left and right closure mechanism portions 902,904 are separated, the push button 906*a* can be actuated to enable sliding of the left closure mechanism portion 902. Likewise, the push button 906*b* can be actuated to enable sliding of the right closure mechanism portion 904. It is understood that other embodiments may comprise operational features to enable movement of the left and right closure mechanism portions 902,904 other than the spring-operated push buttons 906*a*,906*b*.

When the left and right closure mechanism portions 902,904 are connected (as shown in FIGS. 9A-9F), they may meet at a split line 910 that may or may not be visible to a user. In the embodiment shown, the left closure mechanism portion 902 includes a protrusion 902*a* and indentation 902*b*, while the right closure mechanism portion 904 includes a protrusion 904*a* and indentation 904*b*. These respective protrusions and indentations of the left and right closure mechanism portions 902,904 may be configured to mate with one another. In one embodiment according to the present disclosure, the split line 910 runs approximately vertically down the closure mechanism 900 before turning substantially horizontally to the right near the bottom of the closure mechanism 900. In some embodiments, the design of the split line 910 results in the protrusion 902*a* and indentation 904*b* being smaller than the indentation 902*b* and protrusion 904*a*. However, it is understood that in other embodiments these corresponding areas may be equal in size, or may have a smaller or larger area ratio than as shown. Moreover, it is understood that the split line 910 may follow many different paths. For example, the split line 910 may be any number of different shapes, such as vertical, jagged, sawtooth, wavy, or any other similar shape.

FIG. 9C shows a rear surface of the closure mechanism 900. This rear surface may include grips 912, which can increase friction and thus reduce slippage of a user's fingers when attempting to open the closure mechanism 900. In the specific embodiment shown, the grips 912 comprise ridges running from the top to bottom of the clip. However, it is understood that grips may take any number of different shapes, such as horizontal lines, wavy lines, jagged lines, regular or irregular polygon shapes, etc. Furthermore, while the specific embodiment shown comprises 11 total grips 912, it is also understood that any number of grips 912 may be utilized. Grips or other indicators may also serve as a tactile signal or indicator to a user to aid users in easily and properly orienting the closure mechanism 900 for easy operation, such as easy engagement or disengagement of the closure mechanism portions 902,904. Some such indicators, including raised areas such as grips, can accomplish this indication by non-visual means such as touch or feel. Finally, although grips 912 are included on only one surface of the closure mechanism 900 in the specific embodiment shown, it is understood that grips may be included on any combination of closure mechanism surfaces, such as any combination of the front, rear, top, bottom, and side surfaces. For example, in one specific embodiment, grips are included on the front and rear surfaces. In another embodiment, grips are not included. Many different embodiments and grip combinations are possible.

The closure mechanism 900 may include inner portions that interact with, or otherwise mate with, one another so as to form a secure connection between the left and right fasteners 902,904. Many different inner portion designs are possible, and it is understood that different outer portion designs may be used with different inner portion designs and vice versa.

Figure 10E:
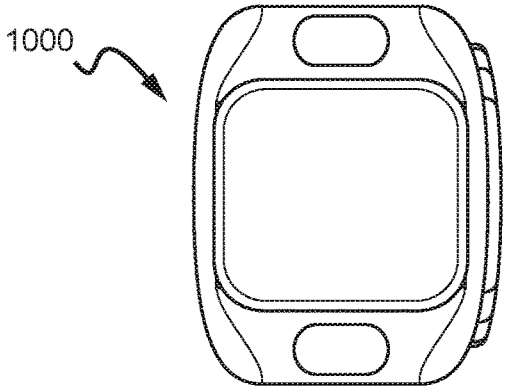
FIGS. 10A-10I show exploded views of one embodiment of a closure mechanism according to the present disclosure.
Figure 10H:
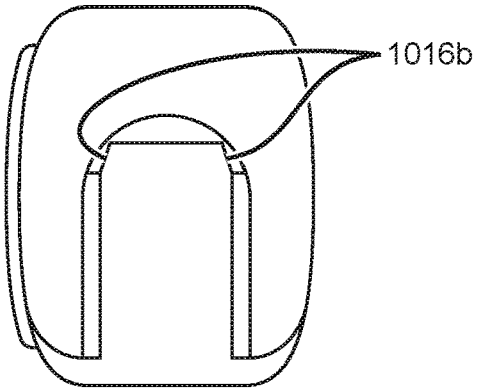
Figure 10I:
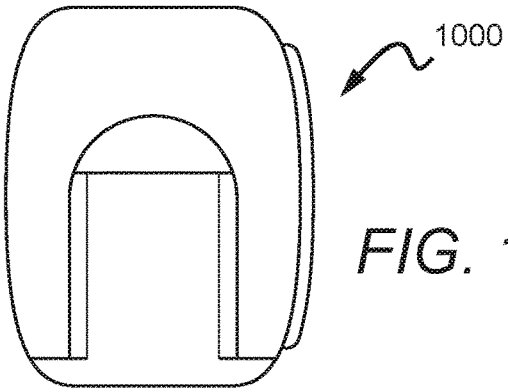
Figure 10A:
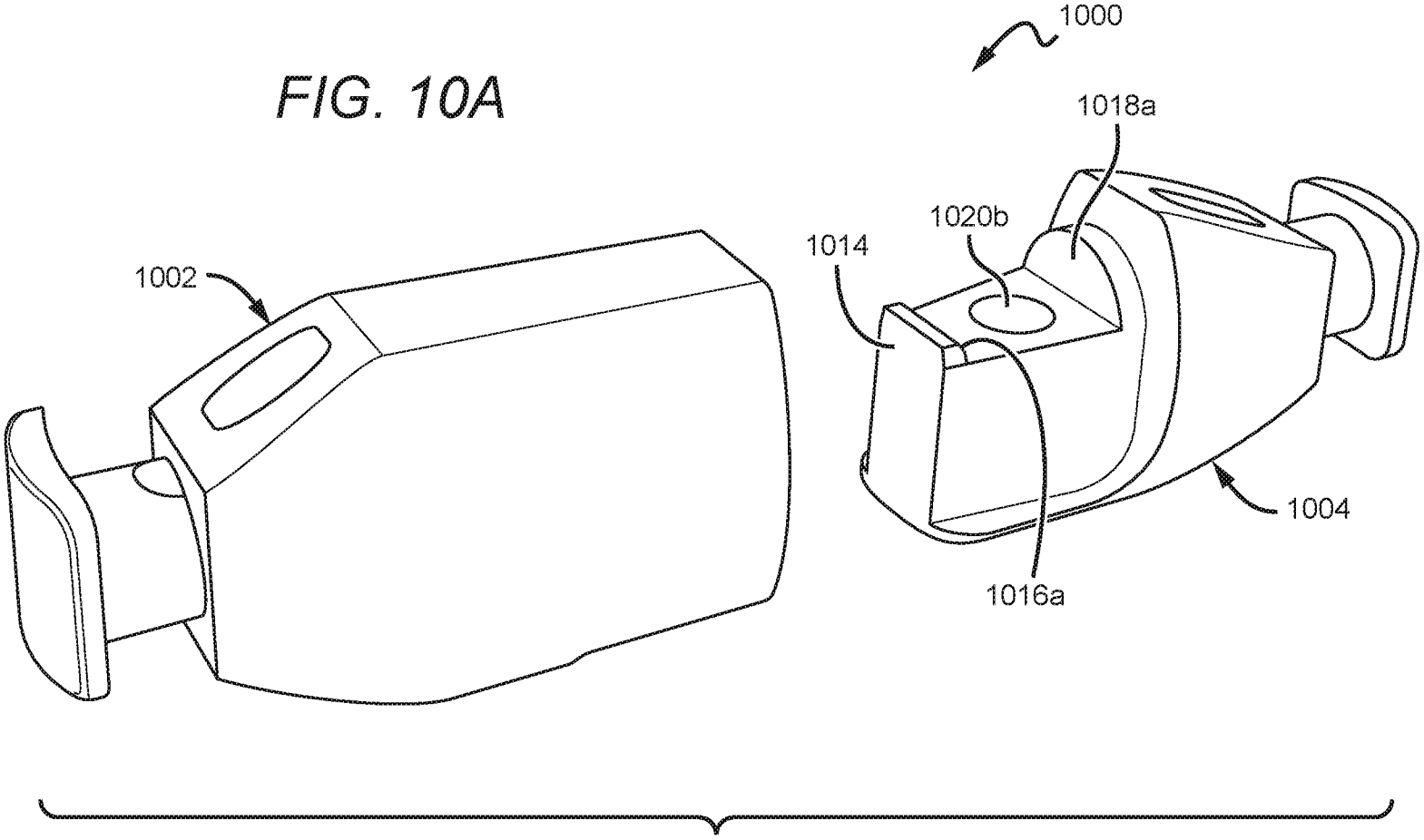
Figure 10B:
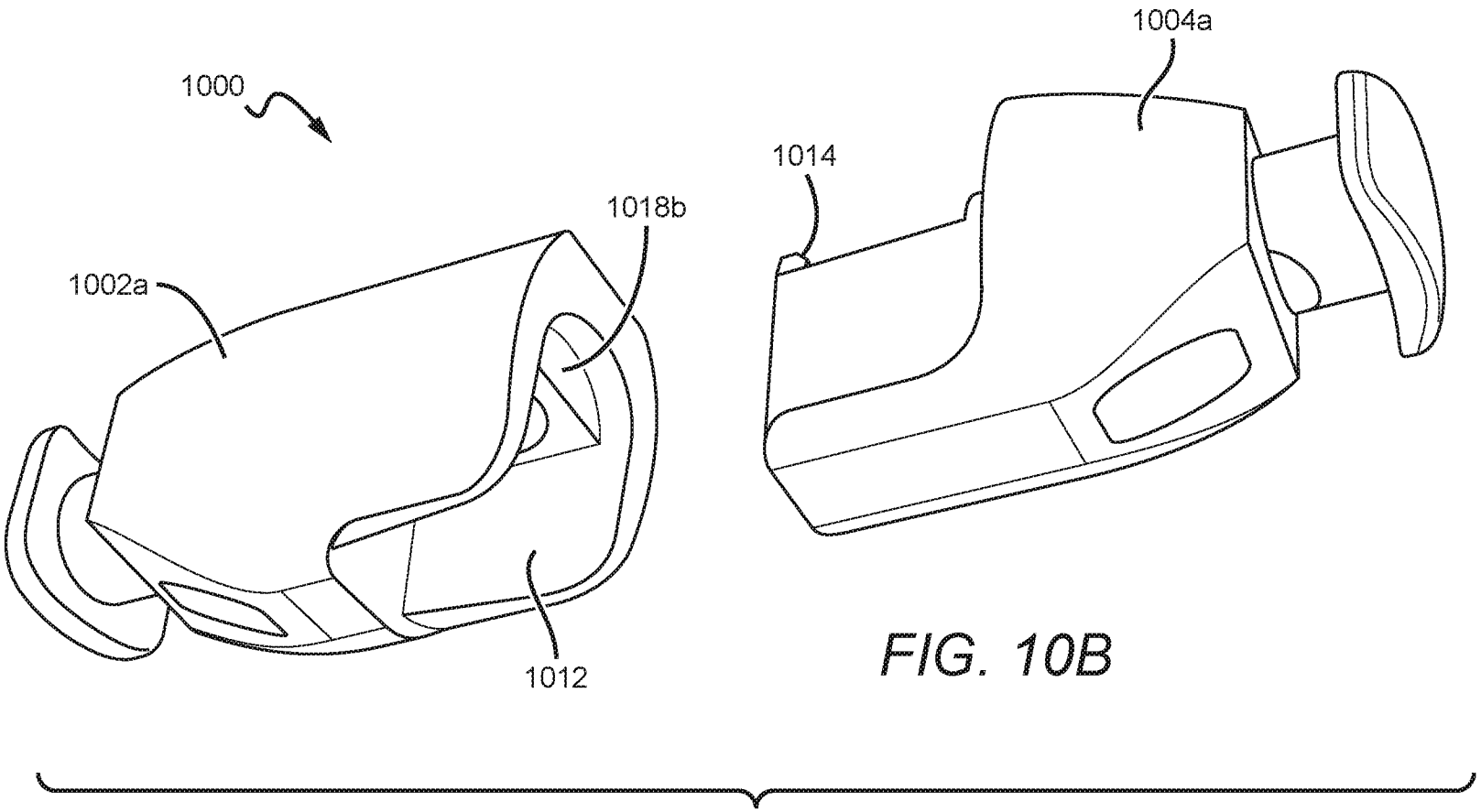
Figure 10C:
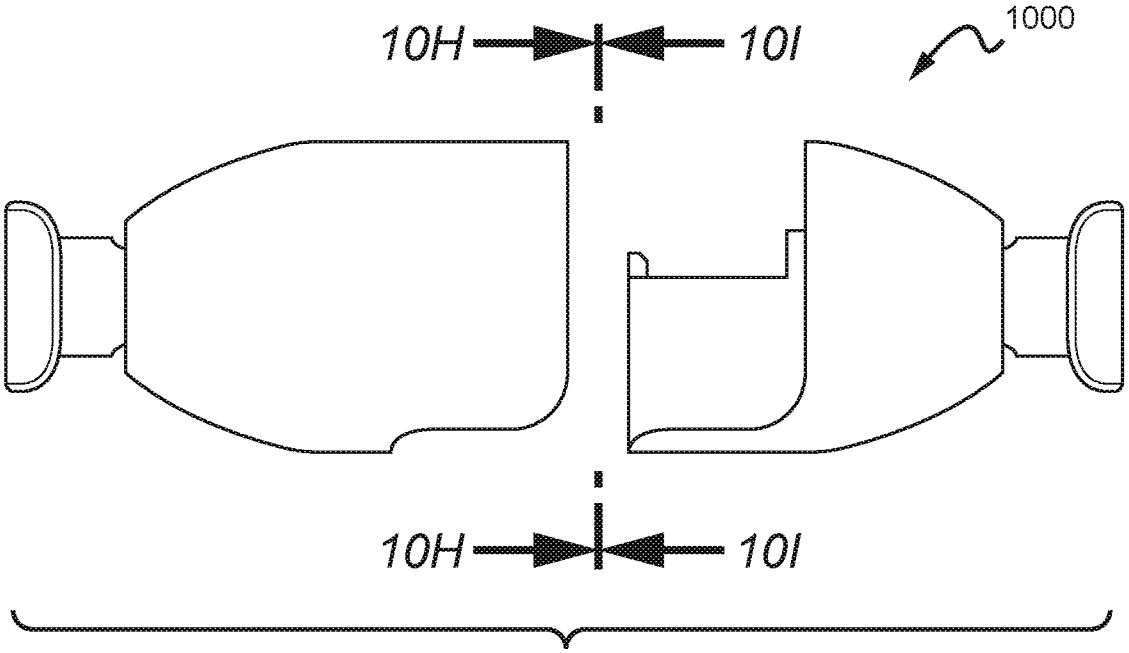

FIGS. 10A-10I show one embodiment of inner portions of a closure mechanism 1000 according to the present disclosure. The outer portions of the closure mechanism 1000 may be the same as or similar to the closure mechanism 900 from FIGS. 9A-9F, or may be different. In this embodiment and as best seen in FIG. 10B, the left closure mechanism portion 1002 includes a primary body 1002*a* and an indentation 1012, and the right closure mechanism portion 1004 includes a primary body 1004*a* and a protrusion 1014. It is understood that many different embodiments are possible, such as those where a left closure mechanism portion includes an indentation and a right closure mechanism portion includes a protrusion, or an embodiment that is a mirror image of that shown, are also possible.

Figure 10D:
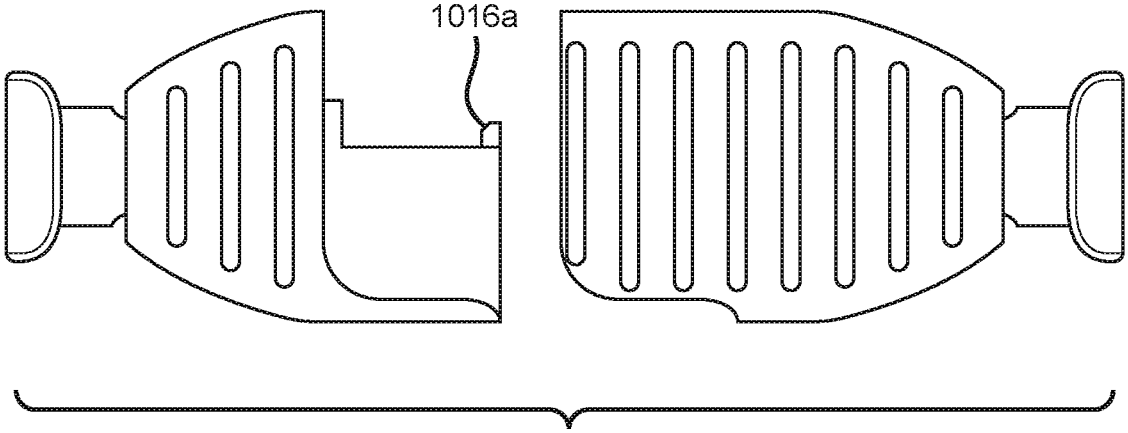
Figure 10F:
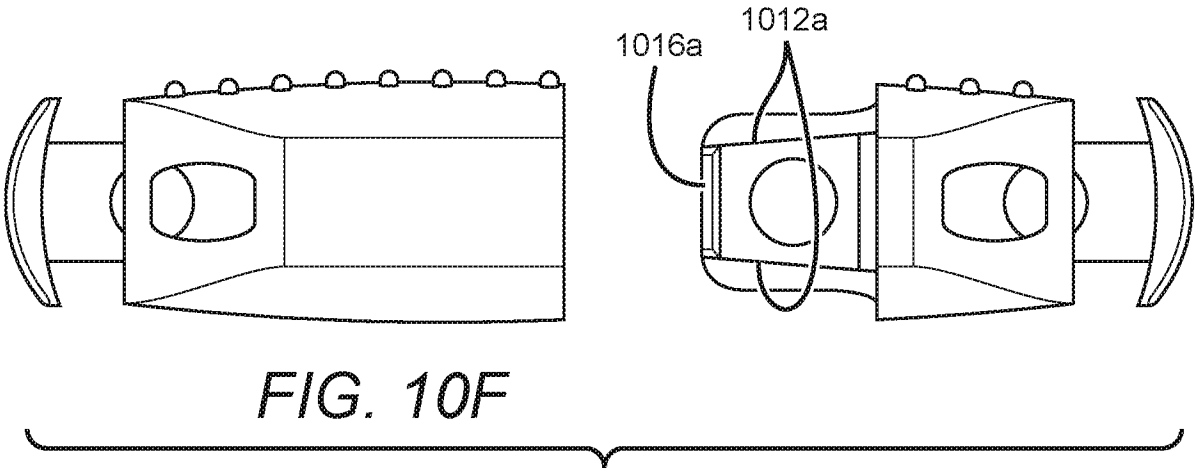
Figure 10G:
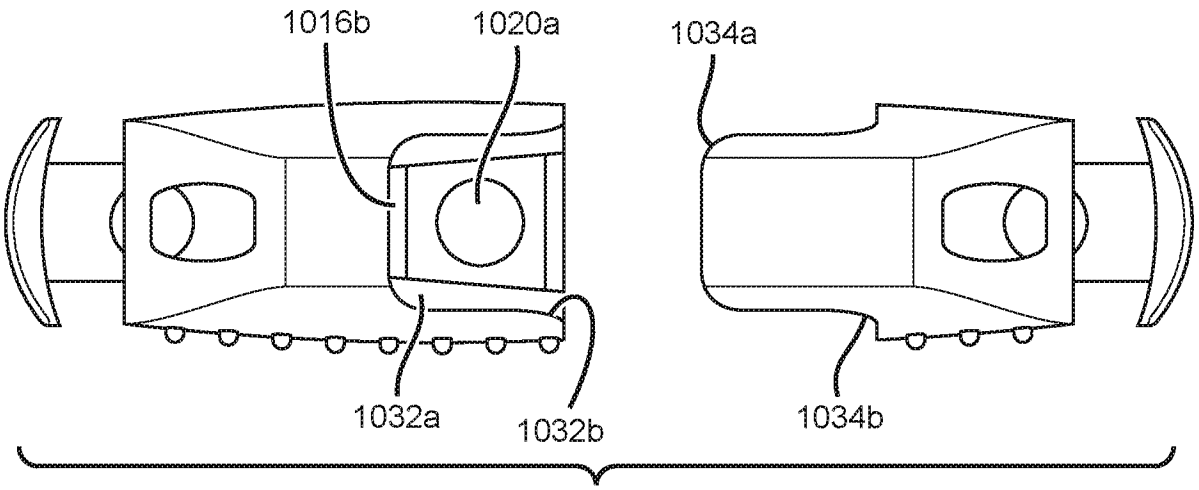

In other embodiments, magnets may be placed within the left and right closure mechanism portions 1002,1004, so as to secure the connection therebetween. It is understood that many different magnet configurations are possible. As shown in FIGS. 10A and 10G, a first magnet 1020*a* is placed in the indentation 1012 while a second magnet 1020*b* is placed in the protrusion 1014. The magnetic connection between the first and second magnets 1020*a*,1020*b* can enable the coming and staying together of the left and right closure mechanism portions 1002,1004 of the closure mechanism 1000. This connection may be strong enough so as to prevent disconnection due to, for example, gravity, jostling, unintentional contact with the closure mechanism, and other actions not intended to cause disconnection. While the magnets 1020*a*,1020*b* are shown as having a circular cross-section, it is understood that many different shapes including, but not limited to, regular or irregular polygon shapes are possible.

The closure mechanism 1000 may also be designed so as to enable easy connection between the left and right closure mechanism portions 1002,1004. For instance, the primary body of the left closure mechanism portion 1002 may include an outer protrusion 1032, and the primary body of the right closure mechanism portion 1004 may include an accompanying outer indentation, similar to the protrusion/indentation arrangement 902*a*,902*b*,904*a*,904*b* as shown in FIGS. 9A-9F. The protrusion and indentation may be shaped so as to enable easy connection of the left and right closure mechanism portions 1002,1004, which can also be aided by magnets 1020*a*,1020*b*. For example, the edges of the protrusion and indentation may be softened, such as by rounding the corners 1032*a*,1032*b*,1034*a*,1034*b*. Protrusions and indentations according to the present disclosure may be trapezoidal, oval-shaped, or a similar shape so as to enable an easier connection compared to that of rectangular pieces with hard corners. It is understood that the protrusions and indentations according to the present disclosure may have any number of different shapes. The protrusion 1012 and indentation 1014 may have a similar cross-section so as to further enable easy connection. Many embodiments are possible.

The protrusion 1012 may include a post 1016*a* and the indentation 1014 may include a post aperture 1016*b* (although it is understood that this may be reversed such that a protrusion is shaped to define a post aperture and an indentation is shaped to define a post). In the embodiment shown, the post 1016*a* is included at an outer end of the protrusion 1012 and the post aperture 1016*b* is included on an inner end of the indentation 1014. However, it is understood that these components may also be located elsewhere along the protrusion 1012 and indentation 1014, respectively. When the left closure mechanism portion 1002 and right closure mechanism portion 1004 are connected, the post 1016*a* and post aperture 1016*b* can mate. The arrangement of the post 1016*a* and post aperture 1016*b* can prevent or make difficult the disconnection of the left and right closure mechanism portions 1002,1004 via horizontal force. This can result in the prevention of unintentional disconnection of the left and right closure mechanism portions 1002,1004.

Posts according to the present disclosure, such as the post 1016*a*, may take many different shapes. Accordingly, post apertures such as the post aperture 1016*b* may take an accompanying shape. For example, the post 1016*a* includes a chamfer on its inner upper corner. Posts according to the present disclosure may include chamfers on the upper outer corner, which can increase ease of connection. Additionally, post corners may be tapered or curved inward to ease connection. For example, in the specific embodiment shown, the post 1016*a* includes sides that taper inward. Rounded shapes, such as rounded corners or fillets, may also be used instead of chamfers. It is understood that the present disclosure may include many different shapes.

Further, the cross-sectional plan view of protrusions such as the protrusion 1012 may also vary. For example, in the embodiment shown in FIG. 10F, the protrusion 1012 may include tapered sides 1012*a*, which can increase the ease of connectivity. In other embodiments according to the present disclosure, the protrusion 1012 may be, for example, rectangular. However, it is understood that embodiments according to the present disclosure may comprise many different shapes.

In the specific embodiment shown, the protrusion 1012 may also include a secondary post 1018*a* on its inner portion, which in this embodiment is connected to the primary body 1002*a*. The indentation may include a corresponding secondary post aperture 1018*b* adjacent the primary body 1004*a*. The secondary post and aperture 1018*a*, 1018*b* can serve to better secure the connection between the left and right closure mechanism portions 1002,1004, such as by prevention of disconnection via twisting of the closure mechanism 1000. It is understood that other embodiments of the present disclosure may or may not include the secondary post and aperture 1018*a*,1018*b* or similar features.

In other embodiments, one or more posts may be included in the indentation 1014 and one or more post apertures may be included in the protrusion 1012, or vice versa. Furthermore, while the post 1016*a* is shown as rectangular and including a chamfer on its corner, many different shapes are possible. For example, rounded post shapes or a post shape with outward angles can result in easier disconnection for the user, whereas a post shape including 90° corners or inward angles can result in a more secure connection. Zig-zag or sawtooth connections are also possible. Many different mating configurations are possible according to the present disclosure, and the above examples are in no way limiting.

In other embodiments of the present disclosure, a magnet may also serve as a post, such as a post that can prevent or make difficult horizontal disconnection of left and right closure mechanism portions. In one embodiment, the magnets 1020*a*,1020*b* are flush with the top surface of the protrusion 1012 and the bottom surface of the indentation 1014 as shown in FIGS. 10A-10F, and do not serve as posts or to define post apertures. In another embodiment of a closure mechanism according the present disclosure, the magnets may serve as mating members for connection of the left and right closure mechanism portions. For example, a magnet may protrude from another portion of the clip, and a corresponding aperture in the opposing clip portion may include a magnet at its bottom, so as to form a post/aperture magnet connection. Such a configuration may replace or be used in conjunction with the other post/aperture configurations described above.

Closure mechanism portions such as the left and right closure mechanism portions 1002,1004 may be designed to be disconnected in any number of ways. For example, the closure mechanism portions 1002,1004 are designed to make difficult detachment via horizontal force, but designed such that detachment via vertical force is comparatively much easier. As another example, the closure mechanism portions 1002,1004 and the inner portions thereof may also be designed such that detachment via downward force on the middle of the closure mechanism 1000 or via upward force on the left and right portions (as shown in FIG. 10D) of the closure mechanism 1000 is relatively difficult, while detachment via downward force on the left and right portions is comparatively easier. This design is efficient in that loads upon the closure mechanism 1000 when a user is wearing a pillow including such a mechanism may be downward on a center of the mechanism—a load which may be less likely to cause disengagement of the closure mechanism portions 1002,1004; and, the loading of the closure mechanism which may be more likely to cause disengagement—i.e., a downward force on both the left and right portions—typically will not be experienced unless a user specifically applies such a load with his or her hands. Such a design can lessen the likelihood of unintentional detachment of the closure mechanism portions 1002,1004. The various components of closure mechanisms such as outer indentations and protrusions (e.g. outer indentations 902*b*,904*b* and outer protrusions 902*a*,904*a*), inner indentations and protrusions, posts and post apertures, and other components, can be designed with different disengagement mechanisms in mind (such as, for example, the disengagement mechanism described above where disengagement via downward force on the left and right portions of the closure mechanism is encouraged). Other embodiments, such as closure mechanisms where vertical force is made more difficult and horizontal force provides easier disconnection are also possible.

Additionally, closure mechanism portions 1002,1004 can be disconnected via force applied to connectors such as drawstring halves which are connected to the closure mechanism 1000. For example, when the closure mechanism 1000 is placed in the same position as the closure mechanism 112 in FIG. 1, the closure mechanism portions 1002,1004 can be separated via a horizontal force (or a combination of vertical and horizontal force) applied to the portions of the drawstring halves 106*a*,106*b* which are below the closure mechanism. Many different embodiments are possible.

While some of the above specific embodiments have included magnets, other closure mechanisms are also possible, including but not limited to snap closure mechanisms which may include a release button, button closure mechanisms, loop closure mechanisms, and other types of mechanical and nonmechanical closure mechanisms. Many different embodiments are possible as would be understood by one of skill in the art.

Pillows according to the present disclosure may include various different styles of anchoring systems, many of which can allow for user customization to allow for a better fit. These anchoring systems may be used with connectors, such as drawstrings, and a closure mechanism or similar; some examples of these elements and systems have been described above. These anchoring systems may use many of the same or similar components to those described above, including but not limited to components described or shown with relation to FIGS. 8A-10I, components described with or shown with relation to other figures above, variants of any of these components, components known in the art, or other components not shown or described. FIGS. 11A-11C show a top perspective view of one embodiment of a pillow according to the present disclosure which includes a variable anchoring system, with each of the figures showing a different configuration. The travel pillow 1100 may include multiple attachment openings and/or anchor points on each side. For simplicity these will be referred to as "anchor points"; it is understood that these anchor points may be attached on the outside of the pillow 1100, may be attached in a manner such as that described above with FIGS. 8A-8C, may or may not utilize anchor components, or otherwise may be attached to the pillow 1100 in any manner. As with all figures shown in the present application, it is understood that the devices shown may be symmetric; when a figure is shown from one side, the view from the other side may be a mirror image. As such, while the right side of the pillow 1100 is shown in FIGS. 11A-11C, it is understood that the left side of the pillow (not shown) may be a mirror image thereof.

In the specific embodiment shown, the travel pillow includes three anchor points 1102,1104,1106 where a drawstring half 1108 may exit or be attached to the body 1110 of the pillow 1100 (or a component thereof, such as an outer cushion, cover, etc.). It is understood that embodiments according to the present disclosure may include any number of attachment openings and/or anchor points, for example one, two or four, or even more. The drawstring half 1108 may be detachable from the pillow body 1110, and can be reattached so as to have the same or a different anchor point. The pillow 1100 may be designed such that attachment of the drawstring to bottom- and/or forward-most anchor point 1102 (as shown in FIG. 11A) accommodates larger neck sizes; attachment to the top- and rear-most anchor point 1106 (as shown in FIG. 11C) better accommodates smaller neck sizes, and to an intermediate anchor point 1104 (as shown in FIG. 11B) better accommodates medium neck sizes. Once anchored to the desired positions, a closure mechanism such as the closure mechanism 1112 can be pulled up the drawstring halves and tightened for user comfort.

The anchor points 1102,1104,1106 are shown in FIGS. 11A-11C in a pattern such that the rearmost anchor point 1106 is also the highest, and the forwardmost 1102 anchor point is also the lowest. However, it is understood that for all embodiments shown and described herein including but not limited to those of FIGS. 11A-15, 17A-18C, and 20A-B, other embodiments may have different arrangements of anchor point locations and/or a different number of anchor points. For example, in some embodiments anchor points might be all around same height, or go upward as they go forward on the pillow. In yet other embodiments, there may be a different number of anchor points, such as one anchor point, two anchor points, three anchor points, or more.

Other embodiments including user adjustable anchor systems are also possible. FIG. 12 is a top perspective view of another embodiment of a pillow 1200 according to the present disclosure. This embodiment includes a first anchor point 1206 where a drawstring 1202 or similar mechanism is meets the pillow body 1204 or a component thereof (referred to herein as a "primary anchor point"). The drawstring half 1202 may be attached to the pillow body 1204 at the primary anchor point or elsewhere, and may be attached in any manner including but not limited to those described above, and may be removably attached, although other embodiments are possible.

The pillow 1200 also includes a secondary anchor point 1208 which can provide for user adjustability. While other embodiments are possible, in the embodiment of FIG. 12 the secondary anchor point takes the form of a molded hook, although other hook and non-hook secondary anchor points are possible. A user can choose to engage the secondary anchor point 1208 with the drawstring half 1202, such as by wrapping the drawstring half 1202 around the hook as shown in FIG. 12. By doing so, the maximum tightening position for a closure mechanism such as the closure mechanism 1212 will be higher and more rearward, typically for fitting smaller neck sizes (when the secondary anchor points are engaged, the "secondary maximum tightening position"). If the user chooses not to engage the secondary anchor point 1208, then the maximum tightening position for the closure mechanism 1212 (when no secondary anchor points are engaged, the "primary maximum tightening position") will be lower and more forward, typically for fitting larger neck sizes. In the specific embodiment shown the primary anchor point is below and forward of the secondary anchor point, although it is understood that as with FIGS. 11A-11C, many different anchor point arrangements are possible. The primary anchor point could be above and rearward of the secondary anchor point. The primary and secondary anchor points could be at the same height. The primary and secondary anchor points could be vertically aligned with one another. Many different embodiments are possible.

Further, while the embodiment of FIG. 12 shows only one primary anchor point 1206 and one secondary anchor point 1208 per side of the pillow 1200, many different embodiments are possible, and any number of possible primary and secondary anchor points are possible. In one embodiment, the primary and secondary anchor points may be swapped with one another based on user preference, similar to the system shown in FIGS. 11A-11C. In another embodiment, there are two primary anchor points where a drawstring half meets the body of the pillow, with either no or one or more secondary anchor points. Many different combinations are possible. Many different embodiments are possible.

As with all embodiments herein, the pillow 1200 may also include a cover. In the specific embodiment shown, the pillow 1200 includes a cover 1205. As shown in this embodiment, the secondary anchor point 1208 is accessible from outside the cover 1205 such that a user can engage it without removal of the cover 1205. One example of attachment of a connector within the cover 1205 is shown with regard to FIGS. 8A-8C. Other embodiments are also possible. For example, connectors according to the present disclosure may be attached outside a cover, between a cushion and cover, between an internal frame and a cushion, or may go through an internal frame and be connected at an inside surface of the internal frame or cushion. Any combination of these different connection methods is possible. Many different embodiments are possible as would be understood by one of skill in the art.

Forces applied to connectors such as drawstring halves may in some instances cause force upon a pillow that could cause damage to the pillow body, such as tearing or ripping. Embodiments of the present disclosure may also include reinforcement mechanisms such as a reinforcement mechanism 1210 which can prevent ripping or other damage which may be caused by the forces upon the secondary anchor point 1208. In the embodiment shown the reinforcement mechanism 1210 wraps around a top surface of the pillow 1200, although many different embodiments are possible. Such reinforcement mechanisms may also be utilized around primary anchor points.

Figure 13:
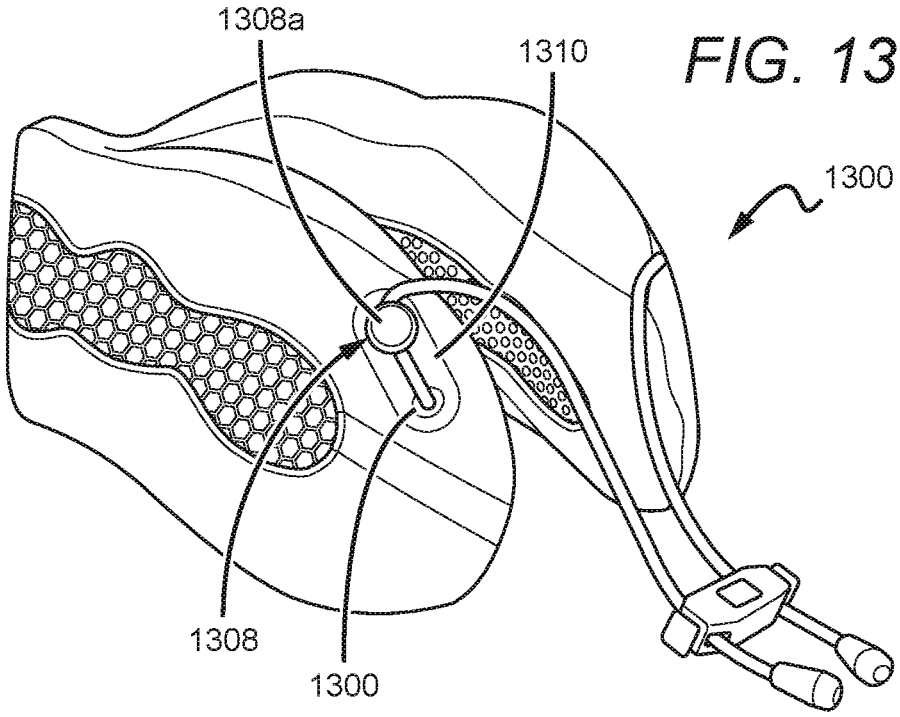
FIG. 13 shows a top perspective view of another embodiment of a pillow according to the present disclosure.

Reinforcement mechanisms according to the present disclosure may also be used in between anchor points. FIG. 13 shows a pillow 1300 with primary and secondary anchor points 1306,1308, placed similarly to the anchor points shown in FIG. 12. The pillow 1300 includes a reinforcement mechanism 1310 between and connecting the two anchor points. This type of arrangement can help to prevent bunching of pillow material between these two points which might otherwise occur when a user pulled on the drawstring halves, causing a force on the secondary anchor point biasing the secondary anchor point toward the primary anchor point. A reinforcement mechanism such as the reinforcement mechanism 1310 between and connecting the two anchor points can prevent or reduce such bunching. It is understood that the reinforcement mechanisms described herein may be used alone as replacements for one another, or may be used in combination with one another.

The pillow 1300 also utilizes a different style of secondary anchor point than the secondary anchor point 1208 from FIG. 12. In this embodiment a molded "rivet" hook which may be similar to a button in function is utilized as secondary anchor point 1308. A user can place the drawstring half around the smaller diameter of the rivet hook (not shown) beneath the larger diameter 1308*a*, the larger diameter 1308*a* aiding in preventing the drawstring from disengaging from the secondary anchor point 1308.

Figure 14:
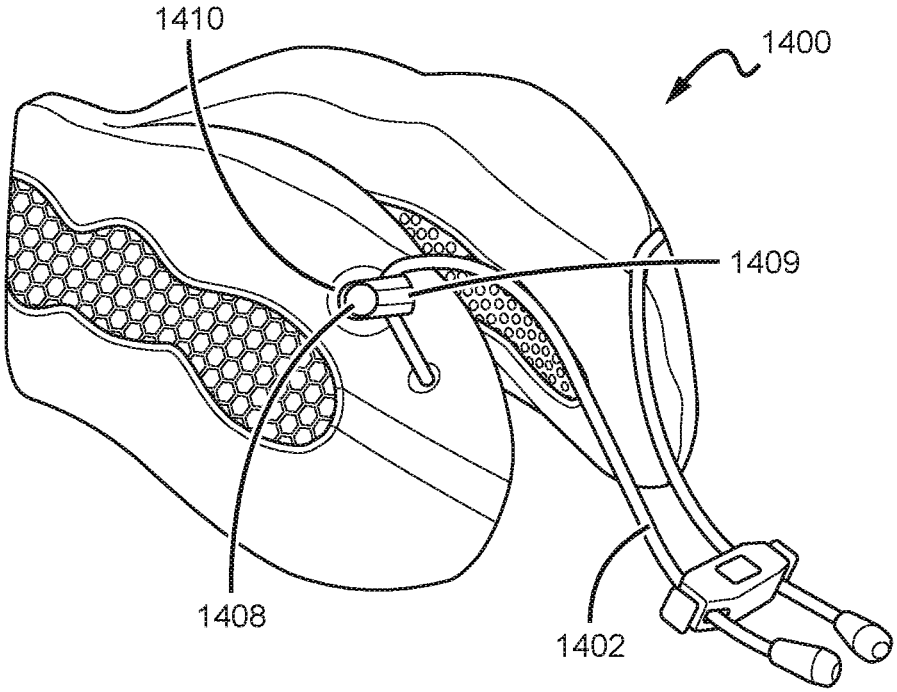
FIG. 14 shows a top perspective view of another embodiment of a pillow according to the present disclosure.

FIG. 14 is a top perspective view of another embodiment of a pillow 1400 according to the present disclosure. The pillow 1400 may include a secondary anchor point 1408 that utilizes a "snap-hook" system. When the snap-hook 1409 is disengaged, the secondary anchor point 1408 is open such that a user can place the drawstring half 1402 into the area of the secondary anchor point 1408 and the snap-hook 1409 can be engaged around the drawstring half 1402, thus anchoring the drawstring half 1402 to the secondary anchor point 1408. This type of anchor point can be more secure than certain others in that it requires disengagement of a snap or similar system prior to removal of the drawstring half 1402 from the secondary anchor point 1408, and thus can prevent or lessen the likelihood of the drawstring half 1402 from disengaging from the secondary anchor point 1408 unintentionally. The pillow 1400 may also include reinforcement, such as reinforcement 1410 specifically around the secondary anchor point 1408.

Figure 15:
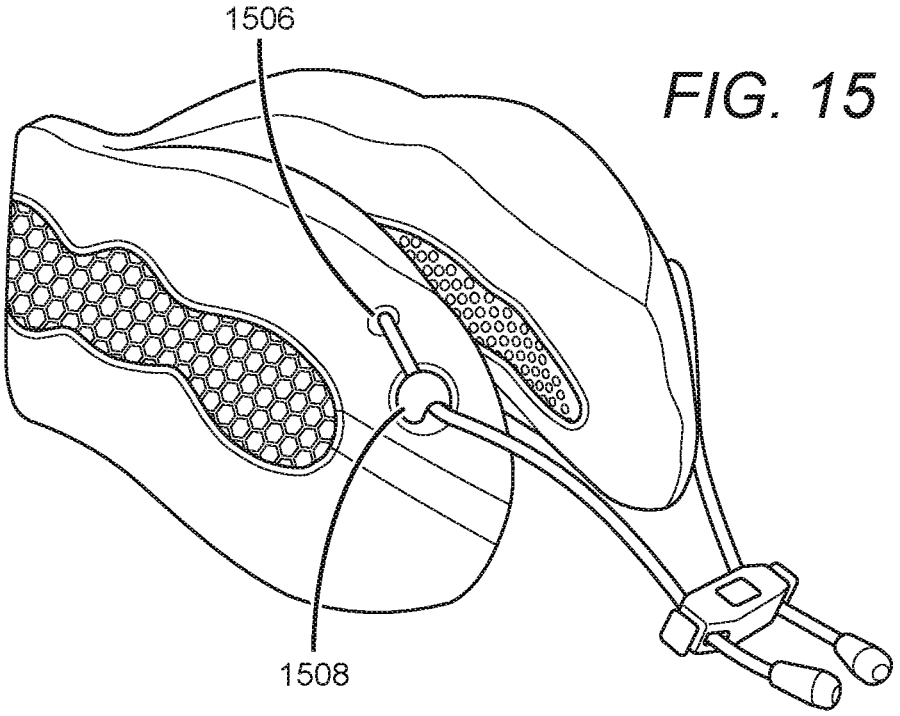
FIG. 15 shows a top perspective view of another embodiment of a pillow according to the present disclosure.

FIG. 15 shows another pillow 1500 which may utilize an anchoring system for user customization. The pillow 1500 includes primary and secondary anchor points 1506,1508 with the secondary anchor point 1508 lower and forward of the primary anchor point 1506. Thus, utilization of the secondary anchor point 1508 typically accommodates larger neck sizes and has a maximum tightening position further away from a user, while not engaging the secondary anchor point 1508 typically accommodates comparatively smaller neck sizes and has a maximum tightening position closer to the user. This arrangement can help to prevent bunching in that instead of a forward force being applied to the rearward anchor point when a user pulls upon the drawstring halves, causing it the rearward anchor point to be pulled toward the forward anchor point, the force will at least partially pull forward on the forward anchor point. Thus, bunching between the rearward anchor point (here the primary anchor point 1506) and the forward anchor point (here the secondary anchor point 1508) can be reduced or prevented. As opposed to other embodiments described above where engaging the secondary anchor assists in fitting comparatively smaller neck sizes, here engagement of the secondary anchor 1508 assists in fitting comparatively larger neck sizes since the maximum tightening position is further away from the user. The secondary anchor point in this embodiment includes a hook similar to that shown in FIG. 12, but any anchor style is possible.

Figure 16:
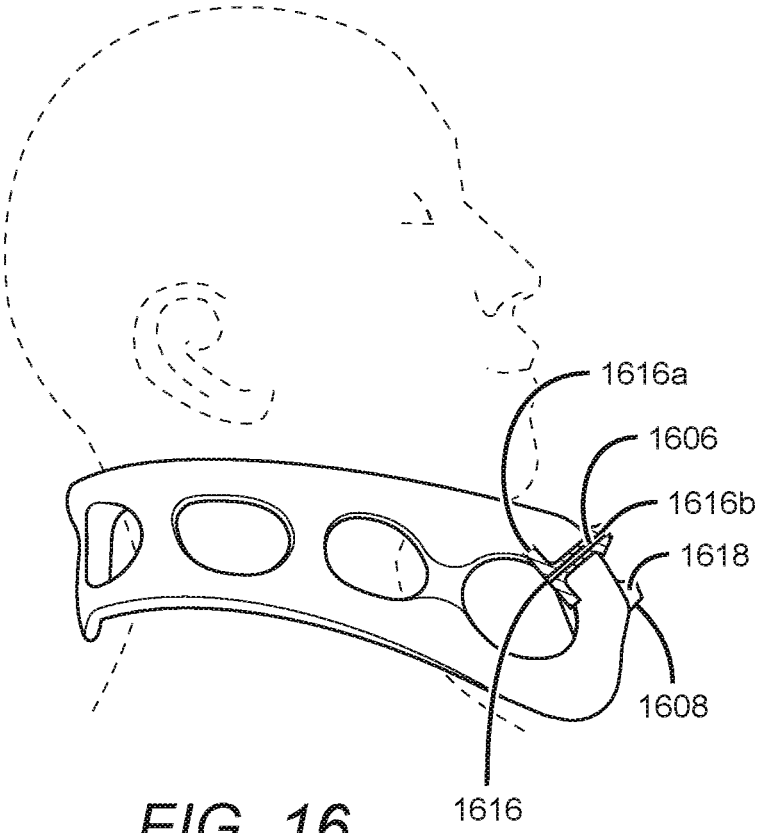
FIG. 16 shows a right side view of another embodiment of an inner frame according to the present disclosure.

FIG. 16 shows a schematic of embodiment of an inner frame 1600 which could be utilized with any pillow anchoring system described herein. Either or both of the anchor points 1606,1608 could serve as a primary anchor point. In the embodiment shown, both of the anchor points 1606,1608 include a respective anchor component 1616,1618 which is placed through the body 1602 of the inner frame 1600. While the anchor component 1616 is specifically discussed below, it is understood that these concepts may apply equally to the anchor component 1618 and other anchor components. Other embodiments where neither or some of the anchor components reach through the inner frame body are possible. In one specific embodiment of an anchor arrangement with an inner frame and outer cushion, the anchor base 1616*a* is available on the backside of an outer cushion, while the anchor protrusion 1616*b* reaches through the back portion of the outer cushion and through the inner frame, similar to how the anchor protrusion 1616*b* reaches through the inner frame 1600. The outer cushion may be shaped to define a drawstring aperture to provide access to the anchor protrusion 1616*b*. In other embodiments an anchor protrusion may not reach through all or any of the inner frame, and as such the inner frame may also be shaped to define a drawstring aperture. In yet other embodiments, an anchor protrusion may not be present, and a drawstring aperture may reach through the outer cushion, the inner frame, and then the outer cushion again in order to provide access to the anchor component, such as an anchor base. Embodiments where all, some, or none of the anchor points include anchoring components through the body of an outer cushion, inner frame, and/or through a cover over the outer cushion are also possible. If through a cover, the cover may include apertures therein through which connector portions such as drawstring portions may pass. These cover apertures may be placed displaced from a seam in the cover to avoid cover ripping. In some embodiments these apertures are 0.25 inch or more away from the nearest seam, and in a specific embodiment 0.5 inch or more away from the nearest seam, and in yet a further specific embodiment 1.0 inch or more away from the nearest seam.

Figure 17C:
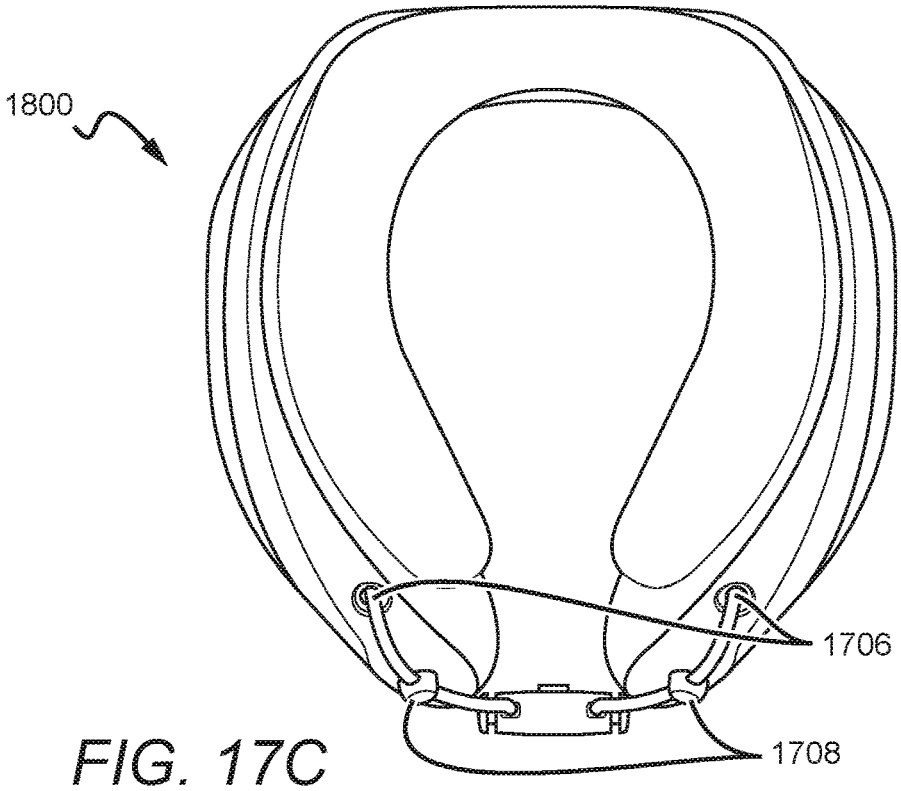

FIGS. 17A-17C show another embodiment of a pillow 1700 according to the present disclosure similar in nature to the pillow 1500, but without a cover over the remainder of the pillow (although a cover may be used in conjunction with this embodiment). In FIG. 17B, the outer cushion 1702 is shown as transparent for the purpose of better showing the inner frame 1704 within the outer cushion 1704. The primary anchor point 1706 in this embodiment is placed higher and rearward of the secondary anchor point 1708, although variants are possible. Anchor points according to the present disclosure, whether primary or secondary in nature, may be placed so as to be above or at approximately the same height as the bottom of chin supports such as the chin supports 1710, and may be placed to be below or at approximately the same height as the top of an indented area or aperture, such as the indented area 1712 and the forwardmost aperture 1714. The distance between anchor points may vary greatly. In some embodiments, the distance may between two anchor points, such as a primary anchor point and a secondary anchor point, may be between 0.5 inch and 4 inches, and in a specific embodiment between 1 inch and 2.5 inches, and in an even further specific embodiment approximately 1.75 inches. In some embodiments, this distance is greater than 0.5 inch, and in a further specific embodiment greater than 1 inch. In one embodiment this distance is less than 4 inches, and in a specific embodiment thereof less than 2.5 inches. Many different embodiments are possible.

As best shown in FIG. 17C, in this specific embodiment the secondary anchor points 1708, in addition to being forward and below the primary anchor points 1706 as best seen in FIGS. 17A and 17B, are inward of the primary anchor points 1706. It is understood that in other embodiments, the secondary anchor points 1708 may be outside the primary anchor points 1706, or the primary and secondary anchor points 1706,1708 may be swapped. In one embodiment one of the primary and secondary anchor points is placed directly above the other. Any combination of vertical placement (above or below), forward/rearward placement, and inward/outward placement, whether with two anchoring points or more, is possible and within the scope of the present disclosure, and may be applied to any of the embodiments described herein.

Figure 18A:
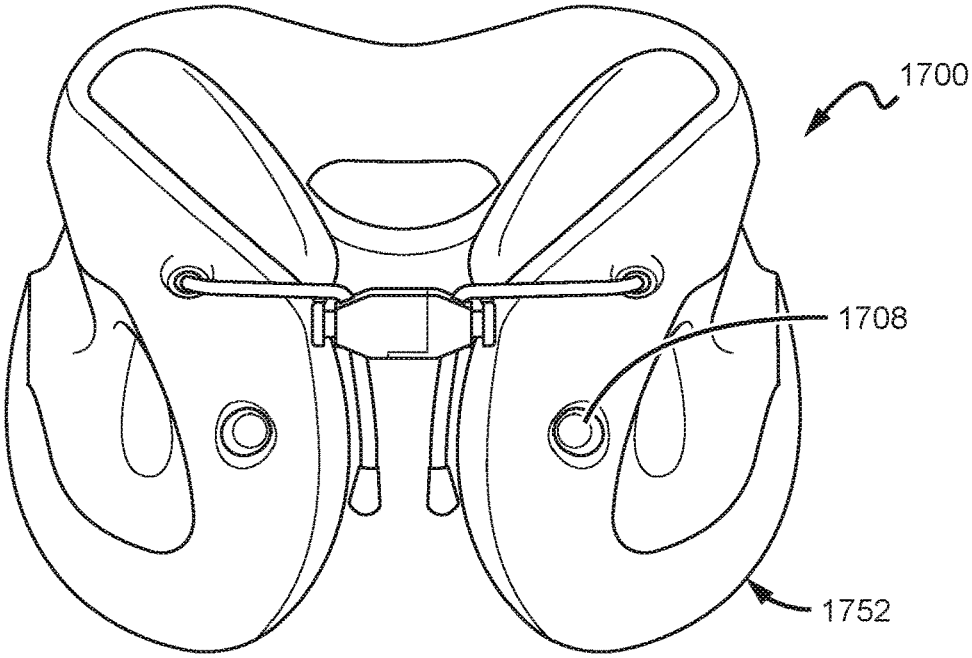

FIGS. 18A-18C are top perspective views of the pillow 1700 in three different configurations 1752,1754,1756. FIG. 18A (configuration 1752) and 18B (configuration 1754), respectively, show the small neck (no engagement of secondary anchor points 1708) and large neck settings (engagement of secondary anchor points 1708) previously described. The use of primary and secondary anchor points such as the primary anchors 1706 and the secondary anchor points 1708 also enables a third configuration for providing support to a user's head or neck. In the third configuration 1706, the drawstring half 1760*a* attached to the primary anchor point 1706*a* is then engaged with the secondary anchor point 1708*b* on the opposite side portion of the pillow 1700. Similarly, the drawstring half 1760*b* attached to the primary anchor point 1706*b* is then engaged with the secondary anchor point 1708*a*. This configuration provides excellent support to a user's head and neck in that tightening of the closure mechanism 1770 results in the side portions of the pillow coming together from two different sets of anchor points—the primary anchor points 1706*a*,1706*b* come together with one another, and the secondary anchor points 1708*a*,1708*b* also come together with one another. This results in a stronger connection between the pillow side portions, and results in more material being beneath a user's jaw to support it, providing vertical support. This setting can be particularly useful for long but narrow necks. However, it is understood that any number of different embodiments according to the present disclosure may comprise any number of different arrangements to accommodate any number of different supportive settings.

Figure 19C:
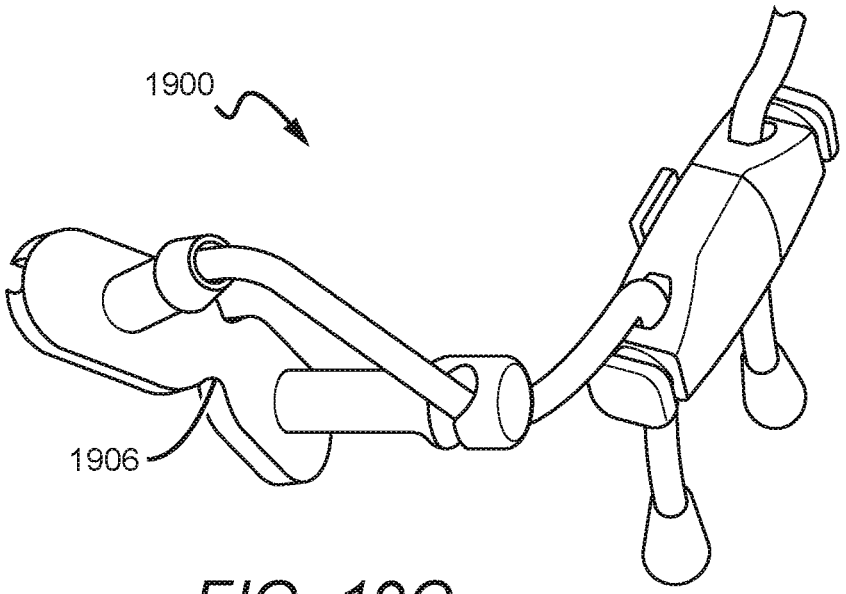

Some embodiments of the present disclosure, such as embodiments including primary and secondary anchor points, may utilize double-anchor mechanisms, where the anchor mechanisms used at two different anchoring points are combined into a single mechanism. FIGS. 19A-19C show various views of a double-anchor mechanism 1900 according to the present disclosure. Each of the single-anchor components 1902,1904 of the double-anchor mechanism 1900 may be similar to or the same as the anchor mechanism 800 shown in FIGS. 8A-8C, or may be a different style of anchor component. The two single-anchor components 1902,1904 may be joined at a double-anchor junction 1906. Use of a double-anchor mechanism such as the double-anchor mechanism 1900 can assist in preventing bunching of pillow material, as the two single-anchor components 1902,1904 will be prevented or discouraged from moving toward one another. Additionally, the single-anchor components 1902,1904 may share a single base, or may each include its own base 1952 (as shown in the embodiment of FIGS. 19A-19C). "Double-base" embodiments, i.e., embodiments where each single-anchor component includes its own base, can be advantageous in that the likelihood of pivoting or other types of movement of the double-anchor mechanism 1900 when loads are applied to both single-anchor components 1902,1904 may be reduced compared to single-base embodiments. Single-base embodiments, on the other hand, may result in the use of less material and thus be less costly, and may also be easier to install. Many different embodiments with different advantages are possible.

As with single-anchor mechanisms, each of the single-anchor components 1902,1904 may include an anchor base 1952 and a protrusion 1954 such as a tube which may include a larger diameter on the end to prevent accidental disengagement with an aperture. A connector such as a drawstring half 1960 may include a stop 1962 which can engage or nest with an anchor base or an anchor base backside such as the anchor base backside 1952*a*, which may be shaped to receive the stop 1962.

The single-anchor components of a double-anchor mechanism, such as the single-anchor components 1902, 1904 of the double-anchor mechanism 1900, may be connected at any desired angle in order to meet the design of the remainder of the pillow in which they are to be used. For example, single-anchor components may be connected at an angle between 0° (in line with one another) and 90° (at a right angle to one another); in a further specific embodiment between 0° and 60°; and in an even further specific embodiment at an angle between 0° and 45°. In yet another embodiment the single-anchor components may be connected at an angle between 0° and 30°; in a further specific embodiment at an angle between 0° and 15°; and in yet a further specific embodiment at an angle between 0° and 7.5°. Additionally, while the double-anchor mechanism 1900 includes untwisted single-anchor components 1902,1904, double-anchor mechanisms according to the present disclosure may be twisted with respect to one another. Many different embodiments are possible.

Further, the type of connection between single-anchor components such as the single-anchor components 1902, 1904 may vary. In one embodiment, the double-anchor junction 1906 is rigid such that the single-anchor components 1902,1904 are prevented from moving with respect to one another, which provides the strongest prevention against bunching. Double-anchor mechanisms with a movable double-anchor junction are also possible. In another embodiment, the double-anchor junction 1906 is able to rotate in one or more planes such that the single-anchor components 1902,1904 can rotate with respect to one another, which can keep the single-anchor components at an approximately equal distance from one another and can lessen the chance of breakage of the double-anchor junction. Many different embodiments are possible, and the above examples are in no way limiting. Further, it is understood that while only a double-anchor mechanism 1900 is shown, mechanisms including three or more anchors are also possible. Further, while the double-anchor mechanism shows a primary anchor 1902 and a secondary anchor 1904, it is understood that any primary/secondary anchor combination is possible. The use of single anchors for some or all anchor points is also possible.

Figure 20B:
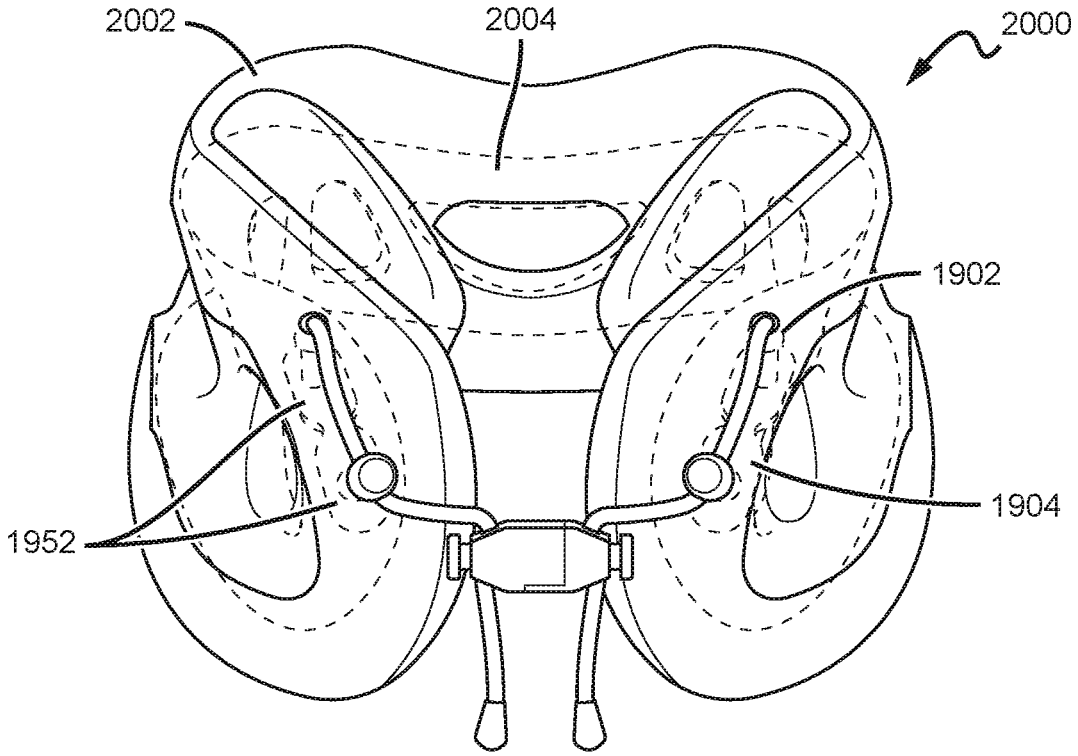
FIGS. 20A and 20B show top perspective and front views of another embodiment of a pillow according to the present disclosure.
Figure 20A:
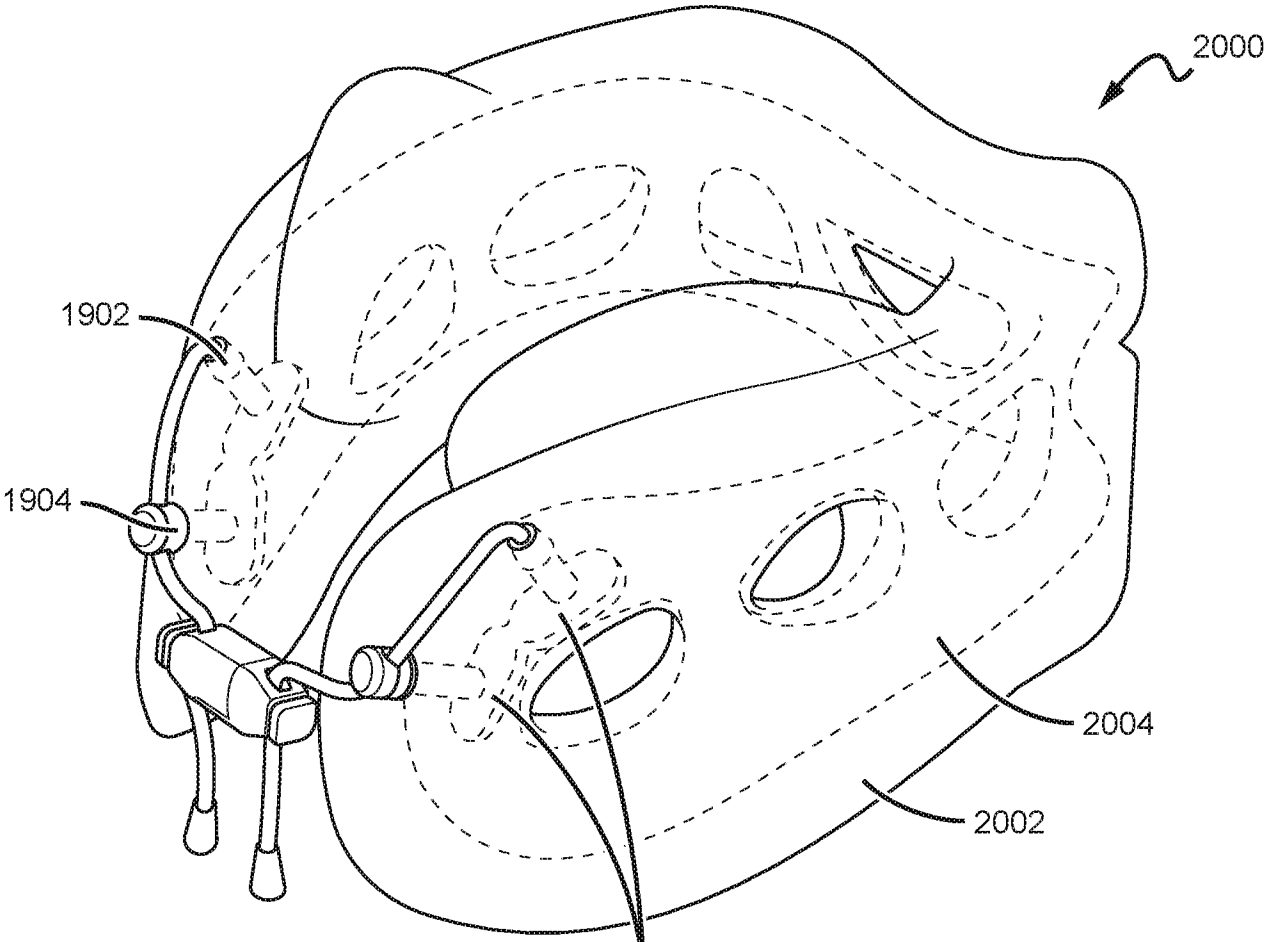

FIGS. 20A and 20B show one embodiment of a pillow 2000 according to the present disclosure, the pillow 2000 including two double-anchor mechanisms 1900. Double-anchor mechanisms according to the present disclosure may be mounted to the body of a pillow in any number of manners. In the specific embodiment shown, the double-anchor mechanisms 1900 are mounted on the pillow body such that the double-anchor bases 1952 are on a backside of the outer cushion 2002. The double-anchor protrusions 1954 go at least partially into the outer cushion 2002, and in some embodiments go at least partially and in some instances fully through the inner frame 2004. In some embodiments of the present disclosure, the double-anchor protrusions 1954 may extend all the way through both the outer cushion 2002 and inner frame 2004 so as to protrude out of the outer cushion 2002. The outer cushion 2002 and/or inner frame 2004 may be shaped to define one or more drawstring apertures in order to provide access to anchor mechanisms or components. It is understood that these same concepts may apply to single anchor mechanisms and to anchor mechanisms including three or more anchor components. Further, the removal of the drawstring halves from the double-anchor mechanism may operate in a manner similar to that described above with regard to FIGS. 8A-8C, thus enabling removal of the drawstring and the cover. Many different embodiments are possible.

Various embodiments of pillows, cushions, head and neck supports, and portions thereof, clips or closure mechanisms, and other components available for use with pillows and components thereof according to the present disclosure are shown and described in U.S. Prov. Pat. App. No. 61/951,421, filed on Mar. 11, 2014; U.S. patent application Ser. No. 14/518,719, filed on Oct. 20, 2014; U.S. Des. patent application Ser. No. 29/506,788 (now U.S. Des. Pat. No. D762,400), filed on Oct. 20, 2014; PCT Pat. App. No. US2015/020038, filed on Mar. 11, 2015; U.S. Prov. Pat. App. No. 62/234,593, filed on Sep. 29, 2015; U.S. Des. patent application Ser. No. 29/540,977, filed on Sep. 29, 2015; U.S. Des. patent application Ser. No. 29/540,981, filed on Sep. 29, 2015; U.S. Des. patent application Ser. No. 29/568,003, filed on Jun. 14, 2016; U.S. Prov. Pat. App. No. 62/377,494, filed on Aug. 19, 2016; and U.S. patent application Ser. No. 15/125,095, filed on Sep. 9, 2016. Each of these applications is commonly assigned with the present application, and each of these applications is fully incorporated by reference herein in its entirety.

Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to other products and systems other than neck or travel pillows.

We claim:

1. A pillow for supporting a user's head or neck, the pillow shaped to define a pillow left side portion, a pillow right side portion, and a pillow rear portion, said pillow comprising:

a generally U-shaped cushion, said cushion comprising a cushion left side portion, a cushion right side portion, and a cushion rear portion;

wherein said cushion left side portion comprises a cushion left forward portion, a left primary anchor point, and a left secondary anchor point;

wherein said cushion right side portion comprises a cushion right forward portion, a right primary anchor point, and a right secondary anchor point;

wherein a top of each of said cushion left forward portion and said cushion right forward portion extending upward to support a user's chin;

a left connector half portion attached to said cushion left side portion;

a right connector half portion attached to said cushion right side portion; and a closure mechanism attached to one or both of said left connector half portion and said right connector half portion, said closure mechanism having a primary maximum tightening location when said left connector half portion is not engaged with said left secondary anchor point and said right connector half portion is not engaged with said right secondary anchor point;

wherein said closure mechanism has a secondary maximum tightening location different from said primary maximum tightening location when said left connector half portion is engaged with said left secondary anchor point and said right connector half portion is engaged with said right secondary anchor point; and wherein said cushion left side portion is shaped to define at least one left cushion air aperture and wherein said cushion right side portion is shaped to define at least one right cushion air aperture.

2. The pillow of claim 1, wherein said cushion rear portion is shaped to define at least one rear cushion air aperture.

3. The pillow of claim 1, wherein the top of each of said cushion left forward portion and said cushion right forward portion extend upward so as to define protrusions for supporting a user's chin.

4. The pillow of claim 3, wherein said protrusions are between 0.5 inch and 1.5 inches high.

5. The pillow of claim 3, wherein said protrusions are arcuate.

6. The pillow of claim 1, further comprising a generally U-shaped frame at least partially within said cushion, said frame comprising a frame left side portion, a frame right side portion, and a frame rear portion between said frame left side portion and said frame right side portion;

wherein said frame is more rigid than said cushion.

7. The pillow of claim 6, wherein said frame left side portion is shaped to define at least one left frame air aperture and wherein said frame right side portion is shaped to define at least one right frame air aperture; and wherein said left frame air aperture is at least partially aligned with said left cushion air aperture to as to form an air aperture through said pillow left side portion and wherein said right frame air aperture is at least partially aligned with said right cushion air aperture so as to form an air aperture through said pillow right side portion.

8. The pillow of claim 7, wherein said frame rear portion is shaped to define at least one frame rear air aperture and said cushion rear portion is shaped to define at least one cushion rear air aperture, said cushion rear air aperture at least partially aligned with said frame rear air aperture so as to form an air aperture through said pillow rear portion.

9. The pillow of claim 6, wherein said frame left side portion is shaped to define a plurality of left frame air apertures and wherein said frame right side portion is shaped to define a plurality of right frame air apertures;

wherein said cushion left side portion is shaped to define a plurality of left cushion air apertures including said at least one left cushion air aperture and wherein said cushion right side portion is shaped to define a plurality of right cushion air apertures including said at least one right cushion air aperture; and wherein said plurality of left frame air apertures are at least partially aligned with said left cushion air apertures so as to form a plurality of air apertures through said pillow left side portion, and wherein said plurality of right frame air apertures are at least partially aligned with said right cushion air apertures so as to form a plurality of air apertures through said pillow right side portion.

10. The pillow of claim 6, wherein said frame and said cushion are foam.

11. The pillow of claim 1, wherein a bottom of each of said cushion left forward portion and said cushion right forward portion extends downward to better fit to a user's shoulders.

12. The pillow of claim 1, further comprising a removable outer cover adapted to receive or contain said cushion, said removable outer cover comprising one or more ventilation areas collectively at least partially overlapping with said left cushion air aperture and said right cushion air aperture.

13. The pillow of claim 1, wherein each of said left cushion air aperture and said right cushion air aperture has a width or height of at least 0.1 inch.

14. The pillow of claim 1, wherein each of said left cushion air aperture and said right cushion air aperture has a width or height of at least 0.5 inch.

15. A pillow comprising:

a generally U-shaped cushion, said cushion comprising:

a left cushion side portion comprising a left primary anchor point and a left secondary anchor point; and a right cushion side portion comprising a right primary anchor point and a right secondary anchor point;

a left connector half portion attached to said left cushion side portion;

a right connector half portion attached to said right cushion side portion; and a closure mechanism attached to one or both of said left connector half portion and said right connector half portion, said closure mechanism having a primary maximum tightening location when said left connector half portion is not engaged with said left secondary anchor point and said right connector half portion is not engaged with said right secondary anchor point;

wherein said closure mechanism has a secondary maximum tightening location different from said primary maximum tightening location when said left connector half portion is engaged with said left secondary anchor point and said right connector half portion is engaged with said right secondary anchor point; and wherein the cushion left side portion is shaped to define at least one left cushion air aperture and wherein said cushion right side portion is shaped to define at least one right cushion air aperture.

16. The pillow of claim 15, wherein said left connector half portion is a left drawstring half and wherein said right connector half portion is a right drawstring half.

17. The pillow of claim 15, wherein said closure mechanism comprises a left closure portion attached to said left connector half portion and a right closure portion attached to said right connector half portion.

18. The pillow of claim 15, wherein said left secondary anchor point is forward of and below said left primary anchor point, and wherein said right secondary anchor point is forward of and below said right primary anchor point, such that said secondary maximum tightening position is configured to be further away from a user than said primary maximum tightening position.

19. The pillow of claim 15, wherein said cushion is shaped to define a left connector aperture and a right connector aperture; and wherein said left connector half portion is attached to said cushion through said left connector aperture, and wherein said right connector half portion is attached to said cushion through said right connector aperture.

20. The pillow of claim 19, wherein each of said left connector half portion and said right connector half portion is removably attached to said cushion.

21. The pillow of claim 20, further comprising a cover over said cushion;

wherein each of said left connector half portion and said right connector half portion is removably attached to said cushion through said cover.

22. The pillow of claim 19, further comprising an inner frame within said cushion, said inner frame more rigid than said cushion, and said inner frame shaped to define a left frame connector aperture aligned with said left connector aperture and a right frame connector aperture aligned with said right connector aperture; and wherein said left connector half portion is attached to said cushion through said left frame connector aperture, and wherein said right connector half portion is attached to said cushion through said right frame connector aperture.

23. A pillow comprising:

a generally U-shaped cushion, said cushion comprising a cushion left side portion, a cushion right side portion, and a cushion rear portion;

wherein the cushion left side portion is shaped to define at least one left cushion air aperture and wherein said cushion right side portion is shaped to define at least one right cushion air aperture;

wherein the cushion left side portion and the cushion right side portion includes a magnetic closure mechanism comprising:

a left portion positioned on the cushion left side portion, said left portion comprising an inner protrusion and a first magnet within said inner protrusion, wherein said first magnet comprises a surface flush with a surface of said inner protrusion and;

a right portion positioned on the cushion right side portion, the right portion shaped to define an inner indentation configured to interlock with said inner protrusion, said right portion further comprising a second magnet for engaging with said first magnet when said inner protrusion is interlocked with said inner indentation, wherein said second magnet comprises a surface flush with a surface at least partially defining said inner indentation.

24. The pillow of claim 23, wherein one of said inner protrusion and said inner indentation is shaped to define a post aperture, and wherein the other of said inner protrusion and said inner indentation is shaped to define a post for fitting into said post aperture.

25. The pillow of claim 24, wherein said post is on an outer portion of said inner protrusion and said post aperture is on an inner portion of said inner indentation.

26. The pillow of claim 24, wherein said post prevents or reduces the ease of horizontal disconnection of said left and right portions.

* * * * *